US011621482B2

(12) United States Patent
Yokokawa et al.

(10) Patent No.: US 11,621,482 B2
(45) Date of Patent: Apr. 4, 2023

(54) ANTENNA MANUFACTURING METHOD AND ANTENNA DEVICE

(71) Applicant: Mitsubishi Electric Corporation, Tokyo (JP)

(72) Inventors: Kei Yokokawa, Tokyo (JP); Narihiro Nakamoto, Tokyo (JP); Toru Fukasawa, Tokyo (JP); Hitoshi Arai, Tokyo (JP); Tomohiro Takahashi, Tokyo (JP); Kensuke Iwaki, Tokyo (JP); Takamichi Kono, Tokyo (JP); Keisuke Fujiwara, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/615,840

(22) PCT Filed: Jun. 24, 2019

(86) PCT No.: PCT/JP2019/024949

§ 371 (c)(1),
(2) Date: Dec. 2, 2021

(87) PCT Pub. No.: WO2020/261332

PCT Pub. Date: Dec. 30, 2020

(65) Prior Publication Data

US 2022/0209402 A1 Jun. 30, 2022

(51) Int. Cl.
*H01Q 1/42* (2006.01)
*H01Q 9/04* (2006.01)
(Continued)

(52) U.S. Cl.
CPC ..... *H01Q 1/42* (2013.01); *H01Q 9/0421* (2013.01); *H01Q 21/0025* (2013.01); *H01Q 21/065* (2013.01)

(58) Field of Classification Search
CPC .... H01Q 1/42; H01Q 9/0421; H01Q 21/0025; H01Q 21/065
See application file for complete search history.

(56) References Cited

U.S. PATENT DOCUMENTS 5,210,542 A 5/1993 Pett et al.
2017/0117633 A1 4/2017 Park et al.
(Continued)

FOREIGN PATENT DOCUMENTS

JP 5-218729 A 8/1993
JP 9-98016 A 4/1997
(Continued)

OTHER PUBLICATIONS

Yan et al., "IEEE Transactions on Antennas and Propagation, vol. 67, No. 2, Feb. 2019" pp. 1284-1288 (Year: 2019).*
(Continued)

*Primary Examiner* — Dieu Hien T Duong
(74) *Attorney, Agent, or Firm* — Xsensus LLP

(57) ABSTRACT

A conductor ground plane provided on a dielectric substrate and provided with a patch antenna and a conductor ground plane provided on the side of a dielectric substrate having a through hole are bonded by solder in a state where the through hole and the patch antenna are arranged to face each other, and a conductor ground plane provided on the back side of the dielectric substrate and a conductor ground plane provided on a dielectric substrate are bonded by solder.

12 Claims, 37 Drawing Sheets

(51) Int. Cl.
*H01Q 21/00* (2006.01)
*H01Q 21/06* (2006.01)

(56) References Cited

U.S. PATENT DOCUMENTS

| | | | | |
|---|---|---|---|---|
| 2019/0081404 | A1 | 3/2019 | Jeon et al. | |
| 2020/0161766 | A1* | 5/2020 | Liu | H01Q 9/045 |
| 2020/0303822 | A1* | 9/2020 | Yao | H01L 21/563 |
| 2021/0184365 | A1* | 6/2021 | Park | H01Q 15/0086 |
| 2021/0242601 | A1* | 8/2021 | Johansson | H01Q 21/0025 |

FOREIGN PATENT DOCUMENTS

| | | | |
|---|---|---|---|
| JP | 2000-138525 | A | 5/2000 |
| JP | 2009-188895 | A | 8/2009 |
| JP | 2019-54515 | A | 4/2019 |
| WO | 2018/210054 | A1 | 11/2018 |

OTHER PUBLICATIONS

Extended European Search Report dated Jun. 15, 2022, in corresponding European Patent Application 19934581.0.
International Search Report and Written Opinion dated Jul. 16, 2019, received for PCT Application PCT/JP2019/024949, Filed on Jun. 24, 2019, 9 pages including English Translation.
Decision to Grant dated Feb. 9, 2021, received for JP Application 2020-568002, 5 pages including English Translation.

* cited by examiner

ANTENNA MANUFACTURING METHOD AND ANTENNA DEVICE

CROSS-REFERENCE TO RELATED APPLICATION

The present application is based on PCT filing PCT/JP2019/024949, filed Jun. 24, 2019, the entire contents of which are incorporated herein by reference.

TECHNICAL FIELD

The present disclosure relates to an antenna manufacturing method and an antenna device.

BACKGROUND ART

In order to perform wireless communication in a wide angle even when radio waves are extremely weak, an array antenna device is demanded to have a high gain and a low axial ratio when performing beam scanning in a wide angle direction. The wide angle direction indicates a direction of a zenith angle ±60 degrees or more when the antenna is disposed horizontally with respect to the ground. The amplitude difference between a vertically polarized wave and a horizontally polarized wave in the wide angle direction is a factor tor causing the degradation of the axial ratio when beam scanning is performed in the wide angle direction.

For example, Patent Literature 1 discloses an antenna used as an antenna element of an array antenna. The antenna includes a first dielectric substrate, a second dielectric substrate, and a cylindrical member. The first dielectric substrate has a circular feed conductor on its front side, and a ground conductor on its back side. The second dielectric substrate has a back side facing the front side of the first dielectric substrate, and has a circular parasitic conductor formed on its front side. The cylindrical member is provided around a space defined by bonding a peripheral edge of the parasitic conductor and a peripheral edge of the feed conductor, and is made of dielectric material or conductive material.

In the antenna disclosed in Patent Literature 1, the space defined by bonding the peripheral edge of the parasitic conductor and the peripheral edge of the feed conductor by the cylindrical member is hollow, so that the equivalent dielectric constant of the dielectric substrates decreases. In addition, the amplitude difference between the vertically polarized wave and the horizontally polarized wave in the wide angle direction varies with a variation in the equivalent dielectric constant of the dielectric substrates. The antenna disclosed in Patent Literature 1 can adjust the amplitude difference between the vertically polarized wave and the horizontally polarized wave in the wide angle direction by varying the equivalent dielectric constant of the dielectric substrates by the hollow structure.

CITATION LIST

Patent Literature

Patent Literature 1: JP 2000-138525 A

SUMMARY OF INVENTION

Technical Problem

A conventional antenna represented by Patent Literature 1 is produced by performing hot pressing in a state where a plurality of dielectric substrates overlap each other. For example, hot pressing is performed in a state where the cylindrical member is provided on a substrate formed of a thermosetting dielectric material, and the first dielectric substrate and the second dielectric substrate are disposed so as to sandwich the substrate from both sides.

During hot pressing, the heated and melted dielectric material of the substrate flows through a gap between the first dielectric substrate and the second dielectric substrate, the gap is filled with this material, and it is cured in the gap. At this time, the periphery of the cylindrical member is filled with the dielectric material, but the space surrounded by the cylindrical member has no filling material and a portion corresponding to the opening of the cylindrical member is not supported by the filling material, and thus, a hollow structure is formed.

For this reason, there is a possibility that a portion of the first dielectric substrate or the second dielectric substrate corresponding to the opening of the cylindrical member is recessed and deformed by a stress generated inside the dielectric substrates by the hot pressing, and there is a problem that desired characteristics cannot be obtained with the antenna deformed as described above.

The present disclosure addresses the above problems, and an object thereof is to obtain an antenna manufacturing method and an antenna device capable of preventing deformation of an antenna.

Solution to Problem

An antenna device according to the present disclosure comprises: a first dielectric substrate provided with a first conductor ground plane; a patch antenna provided on the first conductor ground plane; a second dielectric substrate including a second conductor ground plane provided on a first side and a third conductor ground plane provided on a second side opposite to the first side, the second dielectric substrate having a through hole penetrating the second dielectric substrate from the second conductor ground plane to the third conductor ground plane; and a third dielectric substrate provided with a fourth conductor ground plane, wherein, in a state in which the through hole and the patch antenna are arranged to face each other, the first conductor ground plane of the first dielectric substrate and the second conductor ground plane of the second dielectric substrate are bonded by a first solder, and the third conductor ground plane of the second dielectric substrate and the fourth conductor ground plane of the third dielectric substrate are bonded by a second solder.

Advantageous Effects of Invention

According to the present disclosure, the first conductor ground plane provided on the first dielectric substrate and provided with the patch antenna and the second conductor ground plane provided on the first side of the second dielectric substrate having the through hole are bonded by the first solder in a state where the through hole and the patch antenna are arranged to face each other, and the third conductor ground plane provided on the second side of the second dielectric substrate and the fourth conductor ground plane provided on the third dielectric substrate are bonded by the second solder. Since the dielectric substrates are bonded using solder, a stress generated inside the dielectric substrates can be minimized as compared with bonding by hot pressing, so that deformation of the antenna can be prevented.

DESCRIPTION OF EMBODIMENTS

First Embodiment

Figure 1:
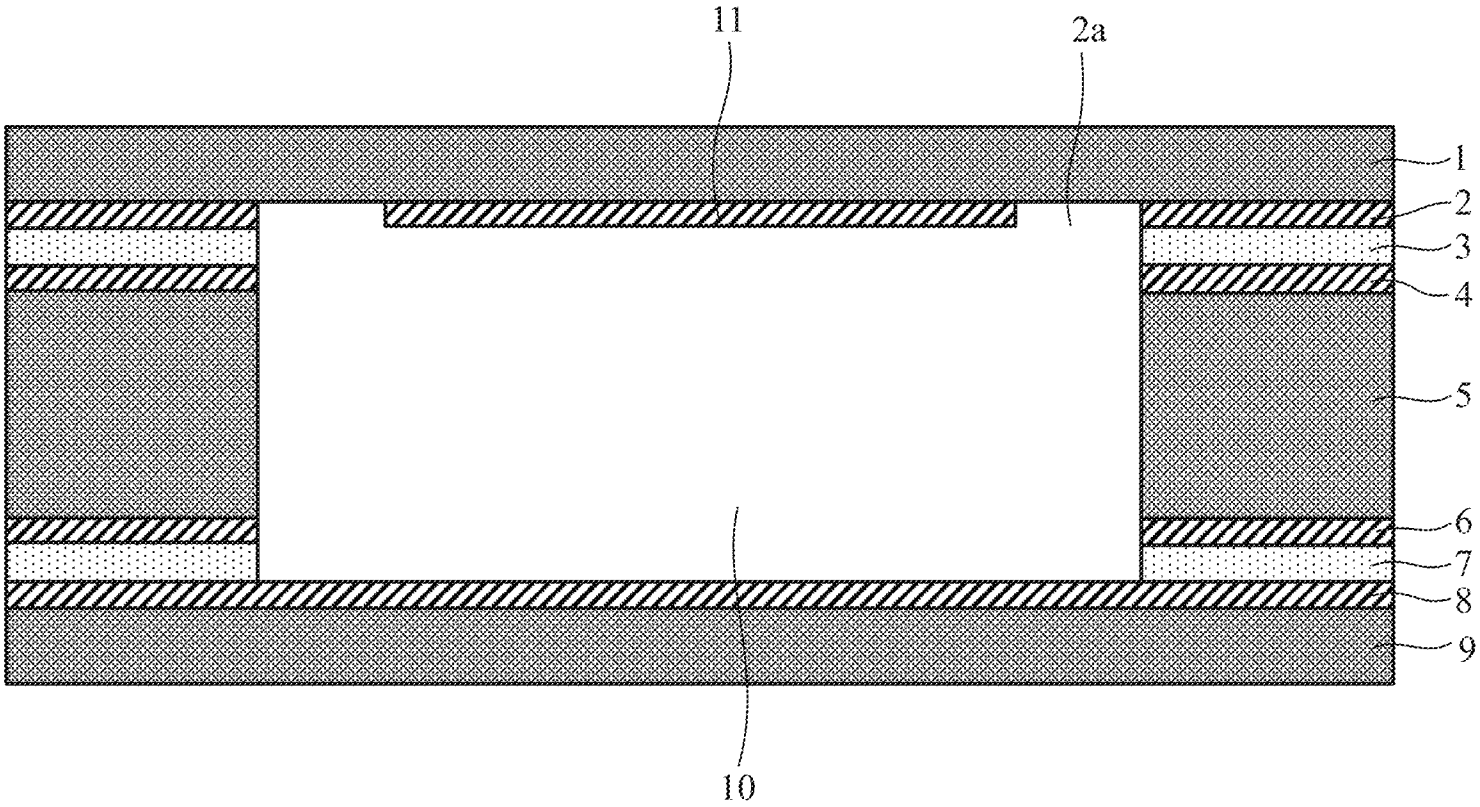
FIG. 1 is a longitudinal sectional view illustrating a configuration of an antenna device according to a first embodiment.
Figure 2:
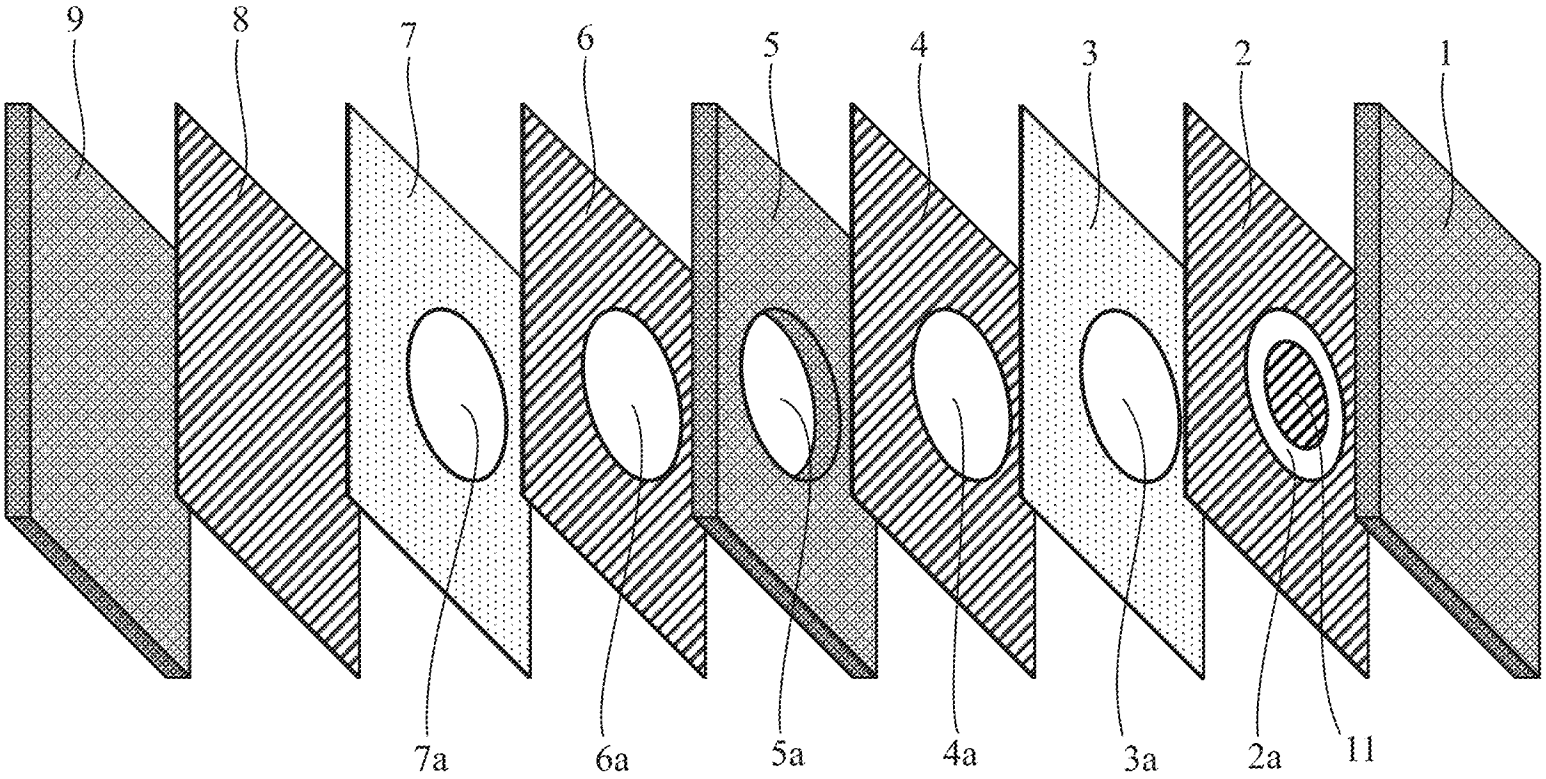
FIG. 2 is an exploded perspective view illustrating the configuration of the antenna device in FIG. 1.

FIG. 1 is a longitudinal sectional view illustrating a configuration of an antenna device according to the first embodiment. FIG. 2 is an exploded perspective view illustrating the configuration of the antenna device illustrated in FIG. 1. As illustrated in FIG. 1, the antenna device according to the first embodiment includes a dielectric substrate 1, a conductor ground plane 2, solder 3, a conductor ground plane 4, a dielectric substrate 5, a conductor ground plane 6, solder 7, a conductor ground plane 8, and a dielectric substrate 9. Inside a dielectric substrate obtained by bonding the dielectric substrate 1, the dielectric substrate 5, and the dielectric substrate 9, a hollow structure 10 for adjusting an equivalent dielectric constant of the dielectric substrate is provided, and a patch antenna 11 faces the hollow structure 10.

The dielectric substrate 1 is a first dielectric substrate having the conductor ground plane 2. The conductor ground plane 2 is a first conductor ground plane provided on the entire back side of the dielectric substrate 1, and is provided with the patch antenna 11. The patch antenna 11 is a first patch antenna formed in a circular shape, and is formed on the conductor ground plane 2 by providing a conductor removed portion 2*a* in the conductor ground plane 2 as illustrated in FIG. 2.

The conductor removed portion 2*a* is a portion formed by removing the conductor from the conductor ground plane 2 along the outer shape of the patch antenna 11. When the patch antenna 11 has a circular shape, the conductor removed portion 2*a* is an annular portion formed by removing the conductor from the conductor ground plane 2 as illustrated in FIG. 2. Note that the patch antenna 11 is not limited to one having a circular shape, and it may have, for example, a polygonal shape such as a triangular shape or a quadrangular shape.

The dielectric substrate 5 is a second dielectric substrate including the conductor ground plane 4 and the conductor ground plane 6. The conductor ground plane 4 is a second conductor ground plane provided on the entire front side (first side) of the dielectric substrate 5, and the conductor ground plane 6 is a third conductor ground plane provided on the entire side (back side, second side) opposite to the front side of the dielectric substrate 5.

The dielectric substrate 5 has a through hole 5*a* penetrating from the conductor ground plane 4 to the conductor ground plane 6. The conductor ground plane 2 of the dielectric substrate 1 and the conductor ground plane 4 of the dielectric substrate 5 are bonded by the solder 3 in a state where the through hole 5*a* and the patch antenna 11 are arranged to face each other. The solder 3 is a first solder for bonding the conductor ground planes, and is, for example, cream solder.

The through hole 5*a* penetrates the dielectric substrate 5 from the conductor ground plane 4 to the conductor ground plane 6. Therefore, as illustrated in FIG. 2, an opening 4*a* having the same opening shape as the through hole 5*a* is formed in the conductor ground plane 4, and an opening 6*a* having the same opening shape as the through hole 5*a* is formed in the conductor ground plane 6. The solder 3 is not applied to the patch antenna 11 and the conductor removed portion 2*a* in the conductor ground plane 2 and a region 3*a* facing the opening 4*a* in the conductor ground plane 4, but applied to a portion other than the region 3*a* in the conductor ground plane 2 or the conductor ground plane 4.

The dielectric substrate 9 is a third dielectric substrate having the conductor ground plane 8. The conductor ground plane 8 is a fourth conductor ground plane provided on the entire front side of the dielectric substrate 9. The conductor ground plane 6 of the dielectric substrate 5 and the conductor ground plane 8 of the dielectric substrate 9 are bonded by the solder 7. The solder 7 is a second solder for bonding the conductor ground planes, and is, for example, cream solder. The solder 7 is not applied to the through hole 5*a* and a region 7*a* facing the opening 6*a*, but applied to a portion other than the region 7*a* in the conductor ground plane 6 or the conductor ground plane 8.

The hollow structure 10 is constituted by the patch antenna 11, the conductor removed portion 2*a*, the region 3*a*, the opening 4*a*, the through hole 5*a*, the opening 6*a*, the region 7*a*, and the conductor ground plane 8. The size of the hollow structure 10 is set so that a gain difference between a vertically polarized wave and a horizontally polarized wave decreases when the antenna device illustrated in FIG. 1 performs beam scanning in a wide angle direction. This suppresses a decrease in an axial ratio when beam scanning is performed in the wide angle direction. Note that the solder 3 and the solder 7 are applied in an amount that does not cause leakage into the hollow structure 10 when melted.

Next, an antenna manufacturing method according to the first embodiment will be described.

Figure 3:
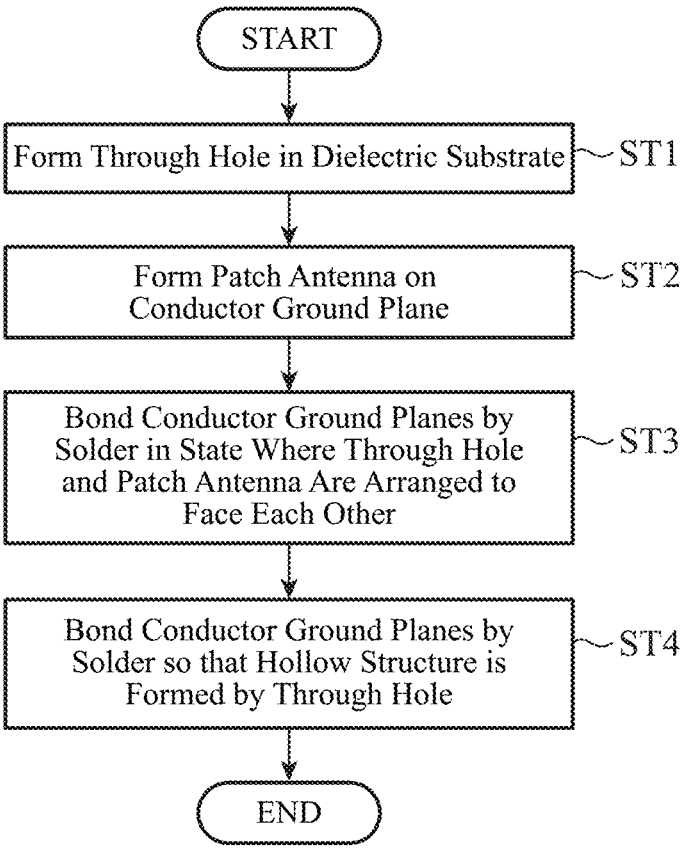
FIG. 3 is a flowchart illustrating an antenna manufacturing method according to the first embodiment.

FIG. 3 is a flowchart illustrating the antenna manufacturing method according to the first embodiment, and illustrates a method for manufacturing the antenna device illustrated in FIG. 1.

First, the through hole 5*a* is formed in the dielectric substrate 5 (step ST1). The through hole 5*a* is formed to penetrate the dielectric substrate 5 from the conductor ground plane 4 to the conductor ground plane 6. The through hole 5*a* can be formed by, for example, machining by a drill, a punch press machine, or a laser.

The patch antenna 11 is formed on the conductor ground plane 2 of the dielectric substrate 1 (step ST2). The patch antenna 11 is formed on the conductor ground plane 2 at a position to be faced by the through hole 5*a* when the dielectric substrate 1 is bonded to the dielectric substrate 5. For example, the patch antenna 11 to be formed is set on the conductor ground plane 2, and the conductor removed portion 2*a* is formed by removing the conductor from the conductor ground plane 2 along the outer shape of the patch antenna 11. The conductor is removed from the conductor ground plane 2 by copper foil punching such as etching.

The conductor ground plane 2 of the dielectric substrate 1 and the conductor ground plane 4 of the dielectric substrate 5 are bonded by the solder 3 in a state where the through hole 5*a* and the patch antenna 11 are arranged to face each other (step ST3). For example, the solder 3 is applied to a portion other than the region 3*a* in the conductor ground plane 2 or the conductor ground plane 4. A structure in which the solder 3 is applied between the conductor ground plane 2 and the conductor ground plane 4 is passed through a reflow furnace so that the solder 3 is melted. Thus, the conductor ground plane 2 and the conductor ground plane 4 are bonded to each other.

The conductor ground plane 6 of the dielectric substrate 5 and the conductor ground plane 8 of the dielectric substrate 9 are bonded by the solder 7 so that the hollow structure 10 is formed between the dielectric substrate 1 and the dielectric substrate 9 by the through hole 5*a* (step ST4). For example, the solder 7 is applied to a portion other than the region 7*a* in the conductor ground plane 6 or the conductor ground plane 8. A structure in which the solder 7 is applied between the conductor ground plane 6 and the conductor ground plane 8 is passed through a reflow furnace so that the solder 7 is melted. Thus, the conductor ground plane 6 and the conductor ground plane 8 are bonded to each other.

Note that the order of the processes of steps ST3 and ST4 may be reversed, or these processes may be performed simultaneously. For example, a structure in which the solder 3 is applied between the conductor ground plane 2 and the conductor ground plane 4 and the solder 7 is applied between the conductor ground plane 6 and the conductor ground plane 8 may be passed through a reflow furnace so that the solder 3 and the solder 7 are melted, whereby the conductor ground plane 2 and the conductor ground plane 4, and the conductor ground plane 6 and the conductor ground plane 8 may be simultaneously bonded.

In the antenna device according to the first embodiment, a substrate with an equivalently low dielectric constant can be achieved by providing the hollow structure 10 between the patch antenna 11 and the conductor ground plane 8. Accordingly, the antenna device according to the first embodiment has improved radiation efficiency and improved gain when beam scanning is performed in the wide angle direction, as compared with a typical patch antenna that does not have a hollow structure.

Furthermore, the gain difference between the vertically polarized wave and the horizontally polarized wave in the wide angle direction in the antenna device according to the first embodiment can be improved by appropriately designing the size of the hollow structure 10. For example, in order to suppress a decrease in the axial ratio when the antenna device according to the first embodiment performs beam scanning in the wide angle direction, the size of the hollow structure 10 may be designed so that the gain difference between the vertically polarized wave and the horizontally polarized wave in the wide angle direction decreases.

Although the dielectric substrate 1 in which the conductor ground plane 2 is provided on the back side has been described above, the conductor ground plane 2 may be provided on both the front side and the back side of the dielectric substrate 1. In this case, the patch antenna 11 may be provided only on the conductor ground plane 2 on the back side of the dielectric substrate 1, or may be provided only on the conductor ground plane 2 on the front side of the dielectric substrate 1. Although the configuration in which there is no via in all the layers of the dielectric substrate 1, the dielectric substrate 5, and the dielectric substrate 9 has been described above, all or any of these substrates may have a via.

As described above, in the antenna manufacturing method according to the first embodiment, the conductor ground plane 2 provided on the dielectric substrate 1 and provided with the patch antenna 11 and the conductor ground plane 4 provided on the side of the dielectric substrate 5 having the through hole 5*a* are bonded by the solder 3 in a state where the through hole 5*a* and the patch antenna 11 are arranged to face each other, and the conductor ground plane 6 provided on the back side of the dielectric substrate 5 and the conductor ground plane 8 provided on the dielectric substrate 9 are bonded by the solder 7. Therefore, in the antenna manufacturing method according to the first embodiment, a stress generated inside the dielectric substrate can be minimized as compared with bonding by hot pressing, so that deformation of the antenna can be prevented.

Second Embodiment

Figure 4:
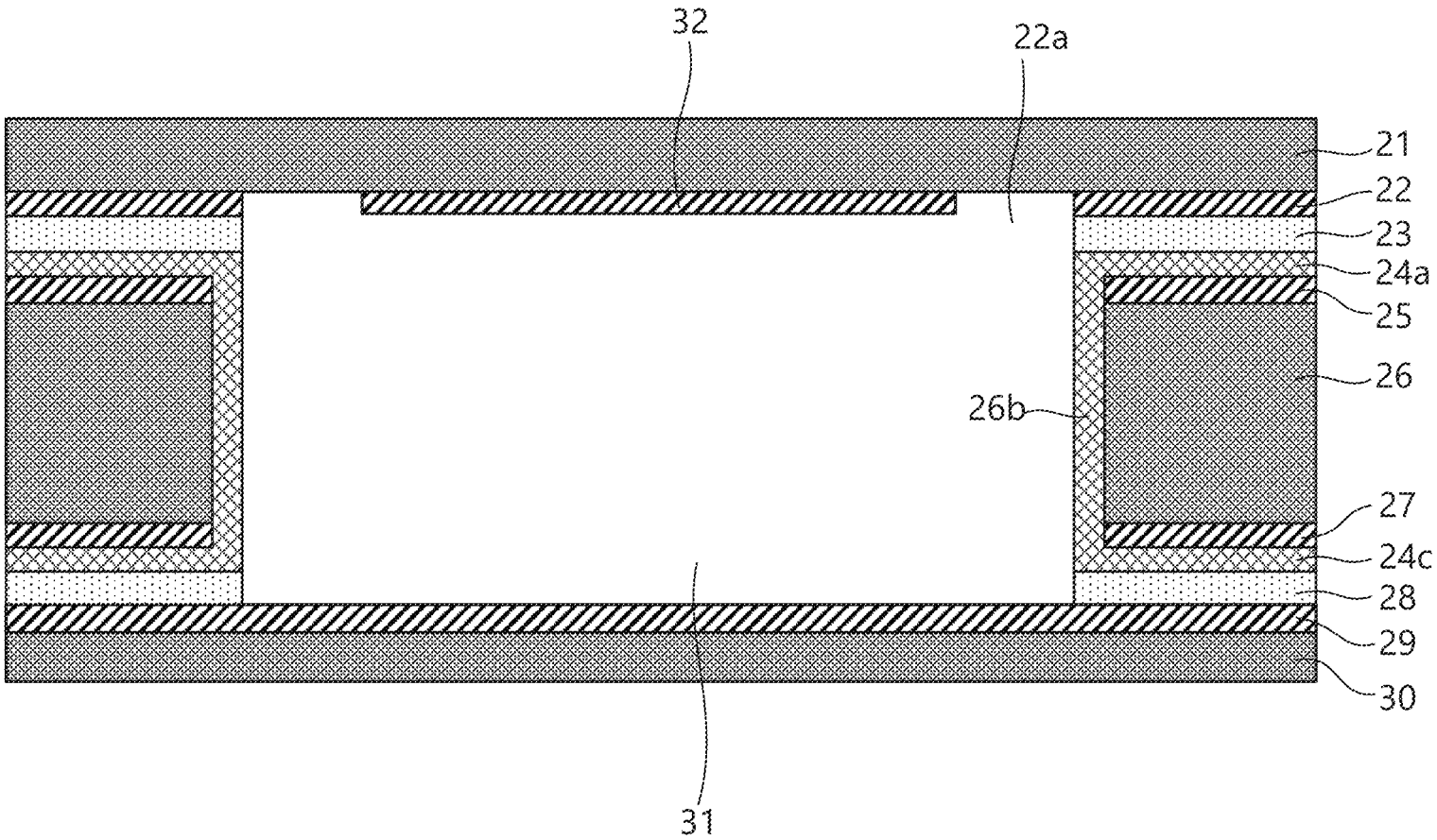
FIG. 4 is a longitudinal sectional view illustrating a configuration of an antenna device according to a second embodiment.
Figure 5:
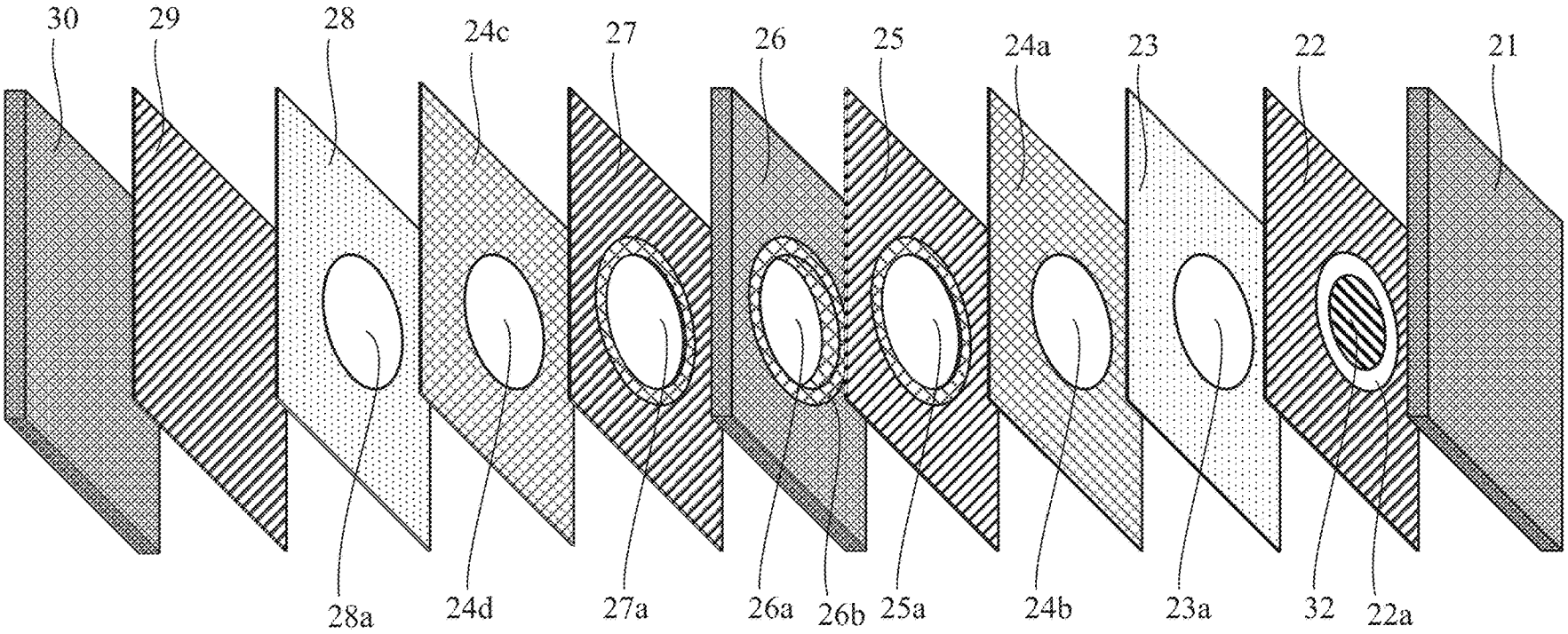
FIG. 5 is an exploded perspective view illustrating the configuration of the antenna device in FIG. 4.

FIG. 4 is a longitudinal sectional view illustrating a configuration of an antenna device according to the second embodiment. FIG. 5 is an exploded perspective view illustrating the configuration of the antenna device shown in FIG. 4. As illustrated in FIG. 4, the antenna device according to the second embodiment includes a dielectric substrate 21, a conductor ground plane 22, solder 23, a conductor ground plane 25, a dielectric substrate 26, a conductor ground plane 27, solder 28, a conductor ground plane 29, and a dielectric substrate 30. As illustrated in FIG. 4, inside a dielectric substrate obtained by bonding the dielectric substrate 21, the dielectric substrate 26, and the dielectric substrate 30, a hollow structure 31 for adjusting an equivalent dielectric constant of the dielectric substrate is provided, and a patch antenna 32 faces the hollow structure 31.

The dielectric substrate 21 is a first dielectric substrate having the conductor ground plane 22. The conductor ground plane 22 is a first conductor ground plane provided on the entire back side of the dielectric substrate 21, and is provided with the patch antenna 32. The patch antenna 32 is a first patch antenna formed in a circular shape, and is formed on the conductor ground plane 22 by providing a conductor removed portion 22*a* in the conductor ground plane 22 as illustrated in FIG. 5.

The conductor removed portion 22*a* is a portion formed by removing the conductor from the conductor ground plane 22 along the outer shape of the patch antenna 32. When the patch antenna 32 has a circular shape, the conductor removed portion 22*a* is an annular portion formed by removing the conductor from the conductor ground plane 22 as illustrated in FIG. 5. Note that the patch antenna 32 is not limited to one having a circular shape, and it may have, for example, a polygonal shape such as a triangular shape or a quadrangular shape.

The dielectric substrate 26 is a second dielectric substrate including the conductor ground plane 25 and the conductor ground plane 27. The conductor ground plane 25 is a second conductor ground plane provided on the entire front side (first side) of the dielectric substrate 26, and the conductor ground plane 27 is a third conductor ground plane provided on the entire side (back side, second side) opposite to the front side of the dielectric substrate 26. The dielectric substrate 26 has a through hole 26*a* penetrating from the conductor ground plane 25 to the conductor ground plane 27.

The dielectric substrate 26 in which the through hole 26*a* is formed is subjected to conductor plating processing. By the conductor plating processing, conductor plating 24*a* is provided on an upper layer of the conductor ground plane 25, conductor plating 26*b* is provided on the side wall of the through hole 26*a*, and conductor plating 24*c* is provided on a lower layer of the conductor ground plane 27 as illustrated in FIGS. 4 and 5.

The conductor ground plane 22 of the dielectric substrate 21 and the conductor ground plane 25 of the dielectric substrate 26 are bonded by the solder 23 via the conductor plating 24*a* in a state where the through hole 26*a* and the patch antenna 32 are arranged to face each other. For example, the dielectric substrate 21 and the dielectric substrate 26 are bonded with the patch antenna 32 facing the through hole 26*a* as illustrated in FIG. 5. The solder 23 is a first solder for bonding the conductor ground planes.

The through hole 26*a* penetrates the dielectric substrate 26 from the conductor ground plane 25 to the conductor ground plane 27. Therefore, as illustrated in FIG. 5, an opening 24*b* having the same opening shape as the through hole 26*a* is formed in the conductor plating 24*a*, and an opening 25*a* having the same opening shape as the through hole 26*a* is formed in the conductor ground plane 25. The solder 23 is not applied to a region 23*a* facing the patch antenna 32 and the conductor removed portion 22*a*, but applied to a portion other than the region 23*a*.

The dielectric substrate 30 is a third dielectric substrate having the conductor ground plane 29. The conductor ground plane 29 is a fourth conductor ground plane provided on the entire side of the dielectric substrate 30. The conductor ground plane 27 of the dielectric substrate 26 and the conductor ground plane 29 of the dielectric substrate 30 are bonded by the solder 28 via the conductor plating 24*c*. The through hole 26*a* penetrates the dielectric substrate 26 from the conductor ground plane 25 to the conductor ground plane 27. Therefore, as illustrated in FIG. 5, an opening 27*a* having the same opening shape as the through hole 26*a* is formed in the conductor ground plane 27, and an opening 24*d* having the same opening shape as the through hole 26*a* is formed in the conductor plating 24*c*.

The solder 28 is a second solder for bonding the conductor ground planes. The solder 28 is not applied to a region 28*a* facing the through hole 26*a* and the opening 27*a*, but applied to a portion other than the region 28*a* in the conductor ground plane 27 or the conductor ground plane 29.

The hollow structure 31 is constituted by the patch antenna 32, the conductor removed portion 22*a*, the region 23*a*, the opening 24*b*, the opening 25*a*, the through hole 26*a*, the opening 27*a*, the opening 24*d*, the region 28*a*, and the conductor ground plane 29. The size of the hollow structure 31 is set so that a gain difference between a vertically polarized wave and a horizontally polarized wave decreases when the antenna device illustrated in FIG. 4 performs beam scanning in a wide angle direction. This suppresses a decrease in an axial ratio when beam scanning is performed in the wide angle direction. Note that the solder 23 and the solder 28 are applied in an amount that does not cause leakage into the hollow structure 31 when melted.

Next, an antenna manufacturing method according to the second embodiment will be described.

Figure 6:
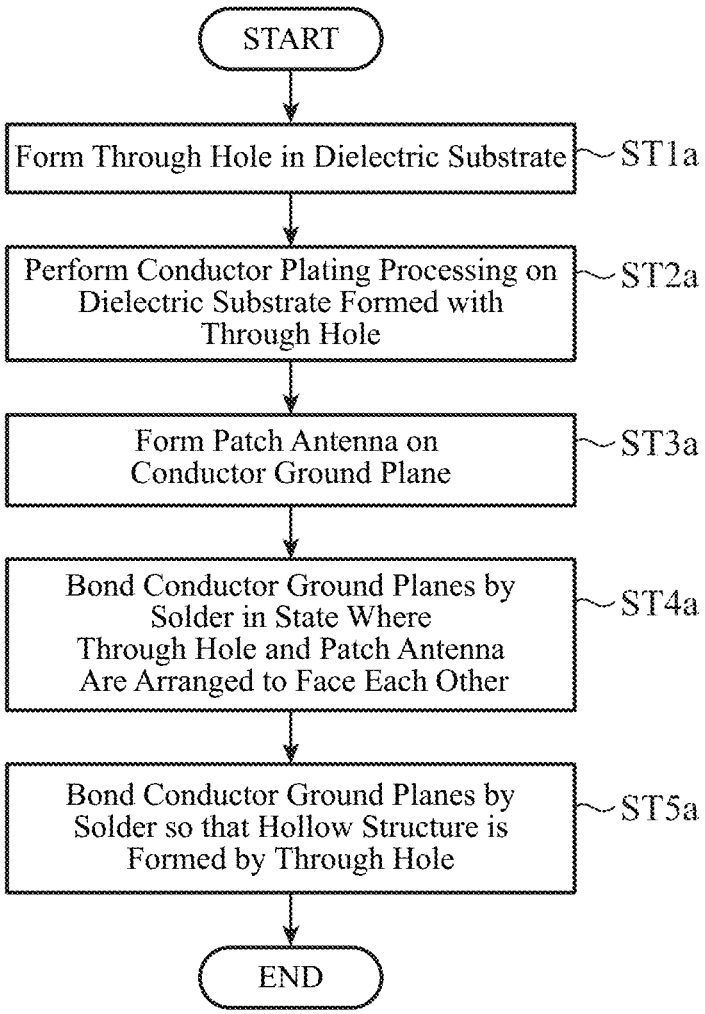
FIG. 6 is a flowchart illustrating an antenna manufacturing method according to the second embodiment.

FIG. 6 is a flowchart illustrating the antenna manufacturing method according to the second embodiment, and illustrates a method for manufacturing the antenna device illustrated in FIG. 4. First, the through hole 26*a* is formed in the dielectric substrate 26 (step ST1*a*). The through hole 26*a* is formed to penetrate the dielectric substrate 26 from the conductor ground plane 25 to the conductor ground plane 27. The through hole 26*a* can be formed by, for example, machining by a drill, a punch press machine, or a laser.

The dielectric substrate 26 in which the through hole 26*a* is formed is subjected to conductor plating processing (step ST2*a*). As the conductor plating processing, a sputtering method or electrolytic plating can be used, for example. By performing the conductor plating processing on the dielectric substrate 26, the conductor plating 24*a* is provided on the conductor ground plane 25, the conductor plating 26*b* is provided on the side wall of the through hole 26*a*, and the conductor plating 24*c* is provided on the conductor ground plane 27.

Next, the patch antenna 32 is formed on the conductor ground plane 22 of the dielectric substrate 21 (step ST3*a*). The patch antenna 32 is formed on the conductor ground plane 22 at a position to be faced by the through hole 26*a* when the dielectric substrate 21 is bonded to the dielectric substrate 26. For example, the patch antenna 32 to be formed is set on the conductor ground plane 22, and the conductor removed portion 22*a* is formed by removing the conductor from the conductor ground plane 22 along the outer shape of the patch antenna 32. The conductor is removed from the conductor ground plane 22 by copper foil punching such as etching.

The conductor ground plane 22 of the dielectric substrate 21 and the conductor ground plane 25 of the dielectric substrate 26 are bonded by the solder 23 via the conductor plating 24*a* in a state where the through hole 26*a* and the patch antenna 32 are arranged to face each other (step ST4*a*). For example, the solder 23 is applied to a portion other than the region 23*a* in the conductor ground plane 22. A structure in which the solder 23 is applied between the conductor ground plane 22 and the conductor ground plane 25 is passed through a reflow furnace so that the solder 23 is melted. Thus, the conductor ground plane 22 and the conductor ground plane 25 are bonded to each other.

The conductor ground plane 27 of the dielectric substrate 26 and the conductor ground plane 29 of the dielectric substrate 30 are bonded by the solder 28 via the conductor plating 24*c* so that the hollow structure 31 is formed between the dielectric substrate 21 and the dielectric substrate 30 by the through hole 26*a* (step ST5*a*). For example, the solder 28 is applied to a portion other than the region 28*a* in the conductor ground plane 27. A structure in which the solder 28 is applied between the conductor ground plane 27 and the conductor ground plane 29 is passed through a reflow furnace so that the solder 28 is melted. Thus, the conductor ground plane 27 and the conductor ground plane 29 are bonded to each other.

Note that the order of the processes of steps ST4*a* and ST5*a* may be reversed, or these processes may be performed simultaneously. For example, a structure in which the solder 23 is applied between the conductor ground plane 22 and the conductor ground plane 25 and the solder 28 is applied between the conductor ground plane 27 and the conductor ground plane 29 may be passed through a reflow furnace so that the solder 23 and the solder 28 are melted, whereby the conductor ground plane 22 and the conductor ground plane 25, and the conductor ground plane 27 and the conductor ground plane 29 may be simultaneously bonded.

In the antenna device according to the second embodiment, a substrate with an equivalently low dielectric constant can be achieved by providing the hollow structure 31 between the patch antenna 32 and the conductor ground plane 29. In addition, since the conductor plating 26*b* is provided on the side wall of the hollow structure 31, it is possible to suppress a side wave inside the substrate that causes a decrease in gain when beam scanning is performed in the wide angle direction.

Furthermore, the gain difference between a vertically polarized wave and a horizontally polarized wave in the wide angle direction in the antenna device according to the second embodiment can be improved by appropriately designing the size of the hollow structure 31. For example, in order to suppress a decrease in the axial ratio when the antenna device according to the second embodiment performs beam scanning in the wide angle direction, the size of the hollow structure 31 may be designed so that the gain difference between the vertically polarized wave and the horizontally polarized wave in the wide angle direction decreases.

Although the dielectric substrate 21 in which the conductor ground plane 22 is provided on the back side has been described above, the conductor ground plane 22 may be provided on both the front side and the back side of the dielectric substrate 21. In this case, the patch antenna 32 may be provided only on the conductor ground plane 22 on the back side of the dielectric substrate 21, or may be provided only on the conductor ground plane 22 on the front side of the dielectric substrate 21. Although the configuration in which there is no via in all the layers of the dielectric substrate 21, the dielectric substrate 26, and the dielectric substrate 30 has been described above, all or any of these substrates may have a via.

As described above, in the antenna manufacturing method according to the second embodiment, the conductor plating processing is performed on the side wall of the through hole 26*a*. Due to the conductor plating 26*b* provided on the side wall of the hollow structure 31, it is possible to suppress a surface wave inside the substrate that causes a decrease in gain when beam scanning is performed in the wide angle direction. Furthermore, the antenna device according to the second embodiment has improved radiation efficiency and improved gain when beam scanning is performed in the wide angle direction, as compared with a typical patch antenna that does not have a hollow structure.

Third Embodiment

Figure 7:
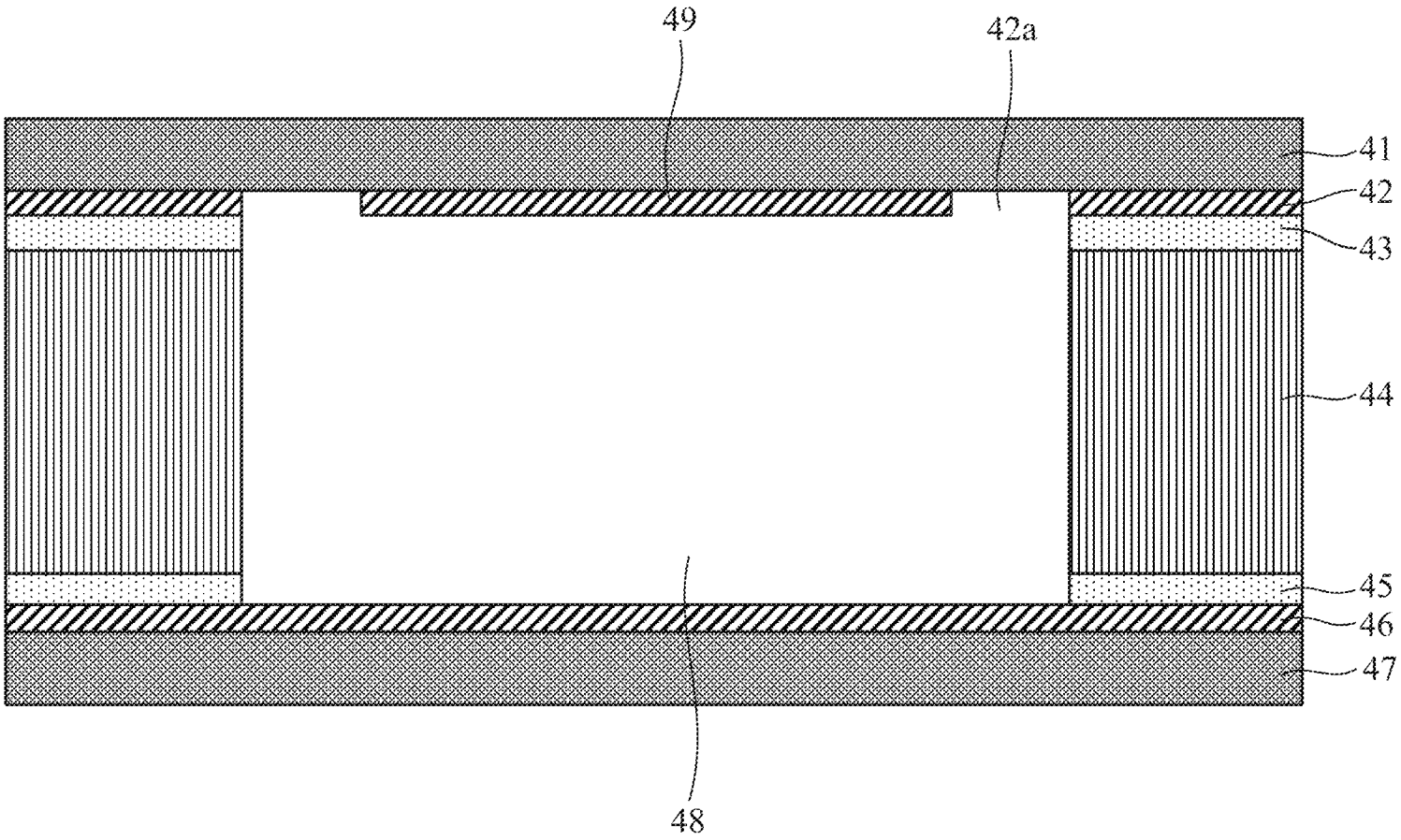
FIG. 7 is a longitudinal sectional view illustrating a configuration of an antenna device according to a third embodiment.
Figure 8:
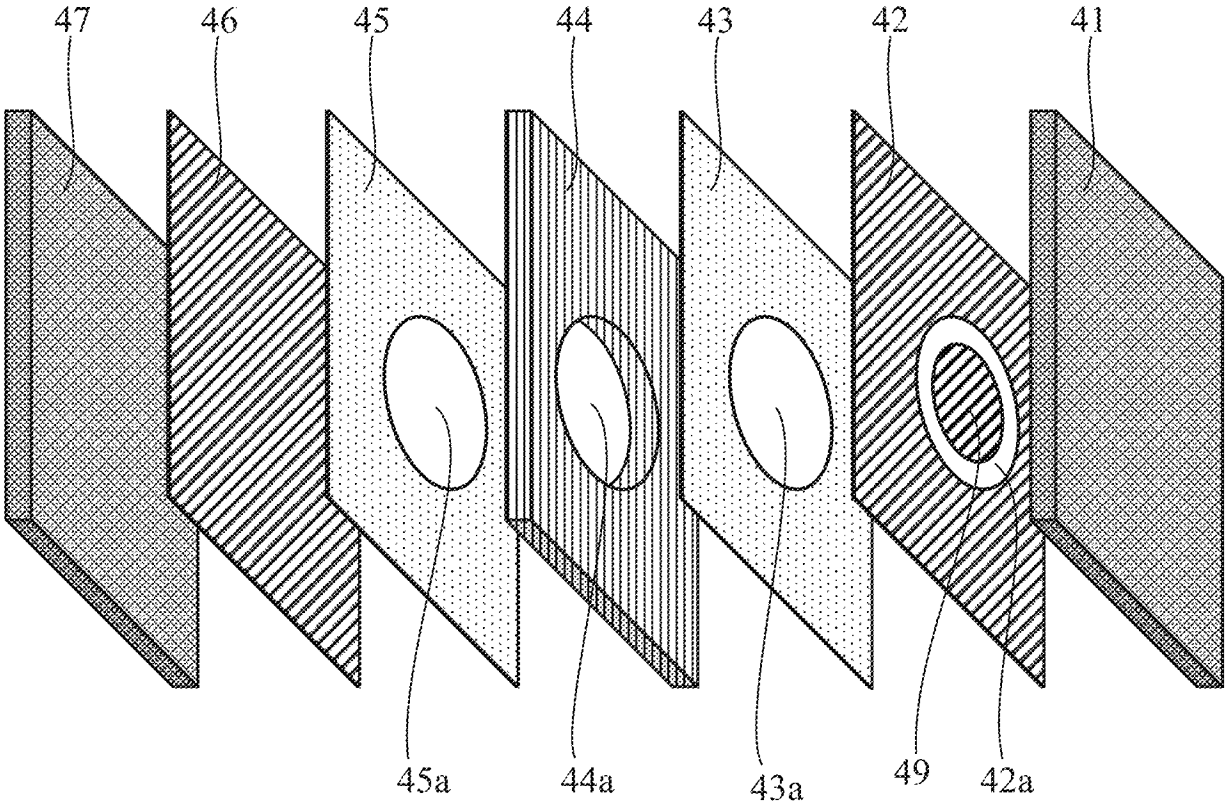
FIG. 8 is an exploded perspective view illustrating the configuration of the antenna device in FIG. 7.

FIG. 7 is a longitudinal sectional view illustrating a configuration of an antenna device according to the third embodiment. FIG. 8 is an exploded perspective view illustrating the configuration of the antenna device shown in FIG. 7. As illustrated in FIG. 7, the antenna device according to the third embodiment includes a dielectric substrate 41, a conductor ground plane 42, solder 43, a conductor plate 44, solder 45, a conductor ground plane 46, and a dielectric substrate 47. Inside a dielectric substrate obtained by bonding the dielectric substrate 41, the conductor plate 44, and the dielectric substrate 47, a hollow structure 48 for adjusting an equivalent dielectric constant of the dielectric substrate is provided, and a patch antenna 49 faces the hollow structure 48.

The dielectric substrate 41 is a first dielectric substrate having the conductor ground plane 42. The conductor ground plane 42 is a first conductor ground plane provided on the entire back side of the dielectric substrate 41, and is provided with the patch antenna 49. The patch antenna 49 is a first patch antenna formed in a circular shape, and is formed in the conductor ground plane 42 by providing a conductor removed portion 42*a* in the conductor ground plane 42 as illustrated in FIG. 8.

The conductor removed portion 42*a* is a portion formed by removing the conductor from the conductor ground plane 42 along the outer shape of the patch antenna 49. When the patch antenna 49 has a circular shape, the conductor removed portion 42*a* is an annular portion formed by removing the conductor from the conductor ground plane 42 as illustrated in FIG. 8. Note that the patch antenna 49 is not limited to one having a circular shape, and it may have, for example, a polygonal shape such as a triangular shape or a quadrangular shape.

The conductor plate 44 is a first conductor plate having a through hole 44*a*. The conductor ground plane 42 of the dielectric substrate 41 and the conductor plate 44 are bonded by the solder 43 in a state where the through hole 44*a* and the patch antenna 49 are arranged to face each other. For example, the dielectric substrate 41 and the conductor plate 44 are bonded with the patch antenna 49 facing the through hole 44*a* as illustrated in FIG. 8.

The solder 43 is a first solder for bonding the conductor ground plane and the conductor plate. The solder 43 is not applied to a region 43*a* facing the patch antenna 49 and the conductor removed portion 42*a*, but applied to a portion other than the region 43*a* in the conductor ground plane 42 or the conductor plate 44.

The dielectric substrate 47 is a second dielectric substrate having the conductor ground plane 46. The conductor ground plane 46 is a second conductor ground plane provided on the entire side of the dielectric substrate 47. The conductor ground plane 46 of the dielectric substrate 47 and the conductor plate 44 are bonded by the solder 45. The solder 45 is a second solder for bonding the conductor plate and the conductor ground plane. The solder 45 is not applied to a region 45*a* facing the through hole 44*a*, but applied to a portion other than the region 45*a* in the conductor plate 44 or the conductor ground plane 46.

As illustrated in FIG. 8, the hollow structure 48 is constituted by the patch antenna 49, the conductor removed portion 42*a*, the region 43*a*, the through hole 44*a*, the region 45*a*, and the conductor ground plane 46. The size of the hollow structure 48 is set so that a gain difference between a vertically polarized wave and a horizontally polarized wave decreases when the antenna device illustrated in FIG. 7 performs beam scanning in the wide angle direction. This suppresses a decrease in an axial ratio when beam scanning is performed in the wide angle direction. The solder 43 and the solder 45 are applied in an amount that does not cause leakage into the hollow structure 48 when melted.

Next, an antenna manufacturing method according to the third embodiment will be described.

Figure 9:
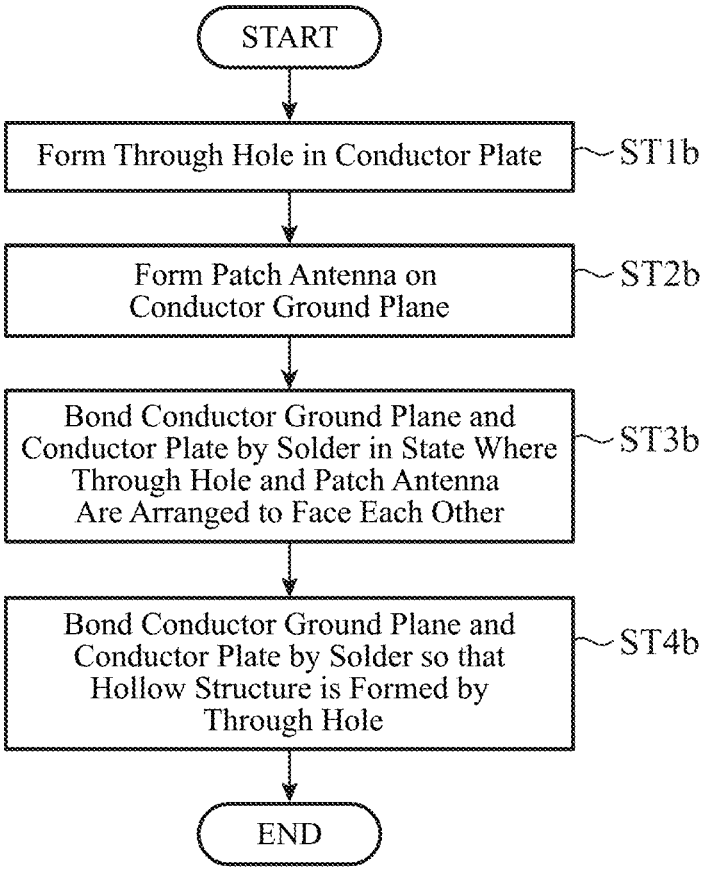
FIG. 9 is a flowchart illustrating an antenna manufacturing method according to the third embodiment.

FIG. 9 is a flowchart illustrating the antenna manufacturing method according to the third embodiment, and illustrates a method for manufacturing the antenna device illustrated in FIG. 7.

The through hole 44*a* is formed in the conductor plate 44 (step ST1*b*). The through hole 44*a* can be formed by, for example, machining by a drill, a punch press machine, or a laser.

The patch antenna 49 is formed on the conductor ground plane 42 of the dielectric substrate 41 (step ST2*b*). The patch antenna 49 is formed on the conductor ground plane 42 at a position to be faced by the through hole 44*a* when the dielectric substrate 41 is bonded to the conductor plate 44. For example, the patch antenna 49 to be formed is set on the conductor ground plane 42, and the conductor removed portion 42*a* is formed by removing the conductor from the conductor ground plane 42 along the outer shape of the patch antenna 49. The conductor is removed from the conductor ground plane 42 by copper foil punching such as etching.

The conductor ground plane 42 of the dielectric substrate 41 and the conductor plate 44 are bonded by the solder 43 in a state where the through hole 44*a* and the patch antenna 49 are arranged to face each other (step ST3*b*). For example, the solder 43 is applied to a portion other than the region 43*a* in the conductor ground plane 42. A structure in which the solder 43 is applied between the conductor ground plane 42 and the conductor plate 44 is passed through a reflow furnace so that the solder 43 is melted. Thus, the conductor ground plane 42 and the conductor plate 44 are bonded to each other.

The conductor plate 44 and the conductor ground plane 46 of the dielectric substrate 47 are bonded by the solder 45 so that the hollow structure 48 is formed between the dielectric substrate 41 and the dielectric substrate 47 by the through hole 44*a* (step ST4*b*). For example, the solder 45 is applied to a portion other than the region 45*a* in the conductor plate 44 or the conductor ground plane 46. A structure in which the solder 45 is applied between the conductor plate 44 and the conductor ground plane 46 is passed through a reflow furnace so that the solder 45 is melted. Thus, the conductor plate 44 and the conductor ground plane 46 are bonded to each other.

Note that the order of the processes of steps ST3*b* and ST4*b* may be reversed, or these processes may be performed simultaneously. For example, a structure in which the solder 43 is applied between the conductor ground plane 42 and the conductor plate 44 and the solder 45 is applied between the conductor plate 44 and the conductor ground plane 46 may be passed through a reflow furnace so that the solder 43 and the solder 45 are melted, whereby the conductor ground plane 42 and the conductor plate 44, and the conductor plate 44 and the conductor ground plane 46 may be simultaneously bonded.

In the antenna device according to the third embodiment, a substrate with an equivalently low dielectric constant can be achieved by providing the hollow structure 48 between the patch antenna 49 and the conductor ground plane 46. As a result, the antenna device according to the third embodiment has improved radiation efficiency and improved gain when beam scanning is performed in the wide angle direction, as compared with a typical patch antenna that does not have a hollow structure.

Furthermore, the gain difference between the vertically polarized wave and the horizontally polarized wave in the wide angle direction in the antenna device according to the third embodiment can be improved by appropriately designing the size of the hollow structure 48. For example, in order to suppress a decrease in the axial ratio when the antenna device according to the third embodiment performs beam scanning in the wide angle direction, the size of the hollow structure 48 may be designed so that the gain difference between the vertically polarized wave and the horizontally polarized wave in the wide angle direction decreases.

Although the dielectric substrate 41 in which the conductor ground plane 42 is provided on the back side has been described above, the conductor ground plane 42 may be provided on both the front side and the back side of the dielectric substrate 41. In this case, the patch antenna 49 may be provided only on the conductor ground plane 42 on the back side of the dielectric substrate 41, or may be provided only on the conductor ground plane 42 on the front side of the dielectric substrate 41. Although the configuration in which there is no via in all the layers of the dielectric substrate 41 and the dielectric substrate 47 has been described above, both or either of these substrates may have a via.

As described above, in the antenna manufacturing method according to the third embodiment, the conductor ground plane 42 of the dielectric substrate 41 and the conductor plate 44 are bonded by the solder 43 in a state where the through hole 44*a* and the patch antenna 49 are arranged to face each other, and the conductor plate 44 and the conductor ground plane 46 of the dielectric substrate 47 are bonded by the solder 45. With this configuration, the same effects as those of the first embodiment can be obtained. In addition, due to the side wall of the hollow structure 48 being a conductor side, it is possible to suppress a surface wave inside the substrate that causes a decrease in gain when beam scanning is performed in the wide angle direction. This improves the radiation efficiency, and improves a gain when beam scanning is performed in the wide angle direction, as compared to a typical patch antenna that does not have a hollow structure.

Fourth Embodiment

Figure 10:
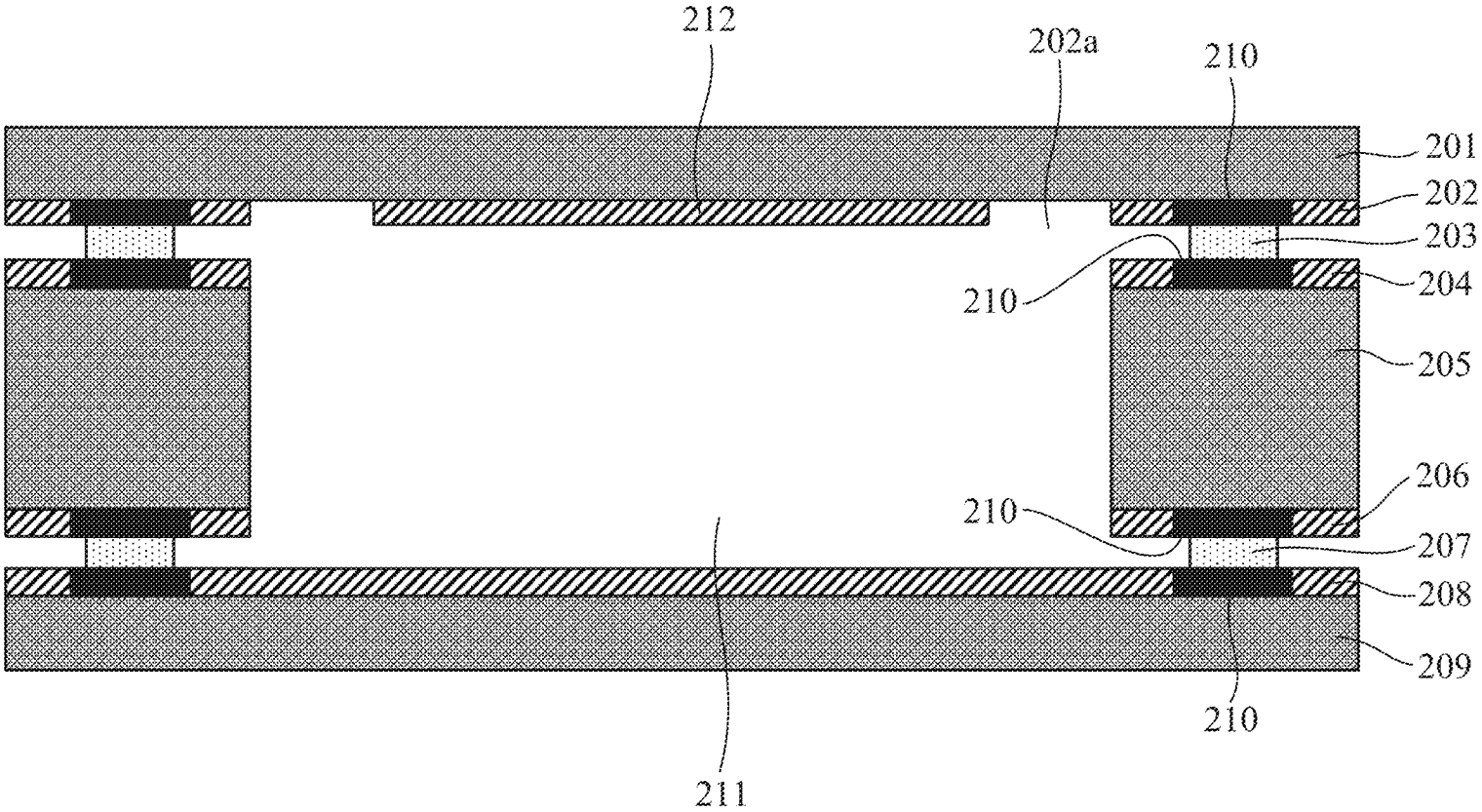
FIG. 10 is a longitudinal sectional view illustrating a configuration of an antenna device according to a fourth embodiment.
Figure 11:
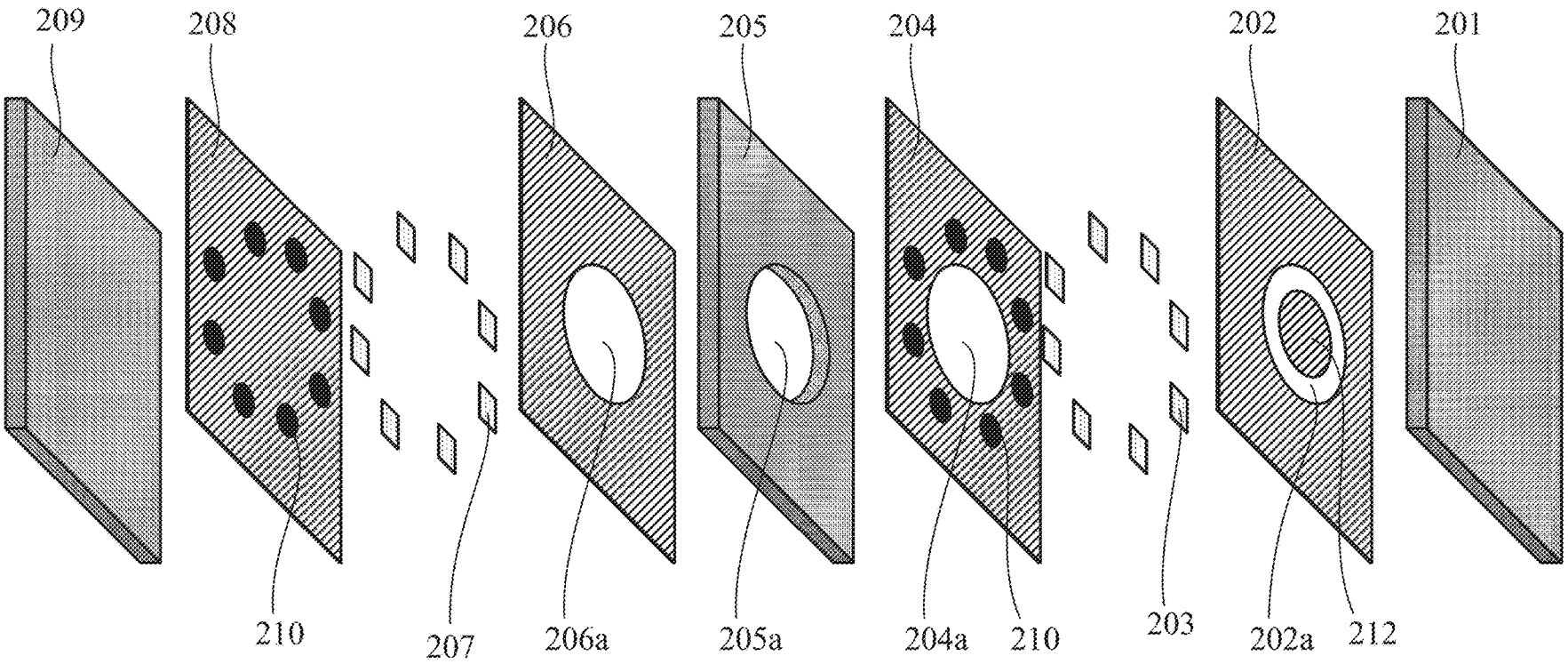
FIG. 11 is an exploded perspective view illustrating the configuration of the antenna device in FIG. 10.

FIG. 10 is a longitudinal sectional view illustrating a configuration of an antenna device according to the fourth embodiment. FIG. 11 is an exploded perspective view illustrating the configuration of the antenna device shown in FIG. 10. As illustrated in FIG. 10, the antenna device according to the fourth embodiment includes a dielectric substrate 201, a conductor ground plane 202, solder 203, a conductor ground plane 204, a dielectric substrate 205, a conductor ground plane 206, solder 207, a conductor ground plane 208, and a dielectric substrate 209. Inside a dielectric substrate obtained by bonding the dielectric substrate 201, the dielectric substrate 205, and the dielectric substrate 209, a hollow structure 211 for adjusting an equivalent dielectric constant of the dielectric substrate is provided, and a patch antenna 212 faces the hollow structure 211.

The dielectric substrate 201 is a first dielectric substrate having the conductor ground plane 202. The conductor ground plane 202 is a first conductor ground plane provided on the entire back side of the dielectric substrate 201, and is provided with the patch antenna 212. The patch antenna 212 is a first patch antenna formed in a circular shape. As illustrated in FIG. 11, the patch antenna 212 is formed on the conductor ground plane 202 by providing a conductor removed portion 202*a* in the conductor ground plane 202.

The conductor removed portion 202*a* is a portion formed by removing the conductor from the conductor ground plane 202 along the outer shape of the patch antenna 212. When the patch antenna 212 has a circular shape, the conductor removed portion 202*a* is an annular portion formed by removing the conductor from the conductor ground plane 202 as illustrated in FIG. 11. Note that the patch antenna 212 is not limited to one having a circular shape, and it may have, for example, a polygonal shape such as a triangular shape or a quadrangular shape.

The dielectric substrate 205 is a second dielectric substrate including the conductor ground plane 204 and the conductor ground plane 206. The conductor ground plane 204 is a second conductor ground plane provided on the entire front side (first side) of the dielectric substrate 205, and the conductor ground plane 206 is a third conductor ground plane provided on the entire side (back side, second side) opposite to the front side of the dielectric substrate 205. The dielectric substrate 205 has a through hole 205*a* penetrating from the conductor ground plane 204 to the conductor ground plane 206.

The conductor ground plane 202 of the dielectric substrate 201 and the conductor ground plane 204 of the dielectric substrate 205 are bonded by the solder 203 in a state where the through hole 205*a* and the patch antenna 212 are arranged to face each other. For example, the dielectric substrate 201 and the dielectric substrate 205 are bonded with the patch antenna 212 facing the through hole 205*a* as illustrated in FIG. 11. The solder 203 is a first solder for bonding the conductor ground planes.

The through hole 205*a* penetrates the dielectric substrate 205 from the conductor ground plane 204 to the conductor ground plane 206. Therefore, as illustrated in FIG. 11, an opening 204*a* having the same opening shape as the through hole 205*a* is formed in the conductor ground plane 204, and an opening 206*a* having the same opening shape as the through hole 205*a* is formed in the conductor ground plane 206.

The dielectric substrate 209 is a third dielectric substrate having the conductor ground plane 208. The conductor ground plane 208 is a fourth conductor ground plane provided on the entire side of the dielectric substrate 209. The conductor ground plane 206 of the dielectric substrate 205 and the conductor ground plane 208 of the dielectric substrate 209 are bonded by the solder 207.

In the fourth embodiment, bonding using the solder 203 and the solder 207 is performed on lands 210. As illustrated in FIGS. 10 and 11, the lands 210 are small regions for bonding using solder formed at a bonding portion between the conductor ground plane 202 and the conductor ground plane 204. Since the bonding using the solder 203 and the solder 207 is performed on the lands 210, the bonding positions using the solder can be accurately disposed.

The positions of the lands 210 in the conductor ground plane 202 and in the conductor ground plane 204 face each other. The lands 210 can be disposed at any position in a region other than the opening 204*a* in the conductor ground plane 204, and an amount of the solder 203 applied to the lands 210 is also freely set. Similarly, the positions of the lands 210 in the conductor ground plane 206 and in the conductor ground plane 208 face each other. The lands 210 can be disposed at any position in a region other than the opening 206*a* in the conductor ground plane 206, and an amount of the solder 207 applied to the lands 210 is also freely set.

The hollow structure 211 is constituted by the patch antenna 212, the conductor removed portion 202*a*, the opening 204*a*, the through hole 205*a*, the opening 206*a*, and the conductor ground plane 208. The size of the hollow structure 211 is set so that a gain difference between a vertically polarized wave and a horizontally polarized wave decreases when the antenna device illustrated in FIG. 10 performs beam scanning in a wide angle direction. This suppresses a decrease in an axial ratio when beam scanning is performed in the wide angle direction.

Next, an antenna manufacturing method according to the fourth embodiment will be described.

The antenna manufacturing method according to the fourth embodiment is basically the same as the series of processing illustrated in FIG. 3 except that the bonding using solder in steps ST3 and ST4 is performed on the lands 210. For example, in step ST3, the conductor ground plane 202 of the dielectric substrate 201 and the conductor ground plane 204 of the dielectric substrate 205 are bonded by the solder 203 on the lands 210 in a state where the through hole 205*a* and the patch antenna 212 are arranged to face each other. A structure including the conductor ground plane 202 and the conductor ground plane 204 bonded by the solder 203 applied to the lands 210 is passed through a reflow furnace to melt the solder 203, whereby the conductor ground plane 202 and the conductor ground plane 204 are bonded.

In addition, in step ST4, the conductor ground plane 206 of the dielectric substrate 205 and the conductor ground plane 208 of the dielectric substrate 209 are bonded by the solder 207 on the lands 210 so that the hollow structure 211 is formed between the dielectric substrate 201 and the dielectric substrate 209 by the through hole 205*a*. A structure including the conductor ground plane 206 and the conductor ground plane 208 bonded by the solder 207 applied to the lands 210 is passed through a reflow furnace to melt the solder 207, whereby the conductor ground plane 206 and the conductor ground plane 208 are bonded.

Note that the order of the processes of steps ST3 and ST4 described above may be reversed, or these processes may be performed simultaneously. For example, a structure in which the solder 203 is applied to the lands 210 between the conductor ground plane 202 and the conductor ground plane 204 and the solder 207 is applied to the lands 210 between the conductor ground plane 206 and the conductor ground plane 208 may be passed through a reflow furnace so that the solder 203 and the solder 207 are melted, whereby the conductor ground plane 202 and the conductor ground plane 204, and the conductor ground plane 206 and the conductor ground plane 208 may be simultaneously bonded.

The case where the bonding using solder in the antenna manufacturing method according to the first embodiment is performed on the lands 210 has been described above. However, the bonding using solder in the antenna manufacturing method according to the second embodiment and the third embodiment may be performed on the lands 210.

In addition, although the dielectric substrate 201 in which the conductor ground plane 202 is provided on the back side has been described above, the conductor ground plane 202 may be provided on both the front side and the back side of the dielectric substrate 201. In this case, the patch antenna 212 may be provided only on the conductor ground plane 202 on the back side of the dielectric substrate 201, or may be provided only on the conductor ground plane 202 on the front side of the dielectric substrate 201. Although the configuration in which there is no via in all the layers of the dielectric substrate 201, the dielectric substrate 205, and the dielectric substrate 209 has been described above, all or any of these substrates may have a via.

As described above, in the antenna manufacturing method according to the fourth embodiment, the bonding using the solder 203 and the solder 207 is performed on the lands 210. Thus, bonding positions using the solder can be accurately determined. Furthermore, due to the hollow structure 211 being provided, the antenna device according to the fourth embodiment has improved radiation efficiency and improved gain when beam scanning is performed in the wide angle direction, as compared with a typical patch antenna that does not have a hollow structure.

Fifth Embodiment

Figure 12:
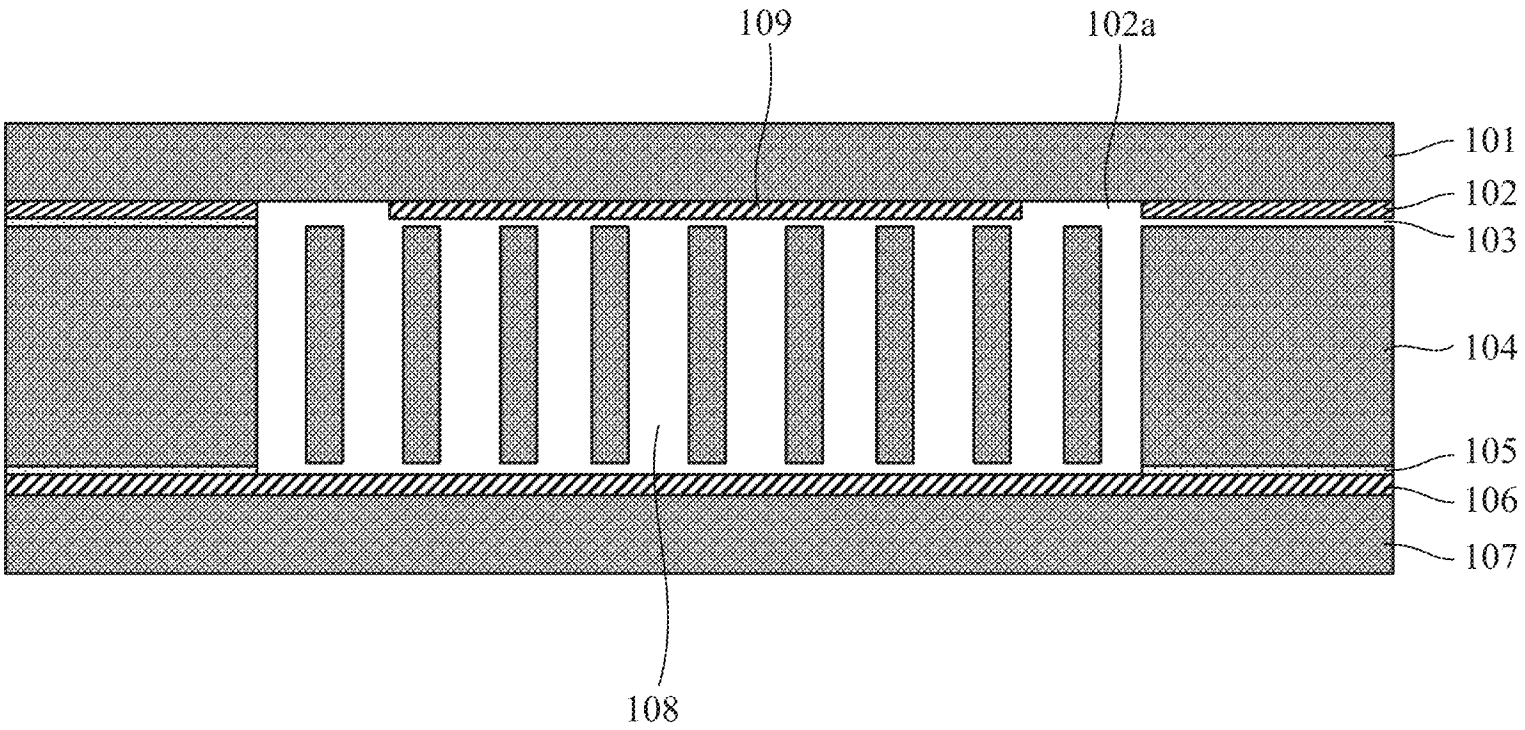
FIG. 12 is a longitudinal sectional view illustrating a configuration of an antenna device according to a fifth embodiment.
Figure 13:
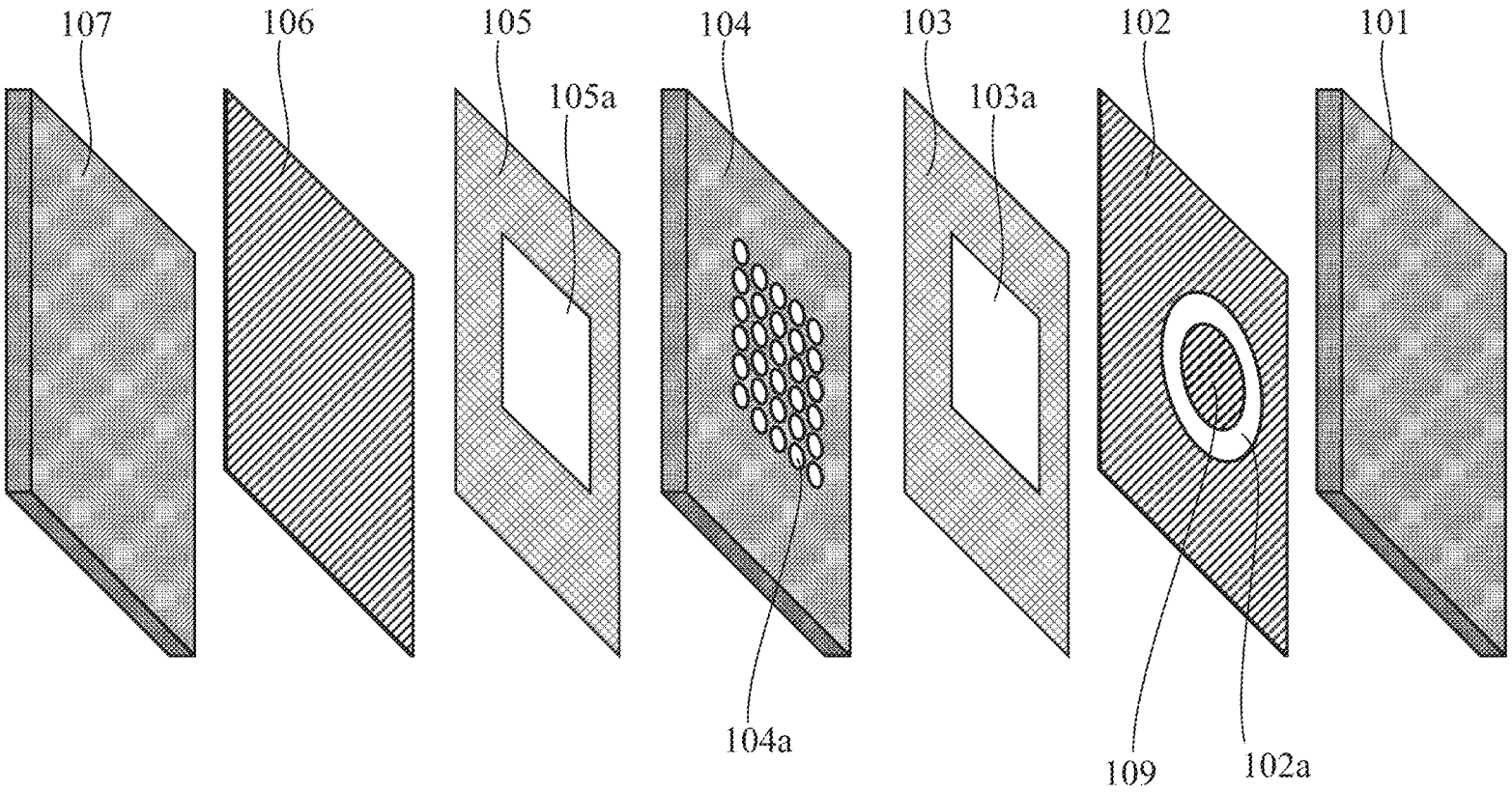
FIG. 13 is an exploded perspective view illustrating the configuration of the antenna device in FIG. 12.

FIG. 12 is a longitudinal sectional view illustrating a configuration of an antenna device according to the fifth embodiment. FIG. 13 is an exploded perspective view illustrating the configuration of the antenna device shown in FIG. 12. As illustrated in FIG. 12, the antenna device according to the fifth embodiment includes a dielectric substrate 101, a conductor ground plane 102, a prepreg 103, a dielectric substrate 104, a prepreg 105, a conductor ground plane 106, and a dielectric substrate 107. Inside a dielectric substrate obtained by bonding the dielectric substrate 101, the dielectric substrate 104, and the dielectric substrate 107, a hollow structure 108 for adjusting an equivalent dielectric constant of the dielectric substrate is provided, and a patch antenna 109 faces the hollow structure 108.

The dielectric substrate 101 is a first dielectric substrate having the conductor ground plane 102. The conductor ground plane 102 is a first conductor ground plane provided on the entire back side of the dielectric substrate 101, and is provided with the patch antenna 109. The patch antenna 109 is a first patch antenna formed in a circular shape, and is formed on the conductor ground plane 102 by providing a conductor removed portion 102*a* in the conductor ground plane 102 as illustrated in FIG. 13.

The conductor removed portion 102*a* is a portion formed by removing the conductor from the conductor ground plane 102 along the outer shape of the patch antenna 109. When the patch antenna 109 has a circular shape, the conductor removed portion 102*a* is an annular portion formed by removing the conductor from the conductor ground plane 102 as illustrated in FIG. 13. Note that the patch antenna 109 is not limited to one having a circular shape, and it may have, for example, a polygonal shape such as a triangular shape or a quadrangular shape.

The dielectric substrate 104 is a second dielectric substrate provided with a plurality of through holes 104*a* having an opening area smaller than the area of the patch antenna 109. The dielectric substrate 107 is a third dielectric substrate having the conductor ground plane 106 formed on the side. The conductor ground plane 106 is a second conductor ground plane provided on the entire side of the dielectric substrate 107. It is possible to reduce the equivalent dielectric constant from the patch antenna 109 to the conductor ground plane 106 by increasing the number of the through holes 104*a*.

The prepreg 103 and the prepreg 105 are dielectric adhesives. The prepreg 103 is provided between the conductor ground plane 102 and the front side of the dielectric substrate 104, and the prepreg 105 is provided between the back side of the dielectric substrate 104 and the conductor ground plane 106. As illustrated in FIG. 13, the prepreg 103 has an opening 103*a* formed by removing a portion corresponding to a region of the dielectric substrate 104 where the plurality of through holes 104*a* is formed. Similarly, the prepreg 105 has an opening 105*a* formed by removing a portion corresponding to the region of the dielectric substrate 104 where the plurality of through holes 104*a* is formed.

The prepreg 103 bonds the conductor ground plane 102 and the side of dielectric substrate 104 by hot pressing, and the prepreg 105 bonds the back side of the dielectric substrate 104 and the conductor ground plane 106 by hot pressing. In the antenna manufacturing method according to the fifth embodiment, the dielectric substrates are bonded by hot pressing. Therefore, a thermoplastic resin film or a thermosetting resin film may be used instead of the prepreg 103 and the prepreg 105.

The hollow structure 108 is constituted by the patch antenna 109, the conductor removed portion 102*a*, the opening 103*a*, the plurality of through holes 104*a*, the opening 105*a*, and the conductor ground plane 106. Since the opening area of each of the plurality of through holes

104*a* is smaller than the area of the patch antenna 109, the deformation of the dielectric substrate 101 and the dielectric substrate 107 toward the hollow structure 108 is restricted by the portion other than the through holes 104*a* in the dielectric substrate 104. Thus, even if stress is generated inside the dielectric substrates by hot pressing, deformation of the dielectric substrates toward the hollow structure 108 is suppressed. The number of the through holes 104*a* is set so that a gain difference between a vertically polarized wave and a horizontally polarized wave decreases when the antenna device illustrated in FIG. 12 performs beam scanning in the wide angle direction. This suppresses a decrease in an axial ratio when beam scanning is performed in the wide angle direction.

Next, an antenna manufacturing method according to the fifth embodiment will be described.

Figure 14:
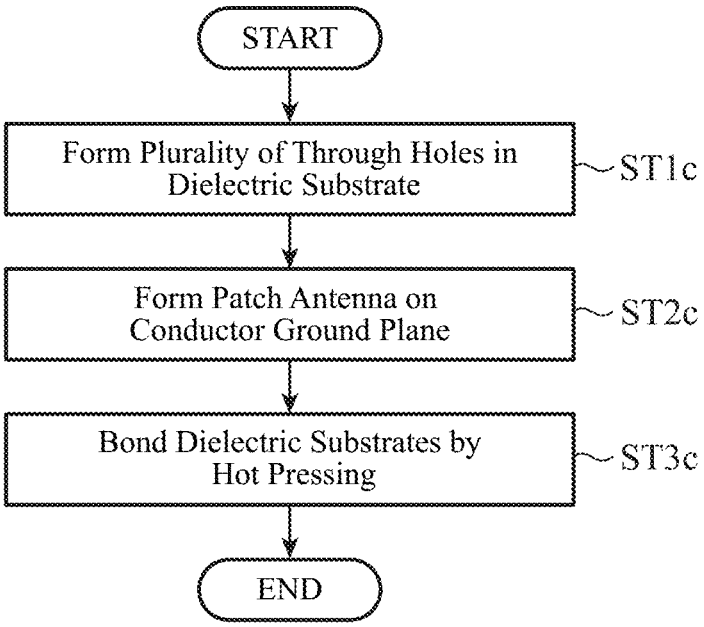
FIG. 14 is a flowchart illustrating an antenna manufacturing method according to the fifth embodiment.

FIG. 14 is a flowchart illustrating the antenna manufacturing method according to the fifth embodiment, and illustrates a method for manufacturing the antenna device illustrated in FIG. 12. A plurality of through holes 104*a* is formed in the dielectric substrate 104 (step ST1*c*). The through holes 104*a* are formed by, for example, machining by a drill, a punch press machine, or a laser.

The patch antenna 109 is formed on the conductor ground plane 102 of the dielectric substrate 101 (step ST2*c*). The patch antenna 109 is formed on the conductor ground plane 102 at a position to be faced by the through holes 104*a* when the dielectric substrate 101 is bonded to the dielectric substrate 104. For example, the patch antenna 109 to be formed is set on the conductor ground plane 102, and the conductor removed portion 102*a* is formed by removing the conductor from the conductor ground plane 102 along the outer shape of the patch antenna 109. The conductor is removed from the conductor ground plane 102 by copper foil punching such as etching.

In a state where the positions of the plurality of through holes 104*a* and the patch antenna 109 face each other, the prepreg 103 is disposed between the conductor ground plane 102 of the dielectric substrate 101 and the front side of the dielectric substrate 104, and the prepreg 105 is disposed between the back side of the dielectric substrate 104 and the conductor ground plane 106 of the dielectric substrate 107. Then, the dielectric substrates are bonded by hot pressing (step ST3*c*). The prepreg 103 softened by heating is pressed to bond the conductor ground plane 102 and the front side of the dielectric substrate 104, and the prepreg 105 softened by heating is pressed to bond the back side of the dielectric substrate 104 and the conductor ground plane 106.

In the antenna device according to the fifth embodiment, a substrate with an equivalently low dielectric constant can be achieved by providing the hollow structure 108 between the patch antenna 109 and the conductor ground plane 106. As a result, the antenna device according to the fifth embodiment has improved radiation efficiency and improved gain when beam scanning is performed in the wide angle direction, as compared with a typical patch antenna that does not have a hollow structure.

Furthermore, the gain difference between the vertically polarized wave and the horizontally polarized wave in the wide angle direction in the antenna device according to the fifth embodiment can be improved by appropriately designing the size of the hollow structure 108. For example, in order to suppress a decrease in the axial ratio when the antenna device according to the fifth embodiment performs beam scanning in the wide angle direction, the size of the hollow structure 108 may be designed so that the gain difference between the vertically polarized wave and the horizontally polarized wave in the wide angle direction decreases.

Although the dielectric substrate 101 in which the conductor ground plane 102 is provided on the back side has been described above, the conductor ground plane 102 may be provided on both the front side and the back side of the dielectric substrate 101. In this case, the patch antenna 109 may be provided only on the conductor ground plane 102 on the back side of the dielectric substrate 101, or may be provided only on the conductor ground plane 102 on the front side of the dielectric substrate 101. Although the configuration in which there is no via in all the layers of the dielectric substrate 101, the dielectric substrate 104, and the dielectric substrate 107 has been described above, all or any of these substrates may have a via.

As described above, in the antenna manufacturing method according to the fifth embodiment, the dielectric substrate 101, the dielectric substrate 104, and the dielectric substrate 107 are bonded by hot pressing in a state where the positions of the plurality of through holes 104*a* and the patch antenna 109 face each other. Since the opening area of each of the plurality of through holes 104*a* is smaller than the area of the patch antenna 109, the deformation of the dielectric substrate 101 and the dielectric substrate 107 toward the hollow structure 108 is restricted by the portion other than the through holes 104*a* in the dielectric substrate 104. Furthermore, the equivalent dielectric constant from the patch antenna 109 to the conductor ground plane 106 can be reduced by increasing the number of through holes 104*a*. Therefore, compared with a typical patch antenna without the hollow structure 108, the radiation efficiency is improved, and the gain when beam scanning is performed in the wide angle direction is improved.

Sixth Embodiment

Figure 15:
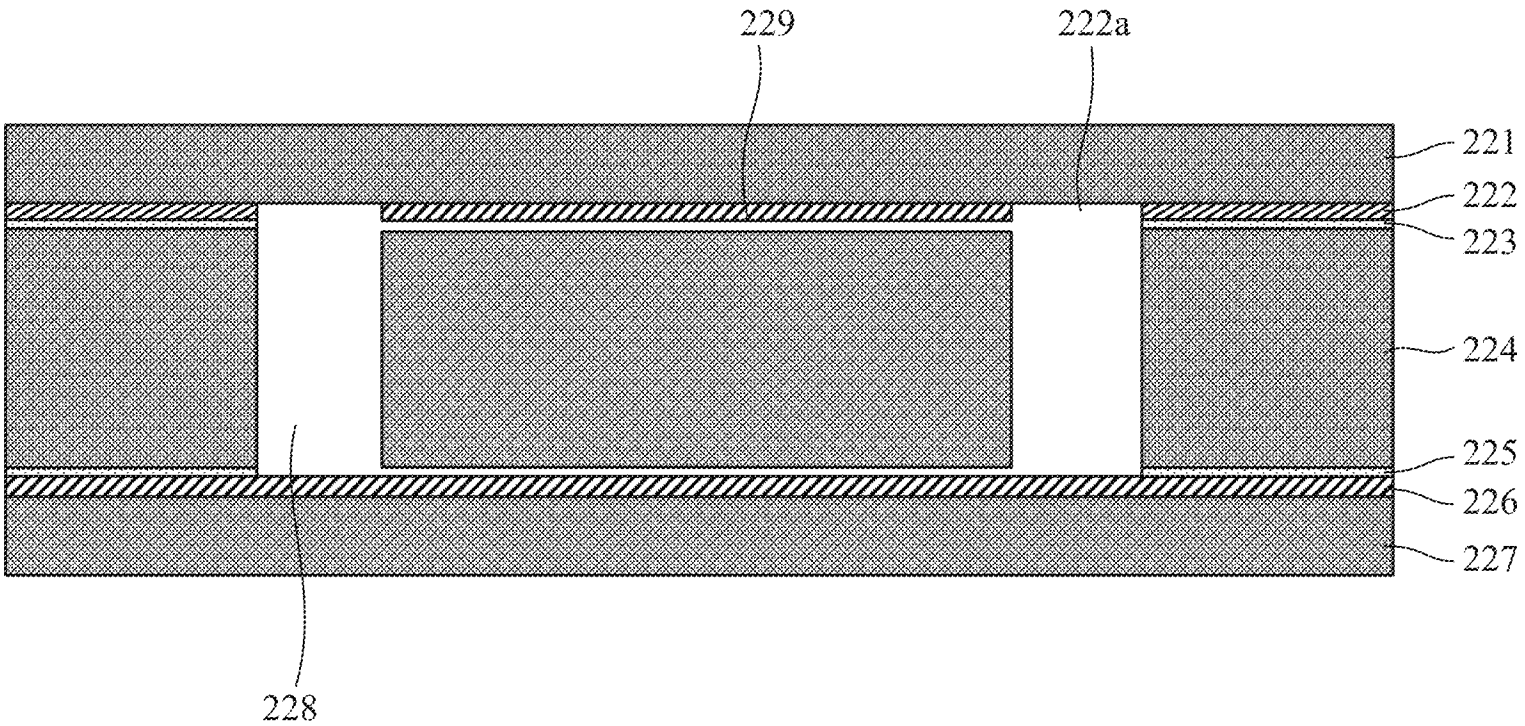
FIG. 15 is a longitudinal sectional view illustrating a configuration of an antenna device according to a sixth embodiment.
Figure 16:
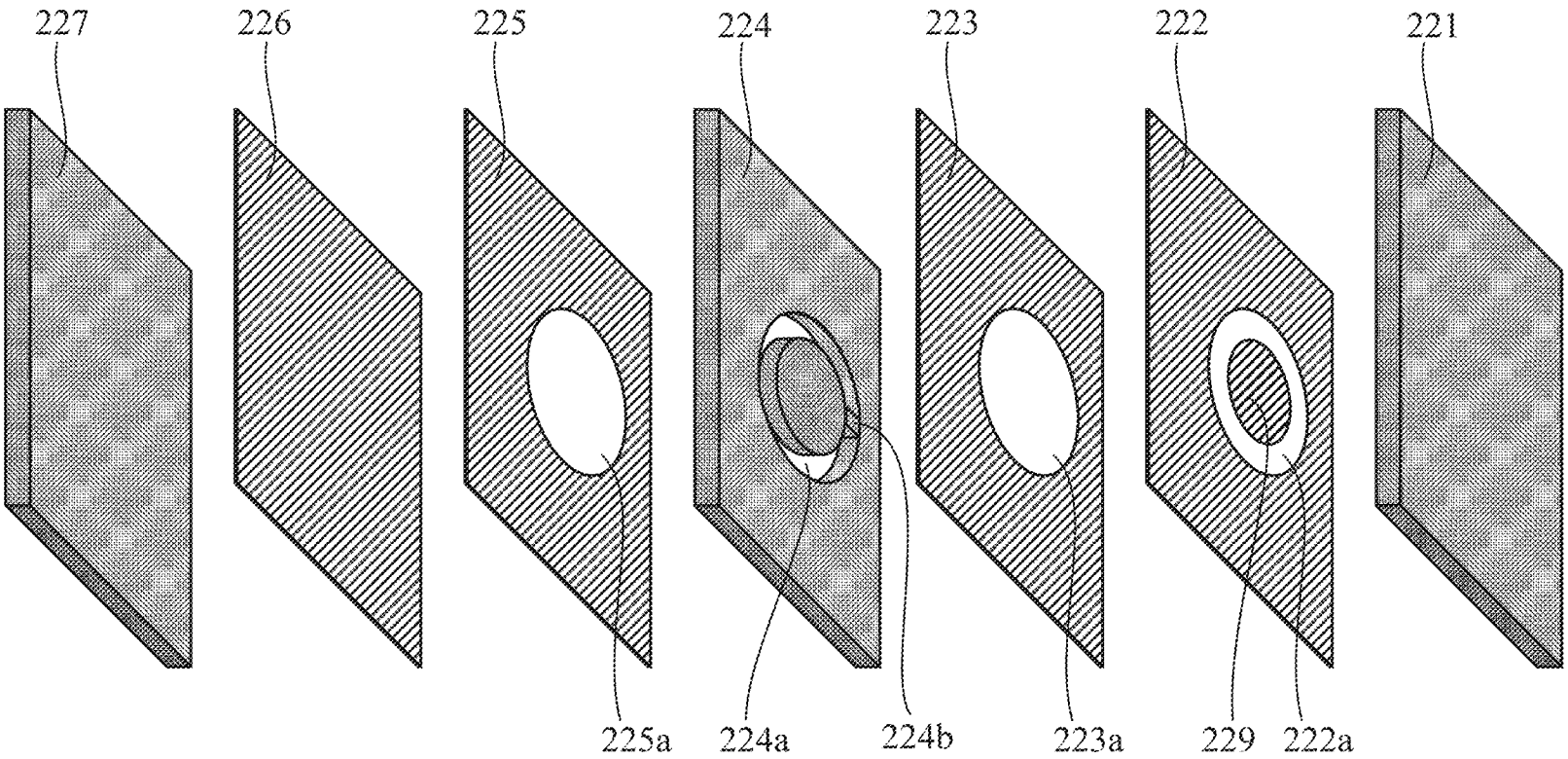
FIG. 16 is an exploded perspective view illustrating the configuration of the antenna device in FIG. 15.

FIG. 15 is a longitudinal sectional view illustrating a configuration of an antenna device according to the sixth embodiment. FIG. 16 is an exploded perspective view illustrating the configuration of the antenna device shown in FIG. 15. As illustrated in FIG. 16, the antenna device according to the sixth embodiment includes a dielectric substrate 221, a conductor ground plane 222, a prepreg 223, a dielectric substrate 224, a prepreg 225, a conductor ground plane 226, and a dielectric substrate 227. Inside a dielectric substrate obtained by bonding the dielectric substrate 221, the dielectric substrate 224, and the dielectric substrate 227, a hollow structure 228 for adjusting an equivalent dielectric constant of the dielectric substrate is provided, and a patch antenna 229 faces the hollow structure 228.

The dielectric substrate 221 is a first dielectric substrate having the conductor ground plane 222. The conductor ground plane 222 is a first conductor ground plane provided on the entire back side of the dielectric substrate 221, and is provided with a patch antenna 229. The patch antenna 229 is a first patch antenna formed in a circular shape, and is formed on the conductor ground plane 222 by providing a conductor removed portion 222*a* in the conductor ground plane 222 as illustrated in FIG. 16.

The conductor removed portion 222*a* is a portion formed by removing the conductor from the conductor ground plane 222 along the outer shape of the patch antenna 229. When the patch antenna 229 has a circular shape, the conductor removed portion 222*a* is an annular portion formed by removing the conductor from the conductor ground plane 222 as illustrated in FIG. 16. Note that the patch antenna 229 is not limited to one having a circular shape, and it may have, for example, a polygonal shape such as a triangular shape or a quadrangular shape.

The dielectric substrate 224 is a second dielectric substrate provided with a through hole 224*a* having an opening area smaller than the area of the patch antenna 229. The dielectric substrate 227 is a third dielectric substrate having the conductor ground plane 226 formed on the side. The conductor ground plane 226 is a second conductor ground plane provided on the entire side of the dielectric substrate 227. The through hole 224*a* is a hole having a groove shape along the outer shape of the patch antenna 229 when the patch antenna 229 is projected from the conductor ground plane 222 onto the dielectric substrate 224. In the dielectric substrate 224, a portion inside the through hole 224*a* is bonded to the dielectric substrate 224 by a support portion 224*b*. It is possible to reduce the equivalent dielectric constant from the patch antenna 229 to the conductor ground plane 226 by appropriately designing the size of the through hole 224*a*.

The prepreg 223 and the prepreg 225 are dielectric adhesives. The prepreg 223 is provided between the conductor ground plane 222 and the front side of the dielectric substrate 224, and the prepreg 225 is provided between the back side of the dielectric substrate 224 and the conductor ground plane 226. As illustrated in FIG. 16, the prepreg 223 has an opening 223*a* formed by removing a portion corresponding to the patch antenna 229 and the conductor removed portion 222*a*. The prepreg 225 also has an opening 225*a* formed by removing a portion corresponding to the patch antenna 229 and the conductor removed portion 222*a*.

The prepreg 223 bonds the conductor ground plane 222 and the side of the dielectric substrate 224 by hot pressing, and the prepreg 225 bonds the back side of the dielectric substrate 224 and the conductor ground plane 226 by hot pressing. In the antenna manufacturing method according to the sixth embodiment, the dielectric substrates are bonded by hot pressing. Therefore, a thermoplastic resin film or a thermosetting resin film may be used instead of the prepreg 223 and the prepreg 225.

The hollow structure 228 is constituted by the patch antenna 229, the conductor removed portion 222*a*, the opening 223*a*, the through hole 224*a*, the opening 225*a*, and the conductor ground plane 226. The opening area of the through hole 224*a* is smaller than the area of the patch antenna 229. Thus, even if stress is generated inside the dielectric substrates by hot pressing, deformation of the dielectric substrates toward the hollow structure 228 is suppressed. The size of the through hole 224*a* is set so that a gain difference between a vertically polarized wave and a horizontally polarized wave decreases when the antenna device illustrated in FIG. 15 performs beam scanning in the wide angle direction. This suppresses a decrease in an axial ratio when beam scanning is performed in the wide angle direction.

The antenna manufacturing method according to the sixth embodiment is basically the same as the series of processing described with reference to FIG. 14 except that the plurality of through holes 104*a* in the fifth embodiment is replaced by the annular through hole 224*a*. Therefore, the description thereof will be omitted.

In the antenna device according to the sixth embodiment, a substrate with an equivalently low dielectric constant can be achieved by providing the hollow structure 228 between the patch antenna 229 and the conductor ground plane 226. As a result, the antenna device according to the sixth embodiment has improved radiation efficiency and improved gain when beam scanning is performed in the wide angle direction, as compared with a typical patch antenna that does not have a hollow structure.

Furthermore, the gain difference between the vertically polarized wave and the horizontally polarized wave in the wide angle direction in the antenna device according to the sixth embodiment can be improved by appropriately designing the size of the hollow structure 228. For example, in order to suppress a decrease in the axial ratio when the antenna device according to the sixth embodiment performs beam scanning in the wide angle direction, the size of the hollow structure 228 may be designed so that the gain difference between the vertically polarized wave and the horizontally polarized wave in the wide angle direction decreases.

Although the dielectric substrate 221 in which the conductor ground plane 222 is provided on the back side has been described above, the conductor ground plane 222 may be provided on both the front side and the back side of the dielectric substrate 221. In this case, the patch antenna 229 may be provided only on the conductor ground plane 222 on the back side of the dielectric substrate 221, or may be provided only on the conductor ground plane 222 on the front side of the dielectric substrate 221. Although the configuration in which there is no via in all the layers of the dielectric substrate 221, the dielectric substrate 224, and the dielectric substrate 227 has been described above, all or any of these substrates may have a via.

As described above, in the antenna device according to the sixth embodiment, the dielectric substrate 221, the dielectric substrate 224, and the dielectric substrate 227 are bonded in a state where the positions of the groove-shaped through hole 224*a* along the outer shape of the patch antenna 229 projected on the dielectric substrate 224 and the patch antenna 229 face each other. Since the opening area of the through hole 224*a* is smaller than the area of the patch antenna 229, the deformation of the dielectric substrate 221 and the dielectric substrate 227 toward the hollow structure 228 is restricted by the portion other than the through hole 224*a* in the dielectric substrate 224. Furthermore, the equivalent dielectric constant from the patch antenna 229 to the conductor ground plane 226 can be reduced depending on the size of the through hole 224*a*. Therefore, compared with a typical patch antenna without the hollow structure 228, the radiation efficiency is improved, and the gain when beam scanning is performed in the wide angle direction is improved.

Seventh Embodiment

Figure 17:
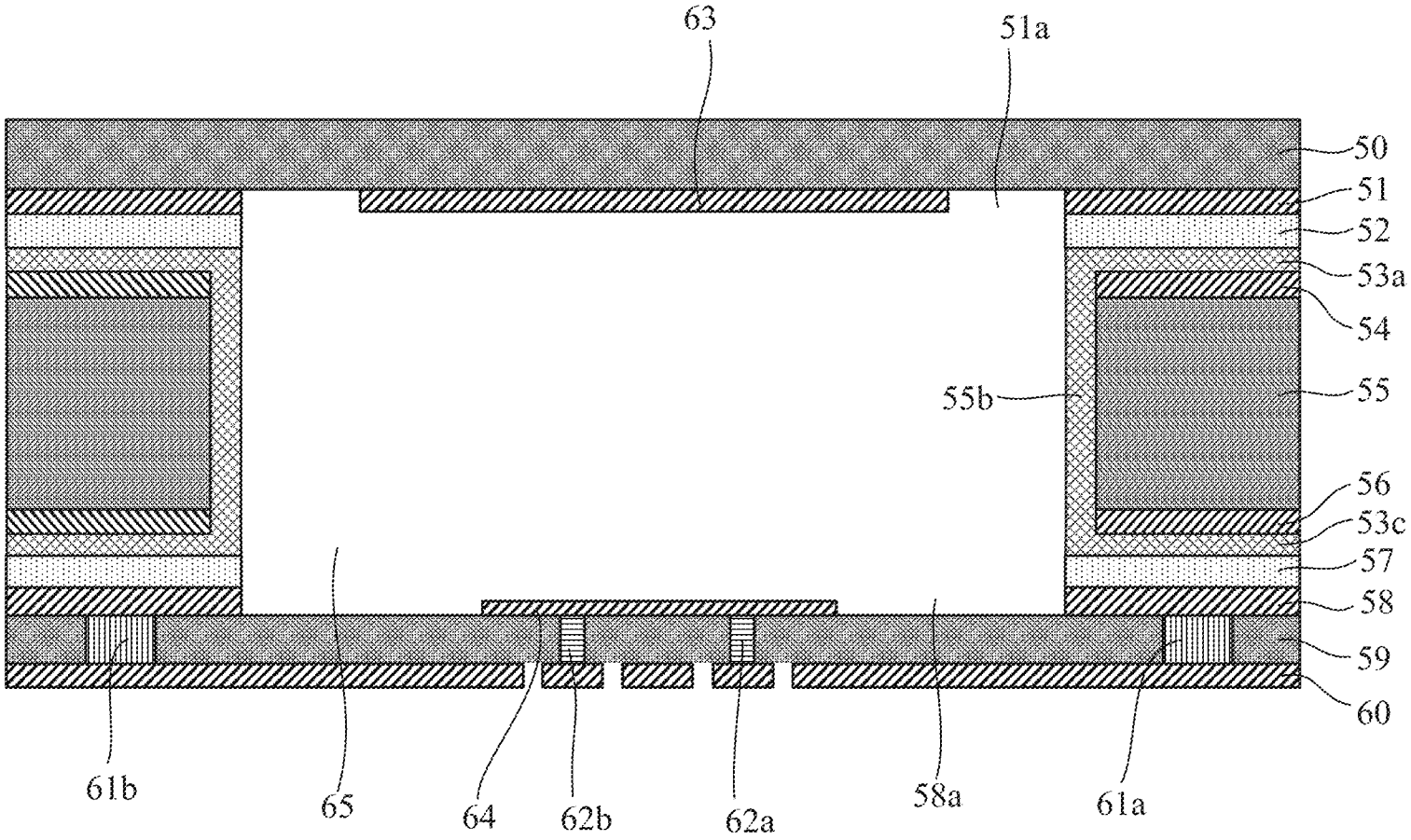
FIG. 17 is a longitudinal sectional view illustrating a configuration of an antenna device according to a seventh embodiment.
Figure 18:
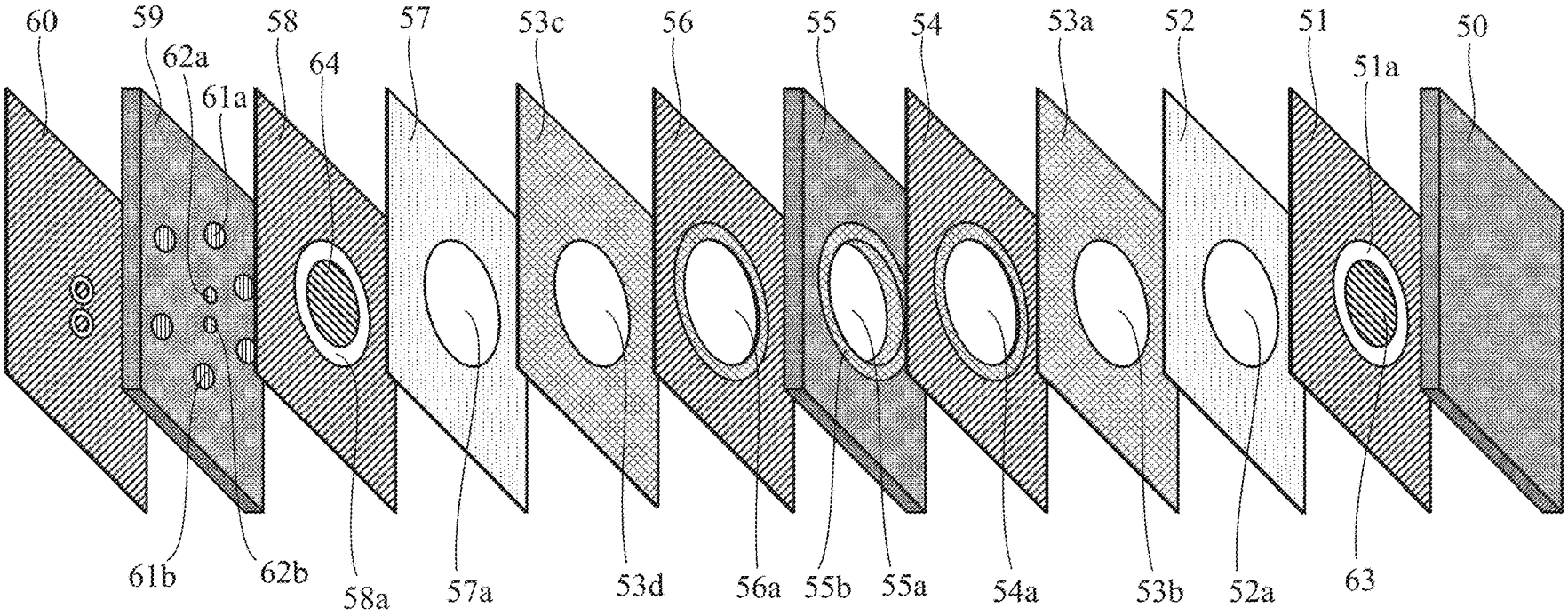
FIG. 18 is an exploded perspective view illustrating the configuration of the antenna device in FIG. 17.

FIG. 17 is a longitudinal sectional view illustrating a configuration of an antenna device according to the seventh embodiment. FIG. 18 is an exploded perspective view illustrating the configuration of the antenna device shown in FIG. 17. As illustrated in FIG. 17, the antenna device according to the seventh embodiment includes a dielectric substrate 50, a conductor ground plane 51, solder 52, a conductor ground plane 54, a dielectric substrate 55, a conductor ground plane 56, solder 57, a conductor ground plane 58, a dielectric substrate 59, and a conductor ground plane 60. Inside a dielectric substrate obtained by bonding the dielectric substrate 50, the dielectric substrate 55, and the dielectric substrate 59, a hollow structure 65 for adjusting an equivalent dielectric constant of the dielectric substrate is provided, and a first patch antenna 63 and a second patch antenna 64 face the hollow structure 65.

The dielectric substrate 50 is a first dielectric substrate having the conductor ground plane 51. The conductor ground plane 51 is a first conductor ground plane provided on the entire back side of the dielectric substrate 50, and is provided with the first patch antenna 63. The first patch antenna 63 is formed in a circular shape. As illustrated in FIG. 18, the first patch antenna 63 is formed on the conductor ground plane 51 by providing a conductor removed portion 51*a* in the conductor ground plane 51.

The conductor removed portion 51*a* is a portion formed by removing the conductor from the conductor ground plane 51 along the outer shape of the first patch antenna 63. When the first patch antenna 63 has a circular shape, the conductor removed portion 51*a* is an annular portion obtained by removing the conductor from the conductor ground plane 51 as illustrated in FIG. 18. Note that the first patch antenna 63 is not limited to one having a circular shape, and it may have, for example, a polygonal shape such as a triangular shape or a quadrangular shape.

The dielectric substrate 55 is a second dielectric substrate including the conductor ground plane 54 and the conductor ground plane 56. The conductor ground plane 54 is a second conductor ground plane provided on the entire front side (first side) of the dielectric substrate 55, and the conductor ground plane 56 is a third conductor ground plane provided on the entire side (back side, second side) opposite to the front side of the dielectric substrate 55. The dielectric substrate 55 has a through hole 55*a* penetrating from the conductor ground plane 54 to the conductor ground plane 56.

The dielectric substrate 55 in which the through hole 55*a* is formed is subjected to conductor plating processing. For example, as shown in FIGS. 17 and 18, conductor plating 53*a* is provided on an upper layer of the conductor ground plane 54, conductor plating 55*b* is formed on the side wall of the through hole 55*a*, and conductor plating 53*c* is provided on a lower layer of the conductor ground plane 56.

The conductor ground plane 51 of the dielectric substrate 50 and the conductor ground plane 54 of the dielectric substrate 55 are bonded by the solder 52 via the conductor plating 53*a* in a state where the through hole 55*a* and the first patch antenna 63 face each other. For example, the dielectric substrate 50 and the dielectric substrate 55 are bonded with the first patch antenna 63 facing the through hole 55*a* as illustrated in FIG. 17. The solder 52 is a first solder for bonding the conductor ground planes.

The through hole 55*a* penetrates the dielectric substrate 55 from the conductor ground plane 54 to the conductor ground plane 56. Therefore, an opening 53*b* having the same opening shape as the through hole 55*a* is formed in the conductor plating 53*a*, an opening 53*d* having the same opening shape as the through hole 55*a* is formed in the conductor plating 53*c*, an opening 54*a* having the same opening shape as the through hole 55*a* is formed in the conductor ground plane 54, and an opening 56*a* having the same opening shape as the through hole 55*a* is formed in the conductor ground plane 56, as illustrated in FIG. 18.

The solder 52 is not applied to a region 52*a* facing the first patch antenna 63 and the conductor removed portion 51*a*, but applied to a portion other than the region 52*a* in the conductor ground plane 51 or the conductor plating 53*a*.

The dielectric substrate 59 is a third dielectric substrate including the conductor ground plane 58 and the conductor ground plane 60. The conductor ground plane 58 is a fourth conductor ground plane provided on the entire front side (first side) of the dielectric substrate 59, and is provided with the second patch antenna 64. The conductor ground plane 60 is a fifth conductor ground plane provided on the entire side (back side, second side) opposite to the front side of the dielectric substrate 59.

The second patch antenna 64 has a circular shape with a diameter smaller than that of the first patch antenna 63. As illustrated in FIG. 18, the second patch antenna 64 is formed on the conductor ground plane 58 by providing a conductor removed portion 58*a* in the conductor ground plane 58.

The conductor removed portion 58*a* is a portion formed by removing the conductor from the conductor ground plane 58 along the outer shape of the second patch antenna 64. When the second patch antenna 64 has a circular shape, the conductor removed portion 58*a* is an annular portion formed by removing the conductor from the conductor ground plane 58 as illustrated in FIG. 18. Note that the second patch antenna 64 is not limited to one having a circular shape, and it may have, for example, a polygonal shape such as a triangular shape or a quadrangular shape.

The conductor ground plane 58 of the dielectric substrate 59 and the conductor ground plane 56 of the dielectric substrate 55 are bonded by the solder 57 via the conductor plating 53*c* in a state where the through hole 55*a* and the second patch antenna 64 are arranged to face each other. For example, the dielectric substrate 55 and the dielectric substrate 59 are bonded with the second patch antenna 64 facing the through hole 55*a* as illustrated in FIG. 18. The solder 57 is a second solder for bonding the conductor ground planes. The solder 57 is not applied to a region 57*a* facing the through hole 55*a*.

In the dielectric substrate 59, a via 61*a* and a via 61*b* are formed, and a first feeding pin 62*a* and a second feeding pin 62*b* are formed. The via 61*a* and the via 61*b* electrically connect the conductor ground plane 60 and the conductor ground plane 58. The conductor ground plane 58 is bonded to the conductor ground plane 56 by the solder 57, the conductor ground plane 56 is electrically bonded to the conductor ground plane 54 by the conductor plating 55*b*, and the conductor ground plane 54 is bonded to the conductor ground plane 51 by the solder 52. Therefore, due to the via 61*a* and the via 61*b* being provided, the potential from the conductor ground plane 60 to the conductor ground plane 51 is the same. The vias 61*a* and 61*b* are provided so as to surround the second patch antenna 64.

The first feeding pin 62*a* and the second feeding pin 62*b* have a feeding structure for feeding power to the second patch antenna 64. For example, a first polarized wave is fed to the first feeding pin 62*a*, and a second polarized wave orthogonal to the first polarized wave is fed to the second feeding pin 62*b*. The second patch antenna 64 operates as an antenna by being fed with power from the first feeding pin 62*a* and the second feeding pin 62*b*. Although the pin feeding method has been described, a feeding structure using slot coupling or spatial coupling of microstrip lines may be used as the structure for feeding power to the second patch antenna 64.

The hollow structure 65 is constituted by the first patch antenna 63, the conductor removed portion 51*a*, the region 52*a*, the opening 53*b*, the opening 54*a*, the through hole 55*a*, the opening 56*a*, the opening 53*d*, the region 57*a*, and the second patch antenna 64. The size of the hollow structure 65 is set so that a gain difference between a vertically polarized wave and a horizontally polarized wave decreases when the antenna device illustrated in FIG. 17 performs beam scanning in a wide angle direction. This suppresses a decrease in an axial ratio when beam scanning is performed in the wide angle direction. The solder 52 and the solder 57 are applied in an amount that does not cause leakage into the hollow structure 31 when melted.

Although the dielectric substrate 50 in which the conductor ground plane 51 is provided on the back side has been described above, the conductor ground plane 51 may be provided on both the front side and the back side of the dielectric substrate 50. In this case, the first patch antenna 63 may be provided only on the conductor ground plane 51 on the back side of the dielectric substrate 50, or may be provided only on the conductor ground plane 51 on the front side of the dielectric substrate 50. In addition, the configuration in which there is no via in the dielectric substrate 50 and the dielectric substrate 55 has been described, both or either of these substrates may have a via.

As described above, the antenna device according to the seventh embodiment includes the first feeding pin 62*a* and the second feeding pin 62*b* which are provided on the dielectric substrate 59, and the second patch antenna 64 which is provided on the dielectric substrate 59 and fed with power from the first feeding pin 62*a* and the second feeding pin 62*b*. Since the hollow structure 65 is provided immediately below the parasitic first patch antenna 63, cross polarization can be suppressed. In addition, circularly polarized waves can be radiated by feeding power having phases different by 90 degrees to the first feeding pin 62*a* and the second feeding pin 62*b*.

Eighth Embodiment

Figure 19:
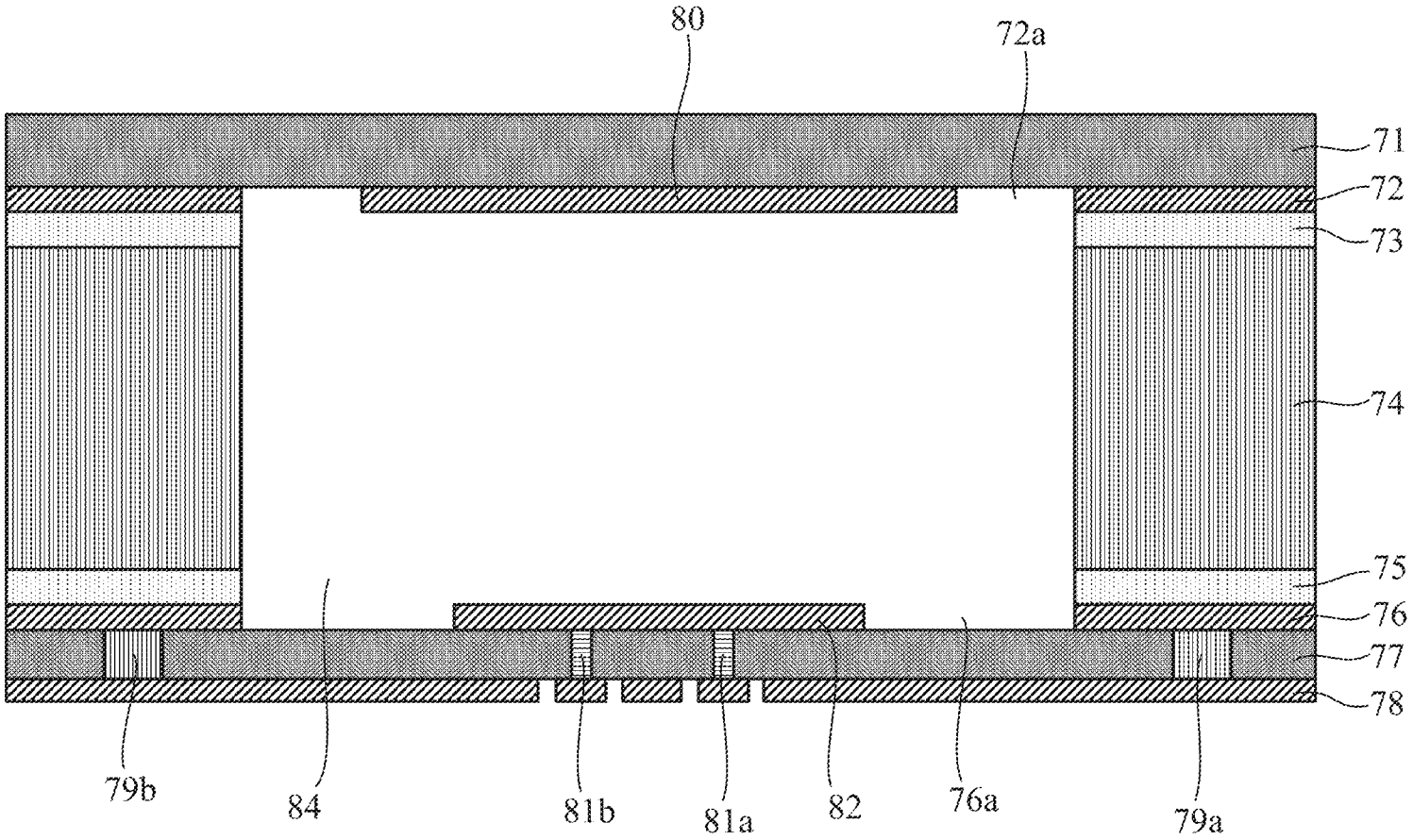
FIG. 19 is a longitudinal sectional view illustrating a configuration of an antenna device according to an eighth embodiment.
Figure 20:
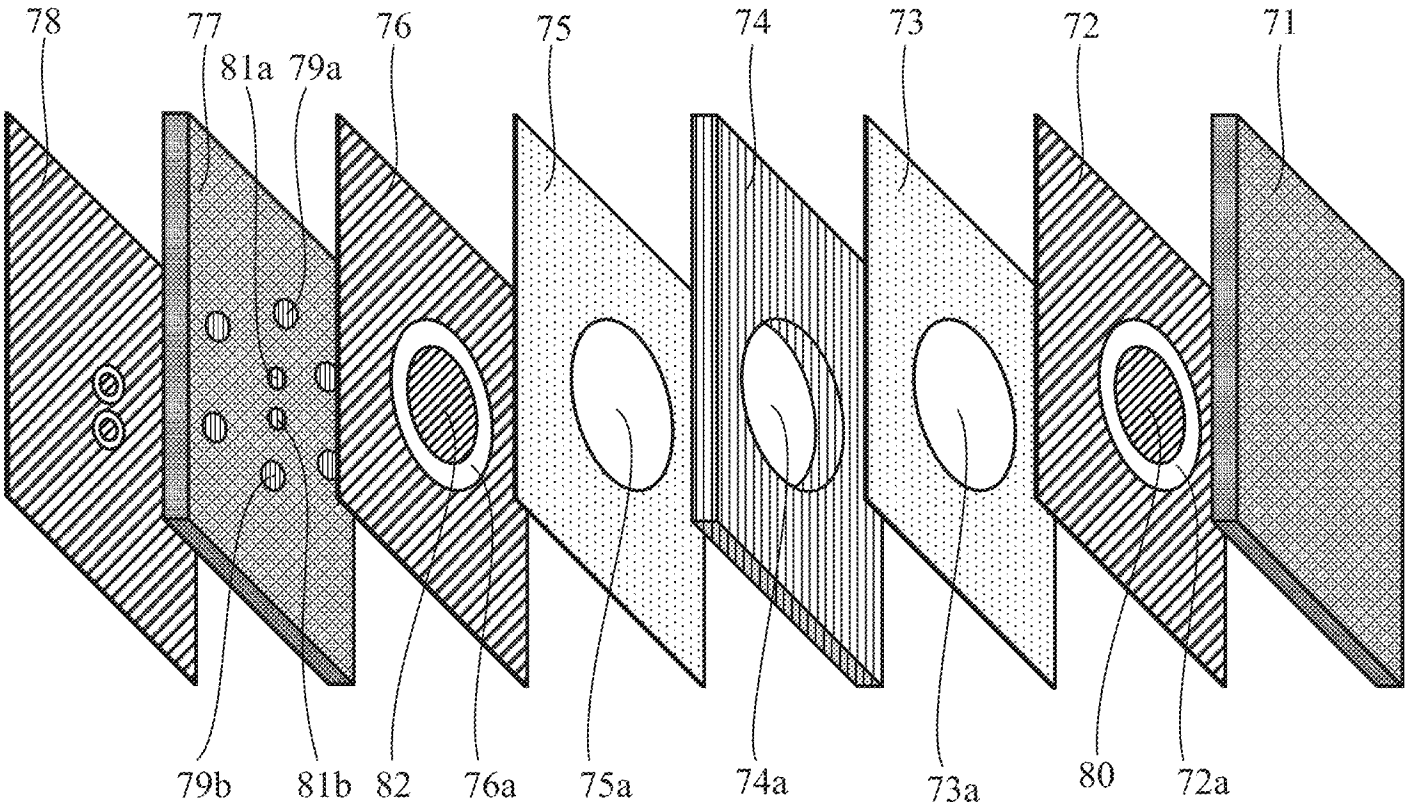
FIG. 20 is an exploded perspective view illustrating the configuration of the antenna device in FIG. 19.

FIG. 19 is a longitudinal sectional view illustrating a configuration of an antenna device according to the eighth embodiment. FIG. 20 is an exploded perspective view illustrating the configuration of the antenna device shown in FIG. 19. As illustrated in FIG. 19, the antenna device according to the eighth embodiment includes a dielectric substrate 71, a conductor ground plane 72, solder 73, a conductor plate 74, solder 75, a conductor ground plane 76, a dielectric substrate 77, and a conductor ground plane 78. Inside a dielectric substrate obtained by bonding the dielectric substrate 71, the conductor plate 74, and the dielectric substrate 77, a hollow structure 84 for adjusting an equivalent dielectric constant of the dielectric substrate is provided, and a first patch antenna 80 and a second patch antenna 82 face the hollow structure 84.

The dielectric substrate 71 is a first dielectric substrate having the conductor ground plane 72. The conductor ground plane 72 is a first conductor ground plane provided on the entire back side of the dielectric substrate 71, and is provided with the first patch antenna 80. The first patch antenna 80 is formed in a circular shape, and is provided on the conductor ground plane 72 by providing a conductor removed portion 72*a* in the conductor ground plane 72 as illustrated in FIG. 18.

The conductor removed portion 72*a* is a portion formed by removing the conductor from the conductor ground plane 72 along the outer shape of the first patch antenna 80. When the first patch antenna 80 has a circular shape, the conductor removed portion 72*a* is an annular portion formed by removing the conductor from the conductor ground plane 72 as illustrated in FIG. 20. Note that the first patch antenna 80 is not limited to one having a circular shape, and it may have, for example, a polygonal shape such as a triangular shape or a quadrangular shape.

The conductor plate 74 is a first conductor plate having a through hole 74*a*. The conductor ground plane 72 of the dielectric substrate 71 and the conductor plate 74 are bonded by the solder 73 in a state where the through hole 74*a* and the first patch antenna 80 are arranged to face each other. For example, the dielectric substrate 71 and the conductor plate 74 are bonded with the first patch antenna 80 facing the through hole 74*a* as illustrated in FIG. 20.

The solder 73 is a first solder for bonding the conductor ground plane and the conductor plate. The solder 73 is not applied to a region 73*a* facing the first patch antenna 80 and the conductor removed portion 72*a*, but applied to a portion other than the region 73*a* in the conductor ground plane 72 or the conductor plate 74.

The dielectric substrate 77 is a second dielectric substrate including the conductor ground plane 76 and the conductor ground plane 78. The conductor ground plane 76 is a second conductor ground plane provided on the entire front side of the dielectric substrate 77, and the conductor ground plane 78 is a third conductor ground plane provided on the entire back side of the dielectric substrate 77. The conductor ground plane 76 of the dielectric substrate 77 and the conductor plate 74 are bonded by the solder 75. The solder 75 is a second solder for bonding the conductor plate and the conductor ground plane. The solder 75 is not applied to a region 75*a* facing the through hole 74*a*, but applied to a portion other than the region 75*a* in the conductor ground plane 76.

The second patch antenna 82 is a circular patch antenna having a diameter smaller than that of the first patch antenna 80. As illustrated in FIG. 20, the second patch antenna 82 is formed in the conductor ground plane 76 by providing a conductor removed portion 76*a* in the conductor ground plane 76.

The conductor removed portion 76*a* is a portion formed by removing the conductor from the conductor ground plane 76 along the outer shape of the second patch antenna 82. When the second patch antenna 82 has a circular shape, the conductor removed portion 76*a* is an annular portion formed by removing the conductor from the conductor ground plane 76 as illustrated in FIG. 20. Note that the second patch antenna 82 is not limited to one having a circular shape, and it may have, for example, a polygonal shape such as a triangular shape or a quadrangular shape.

The conductor ground plane 72 of the dielectric substrate 71 and the conductor plate 74 are bonded by the solder 73 in a state where the through hole 74*a* and the first patch antenna 80 are arranged to face each other. For example, the dielectric substrate 71 and the conductor plate 74 are bonded with the first patch antenna 80 facing the through hole 74*a* as illustrated in FIG. 20.

In the dielectric substrate 77, a via 79*a* and a via 79*b* are formed, and a first feeding pin 81*a* and a second feeding pin 81*b* are formed. The via 79*a* and the via 79*b* electrically connect the conductor ground plane 76 and the conductor ground plane 78. The conductor ground plane 76 is bonded to the conductor plate 74 by the solder 75, and the conductor plate 74 is bonded to the conductor ground plane 72 by the solder 73. Since the via 79*a* and the via 79*b* are provided, the potential from the conductor ground plane 78 to the conductor ground plane 72 is the same. The vias 79*a* and 79*b* are provided so as to surround the second patch antenna 82.

The first feeding pin 81*a* and the second feeding pin 81*b* have a feeding structure for feeding power to the second patch antenna 82. For example, a first polarized wave is fed to the first feeding pin 81*a*, and a second polarized wave orthogonal to the first polarized wave is fed to the second feeding pin 81*b*. The second patch antenna 82 operates as an antenna by being fed with power from the first feeding pin 81*a* and the second feeding pin 81*b*. Although the pin feeding method has been described, a feeding structure using slot coupling or spatial coupling of microstrip lines may be used as the structure for feeding power to the second patch antenna 82.

The hollow structure 84 is constituted by the first patch antenna 80, the conductor removed portion 72*a*, the region 73*a*, the through hole 74*a*, the region 75*a*, and the second patch antenna 82. The size of the hollow structure 84 is set so that a gain difference between a vertically polarized wave and a horizontally polarized wave decreases when the antenna device illustrated in FIG. 19 performs beam scanning in a wide angle direction. This suppresses a decrease in an axial ratio when beam scanning is performed in the wide angle direction. The solder 73 and the solder 75 are applied in an amount that does not cause leakage into the hollow structure 84 when melted.

Although the dielectric substrate 71 in which the conductor ground plane 72 is provided on the back side has been described above, the conductor ground plane 72 may be provided on both the front side and the back side of the dielectric substrate 71. In this case, the first patch antenna 80 may be provided only on the conductor ground plane 72 on the back side of the dielectric substrate 71, or may be provided only on the conductor ground plane 72 on the front side of the dielectric substrate 71. Although a configuration in which the dielectric substrate 71 does not have a via, the dielectric substrate 71 may have a via.

As described above, the antenna device according to the eighth embodiment includes the first feeding pin 81*a* and the second feeding pin 81*b* which are provided on the dielectric substrate 77, and the second patch antenna 82 which is provided on the dielectric substrate 77 and fed with power from the first feeding pin 81*a* and the second feeding pin 81*b*. Since the hollow structure 84 is provided immediately below the parasitic first patch antenna 80, cross polarization can be suppressed. In addition, circularly polarized waves can be radiated by feeding power having phases different by 90 degrees to the first feeding pin 81*a* and the second feeding pin 81*b*.

Ninth Embodiment

Figure 21:
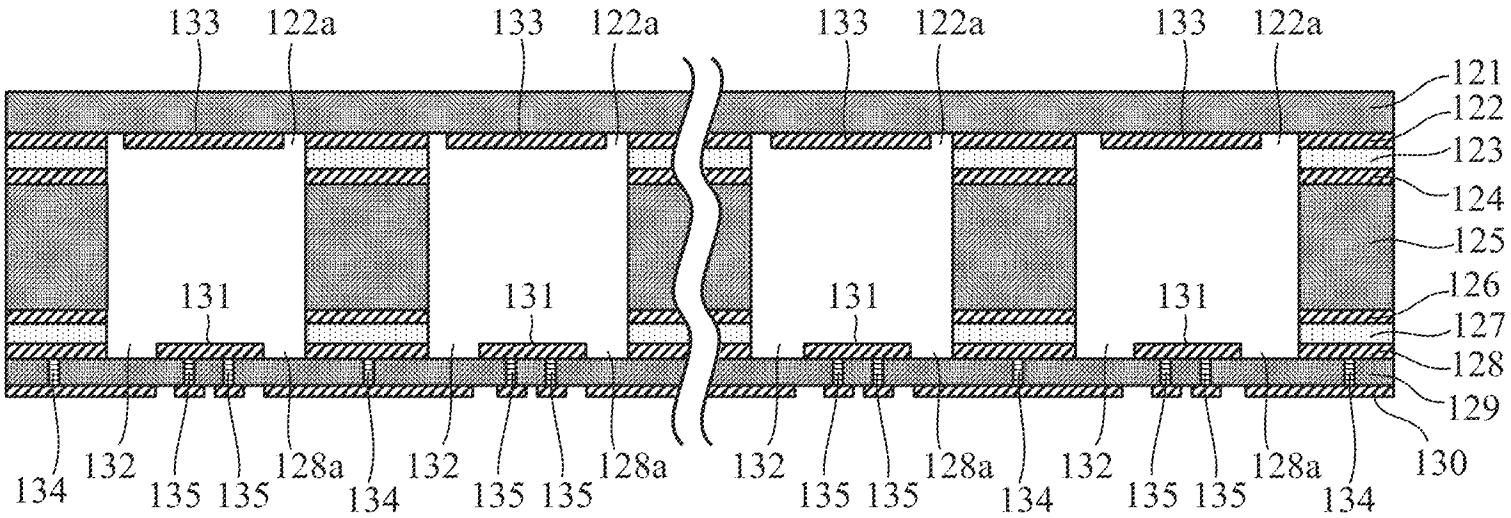
FIG. 21 is a longitudinal sectional view illustrating a configuration of an antenna device according to a ninth embodiment.
Figure 22:
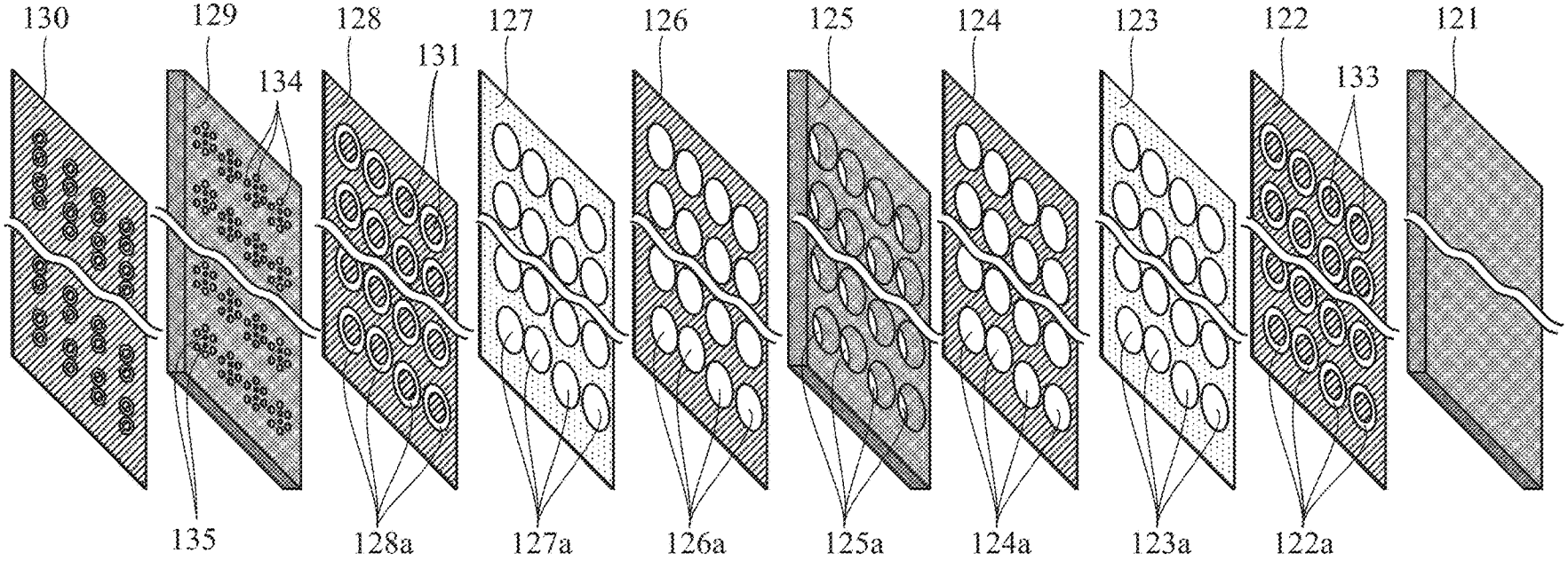
FIG. 22 is an exploded perspective view illustrating the configuration of the antenna device in FIG. 21.

FIG. 21 is a longitudinal sectional view illustrating a configuration of an antenna device according to the ninth embodiment. FIG. 22 is an exploded perspective view illustrating the configuration of the antenna device shown in FIG. 21. As illustrated in FIG. 21, the antenna device according to the ninth embodiment includes a dielectric substrate 121, a conductor ground plane 122, solder 123, a conductor ground plane 124, a dielectric substrate 125, a conductor ground plane 126, solder 127, a conductor ground plane 128, a dielectric substrate 129, and a conductor ground plane 130. Inside a dielectric substrate obtained by bonding the dielectric substrate 121, the dielectric substrate 125, and the dielectric substrate 129, a plurality of hollow structures 132 for adjusting an equivalent dielectric constant of the dielectric substrate is provided, and a first patch antenna 133 and a second patch antenna 131 face each of the hollow structures 132.

The dielectric substrate 121 is a first dielectric substrate having the conductor ground plane 122. The conductor ground plane 122 is a first conductor ground plane provided on the entire back side of the dielectric substrate 121, and is provided with a plurality of first patch antennas 133. Each of the plurality of first patch antennas 133 is formed in a circular shape, and is formed in the conductor ground plane 122 by providing a conductor removed portion 122*a* in the conductor ground plane 122 as illustrated in FIG. 22.

The conductor removed portion 122*a* is a portion formed by removing the conductor from the conductor ground plane 122 along the outer shape of the first patch antenna 133. When the first patch antenna 133 has a circular shape, the conductor removed portion 122*a* is an annular portion formed by removing the conductor from the conductor ground plane 122 as illustrated in FIG. 22. Note that the first patch antenna 133 is not limited to one having a circular shape, and it may have, for example, a polygonal shape such as a triangular shape or a quadrangular shape.

For example, the plurality of first patch antennas 133 is arranged in a rectangular array as illustrated in FIG. 22. However, the plurality of first patch antennas 133 may be arranged in a triangular array or a circular array, or may be arranged one-dimensionally instead of being arranged two-dimensionally.

The dielectric substrate 125 is a second dielectric substrate including the conductor ground plane 124 and the conductor ground plane 126. The conductor ground plane 124 is a second conductor ground plane provided on the entire front side (first side) of the dielectric substrate 125, and the conductor ground plane 126 is a third conductor ground plane provided on the entire side (back side, second side) opposite to the front side of the dielectric substrate 125.

The dielectric substrate 125 has a plurality of through holes 125*a* penetrating from the conductor ground plane 124 to the conductor ground plane 126. In the dielectric substrate 125, each of the plurality of through holes 125*a* is formed at positions facing the first patch antennas 133. That is, they are arranged in, for example, a rectangular array as illustrated in FIG. 22.

The conductor ground plane 122 of the dielectric substrate 121 and the conductor ground plane 124 of the dielectric substrate 125 are bonded by the solder 123 in a state where the positions of the plurality of through holes 125*a* and the plurality of first patch antennas 133 face each other. For example, the dielectric substrate 121 and the dielectric substrate 125 are bonded with each of the first patch antennas 133 facing the corresponding one of the through holes 125*a* as illustrated in FIG. 22. The solder 123 is a first solder for bonding the conductor ground planes.

The through holes 125*a* penetrate the dielectric substrate 125 from the conductor ground plane 124 to the conductor ground plane 126. Therefore, as illustrated in FIG. 22, openings 124*a* each having the same opening shape as the through hole 125*a* are formed in the conductor ground plane 124, and openings 126*a* each having the same opening shape as the through hole 125*a* are formed in the conductor ground plane 126. The solder 123 is not applied to regions 123*a* facing the through holes 125*a*, but applied to a portion other than the regions 123*a* in the conductor ground plane 122 or the conductor ground plane 124.

The dielectric substrate 129 is a third dielectric substrate including the conductor ground plane 128 and the conductor ground plane 130. The conductor ground plane 128 is a fourth conductor ground plane provided on the entire side (first side) of the dielectric substrate 129, and is provided with a plurality of second patch antennas 131. The conductor ground plane 130 is a fifth conductor ground plane provided on the entire side (back side, second side) opposite to the side of the dielectric substrate 129.

Each of the second patch antennas 131 is a circular patch antenna having a diameter smaller than that of the first patch antenna 133. As illustrated in FIG. 22, each of the second patch antennas 131 is formed in the conductor ground plane 128 by providing a conductor removed portion 128*a* in the conductor ground plane 128. The conductor removed portion 128*a* is a portion formed by removing the conductor from the conductor ground plane 128 along the outer shape of the second patch antenna 131.

When the second patch antenna 131 has a circular shape, the conductor removed portion 128*a* is an annular portion formed by removing the conductor from the conductor ground plane 128 as illustrated in FIG. 22. Note that the second patch antenna 131 is not limited to one having a circular shape, and it may have, for example, a polygonal shape such as a triangular shape or a quadrangular shape. Each of the plurality of second patch antennas 131 is formed at positions facing the through holes 125*a* in the conductor ground plane 128. That is, they are arranged in, for example, a rectangular array as illustrated in FIG. 22.

The conductor ground plane 128 of the dielectric substrate 129 and the conductor ground plane 126 of the dielectric substrate 125 are bonded by the solder 127 in a state where the positions of the plurality of through holes 125*a* and the plurality of second patch antennas 131 face each other. The solder 127 is a second solder for bonding the conductor ground planes. The solder 127 is not applied to regions 127*a* facing the through holes 125*a*, but applied to a portion other than the regions 127*a* in the conductor ground plane 128 or the conductor ground plane 126.

A plurality of vias 134 and a plurality of feeding pins 135 are formed in the dielectric substrate 129. The plurality of vias 134 electrically connects the conductor ground plane 130 and the conductor ground plane 128. Since the conductor ground plane 128 is bonded to the conductor ground plane 126 by the solder 127, the potential from the conductor ground plane 130 to the conductor ground plane 126 is the same due to the plurality of vias 134 being provided. The plurality of vias 134 is arranged so as to surround each of the plurality of second patch antennas 131.

Each of the plurality of feeding pins 135 has a feeding structure that feeds power to the corresponding one of the plurality of second patch antennas 131. For example, a set of two feeding pins 135 is provided for one second patch antenna 131. A first polarized wave is fed to one of the feeding pins 135, and a second polarized wave orthogonal to the first polarized wave is fed to the other feeding pin 135. The second patch antenna 131 operates as an antenna by being fed with power from the feeding pins 135. Although the pin feeding method has been described, a feeding structure using slot coupling or spatial coupling of microstrip lines may be used as the structure for feeding power to the second patch antennas 131.

Each of the plurality of hollow structures 132 is constituted by the first patch antenna 133, the conductor removed portion 122*a*, the region 123*a*, the opening 124*b*, the through hole 125*a*, the opening 126*a*, the region 127*a*, and the second patch antenna 131. The size of each hollow structure 132 is set so that a gain difference between a vertically polarized wave and a horizontally polarized wave decreases when the antenna device illustrated in FIG. 21 performs beam scanning in the wide angle direction. This suppresses a decrease in an axial ratio when beam scanning is performed in the wide angle direction. The solder 123 and the solder 127 are applied in an amount that does not cause leakage into each hollow structure 132 when melted.

Although the dielectric substrate 121 in which the conductor ground plane 122 is provided on the back side has been described above, the conductor ground plane 122 may be provided on both the front side and the back side of the dielectric substrate 121. In this case, the first patch antennas 133 may be provided only on the conductor ground plane 122 on the back side of the dielectric substrate 121, or may be provided only on the conductor ground plane 122 on the front side of the dielectric substrate 121. Although the configuration in which there is no via in the dielectric substrate 121 and the dielectric substrate 125 has been described above, both or either of these substrates may have a via.

Next, a modification of the antenna device according to the ninth embodiment will be described.

Figure 23:
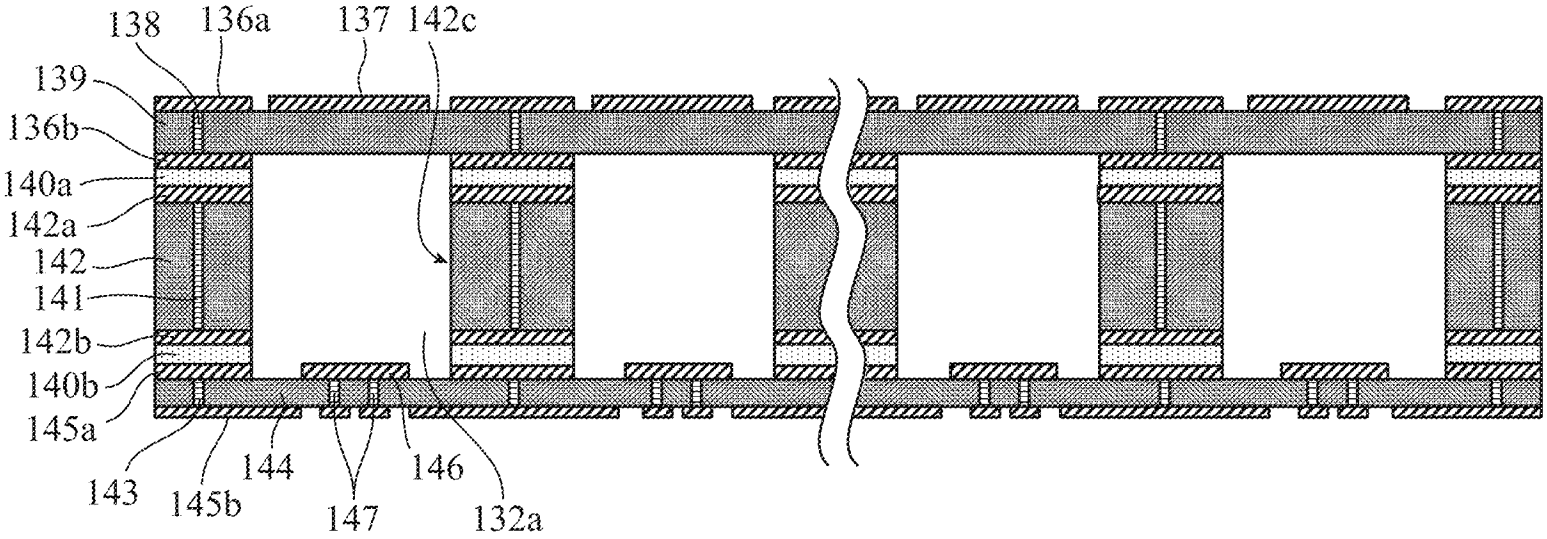
FIG. 23 is a longitudinal sectional view illustrating a configuration of a first modification of the antenna device according to the ninth embodiment.

FIG. 23 is a longitudinal sectional view illustrating a configuration of a first modification of the antenna device according to the ninth embodiment. The antenna device illustrated in FIG. 23 includes a conductor ground plane 136*a*, a dielectric substrate 139, a conductor ground plane 136*b*, solder 140*a*, a conductor ground plane 142*a*, a dielectric substrate 142, a conductor ground plane 142*b*, solder 140*b*, a conductor ground plane 145*a*, a dielectric substrate 144, and a conductor ground plane 145*b*. Inside a dielectric substrate obtained by bonding the dielectric substrate 139, the dielectric substrate 142, and the dielectric substrate 144, a plurality of hollow structures 132*a* for adjusting an equivalent dielectric constant of the dielectric substrate is provided.

The dielectric substrate 139 is a first dielectric substrate having the conductor ground plane 136*a* and the conductor ground plane 136*b*. The conductor ground plane 136*a* is a zeroth conductor ground plane provided on the entire front side (first side) of the dielectric substrate 139, and is provided with a plurality of first patch antennas 137. The conductor ground plane 136*b* is a first conductor ground plane provided on the entire side (back side, second side) opposite to the front side of the dielectric substrate 139. The conductor ground plane 136*b* has openings formed by removing the conductor from portions facing through holes 142*c* of the dielectric substrate 142.

Each of the plurality of first patch antennas 137 is, for example, formed in a circular shape. The first patch antennas 137 may be arranged in a triangular array, a rectangular array, or a circular array, or may be arranged one-dimensionally instead of being arranged two-dimensionally. Vias 138 are provided in the dielectric substrate 139 to electrically connect the conductor ground plane 136*a* and the conductor ground plane 136*b*.

The dielectric substrate 142 is a second dielectric substrate having the conductor ground plane 142*a* and the conductor ground plane 142*b*. The conductor ground plane 142*a* is a second conductor ground plane provided on the entire front side (first side) of the dielectric substrate 142, and the conductor ground plane 142*b* is a third conductor ground plane provided on the entire side (back side, second side) opposite to the front side of the dielectric substrate 142.

The dielectric substrate 142 has a plurality of through holes 142*c* penetrating from the conductor ground plane 142*a* to the conductor ground plane 142*b*. In the dielectric substrate 142, each of the plurality of through holes 142*c* is formed at positions facing the first patch antennas 137. That is, they are arranged in, for example, a rectangular array. Vias 141 are provided in the dielectric substrate 142 to electrically connect the conductor ground plane 142*a* and the conductor ground plane 142*b*.

The conductor ground plane 136*b* of the dielectric substrate 139 and the conductor ground plane 142*a* of the dielectric substrate 142 are bonded by the solder 140*a* in a state where the positions of the plurality of through holes 142*c* and the plurality of first patch antennas 137 face each other. The solder 140*a* is a first solder for bonding the conductor ground planes.

The dielectric substrate 144 is a third dielectric substrate including the conductor ground plane 145*a* and the conductor ground plane 145*b*. The conductor ground plane 145*a* is a fourth conductor ground plane provided on the entire front side of the dielectric substrate 144, and is provided with a plurality of second patch antennas 146. The conductor ground plane 145*b* is a fifth conductor ground plane provided on the entire back side of the dielectric substrate 144. Each of the second patch antennas 146 is a circular patch antenna having a diameter smaller than that of the first patch antenna 137.

A plurality of vias 143 and a plurality of feeding pins 147 are formed in the dielectric substrate 144. The plurality of vias 143 electrically connects the conductor ground plane 145*a* and the conductor ground plane 145*b*. The conductor ground plane 145*a* is bonded to the conductor ground plane 142*b* by the solder 140*b*, the conductor ground plane 142*b* is bonded to the conductor ground plane 142*a* by the vias 141, the conductor ground plane 142*a* is bonded to the conductor ground plane 136*b* by the solder 140*a*, and the conductor ground plane 136*b* is bonded to the conductor ground plane 136*a* by the vias 138. As a result, the potential from the conductor ground plane 145*b* to the conductor ground plane 136*a* is the same. Note that each of the vias 143 is arranged so as to surround the corresponding one of the second patch antennas 146.

Each of the plurality of feeding pins 147 has a feeding structure that feeds power to the corresponding one of the plurality of second patch antennas 146. For example, a set of two feeding pins 147 is provided for one second patch antenna 146. A first polarized wave is fed to one of the feeding pins 147, and a second polarized wave orthogonal to the first polarized wave is fed to the other feeding pin 147. The second patch antennas 146 operate as an antenna by being fed with power from the feeding pins 147. Although the pin feeding method has been described, a feeding structure using slot coupling or spatial coupling of microstrip lines may be used as the structure for feeding power to the second patch antennas 146.

The size of each of the plurality of hollow structures 132*a* is set so that a gain difference between a vertically polarized wave and a horizontally polarized wave decreases when the antenna device illustrated in FIG. 23 performs beam scanning in a wide angle direction. This suppresses a decrease in an axial ratio when beam scanning is performed in the wide angle direction.

Figure 24:
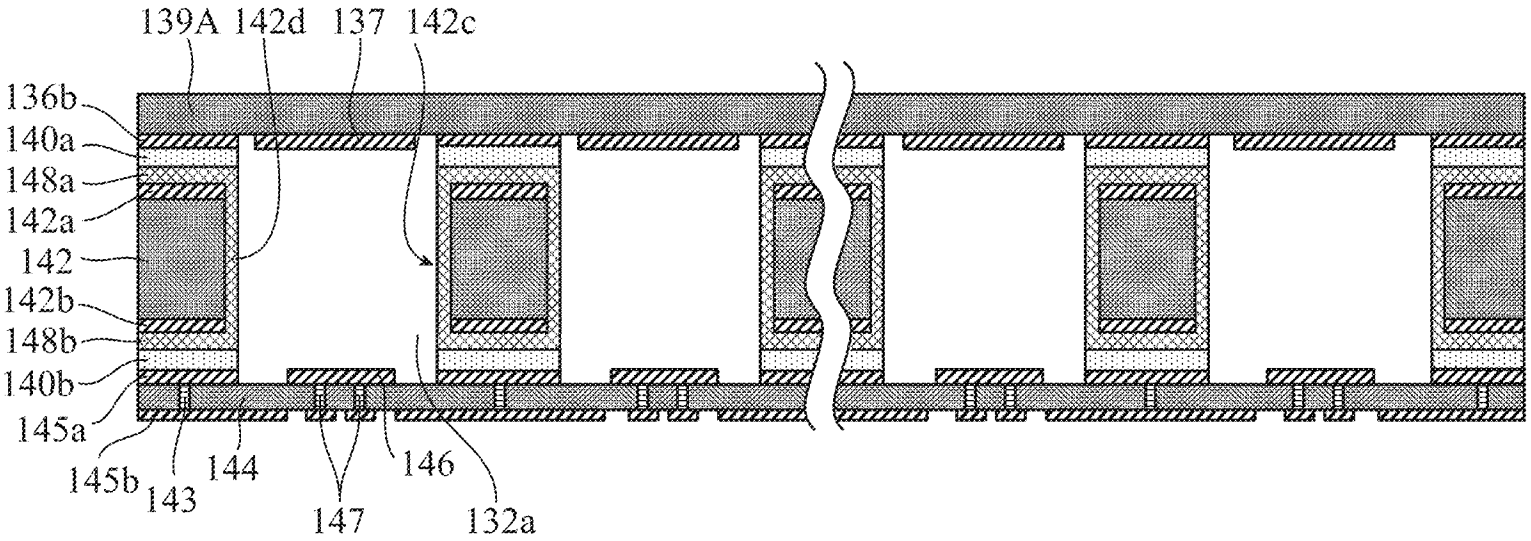
FIG. 24 is a longitudinal sectional view illustrating a configuration of a second modification of the antenna device according to the ninth embodiment.

FIG. 24 is a longitudinal sectional view illustrating a configuration of a second modification of the antenna device according to the ninth embodiment. The antenna device illustrated in FIG. 24 includes a dielectric substrate 139A, a conductor ground plane 136*b*, solder 140*a*, conductor plating 148*a*, a conductor ground plane 142*a*, a dielectric substrate 142, a conductor ground plane 142*b*, conductor plating 148*b*, solder 140*b*, a conductor ground plane 145*a*, a dielectric substrate 144, and a conductor ground plane 145*b*. Inside a dielectric substrate obtained by bonding the dielectric substrate 139A, the dielectric substrate 142, and the dielectric substrate 144, a plurality of hollow structures 132*a* for adjusting an equivalent dielectric constant of the dielectric substrate is provided.

The dielectric substrate 139A is a first dielectric substrate having the conductor ground plane 136*b*. The conductor ground plane 136*b* is a first conductor ground plane provided on the entire back side of the dielectric substrate 139A, and is provided with a plurality of first patch antennas 137. Each of the plurality of first patch antennas 137 is, for example, formed in a circular shape. The first patch antennas 137 may be arranged in a triangular array, a rectangular array, or a circular array, or may be arranged one-dimensionally instead of being arranged two-dimensionally.

The dielectric substrate 142 is a second dielectric substrate including the conductor ground plane 142*a* and the conductor ground plane 142*b*. The conductor ground plane 142*a* is a second conductor ground plane provided on the entire front side of the dielectric substrate 142, and the conductor ground plane 142*b* is a third conductor ground plane provided on the entire back side of the dielectric substrate 142. The dielectric substrate 142 has a plurality of through holes 142*c* penetrating from the conductor ground plane 142*a* to the conductor ground plane 142*b*. The dielectric substrate 142 in which the plurality of through holes 142*c* is formed is subjected to conductor plating processing. By the conductor plating processing, the conductor plating 148*a* is provided on an upper layer of the conductor ground plane 142*a*, conductor plating 142*d* is provided on the side walls of the through holes 142*c*, and the conductor plating 148*b* is provided on a lower layer of the conductor ground plane 142*b*.

The conductor ground plane 136*b* of the dielectric substrate 139A and the conductor ground plane 142*a* of the dielectric substrate 142 are bonded by the solder 140*a* via the conductor plating 148*a* in a state where the positions of the plurality of through holes 142*c* and the plurality of first patch antennas 137 face each other. The solder 140*a* is a first solder for bonding the conductor ground planes.

The dielectric substrate 144 is a third dielectric substrate including the conductor ground plane 145*a* and the conductor ground plane 145*b*. The conductor ground plane 145*a* is a fourth conductor ground plane provided on the entire front side of the dielectric substrate 144, and is provided with a plurality of second patch antennas 146. The conductor ground plane 145*b* is a fifth conductor ground plane provided on the entire back side of the dielectric substrate 144. Each of the second patch antennas 146 is a circular patch antenna having a diameter smaller than that of the first patch antenna 137.

The conductor ground plane 145*a* of the dielectric substrate 144 and the conductor ground plane 142*b* of the dielectric substrate 142 are bonded by the solder 140*b* via the conductor plating 148*b* in a state where the positions of the plurality of through holes 142*c* and the plurality of second patch antennas 146 face each other. The solder 140*b* is a second solder for bonding the conductor ground planes.

A plurality of vias 143 and a plurality of feeding pins 147 are formed in the dielectric substrate 144. The plurality of vias 143 electrically connects the conductor ground plane 145*a* and the conductor ground plane 145*b*. The conductor ground plane 145*a* is bonded to the conductor ground plane 142*b* by the conductor plating 148*b* and the solder 140*b*, the conductor ground plane 142*b* is bonded to the conductor ground plane 142*a* by the conductor plating 142*d*, and the conductor ground plane 142*a* is bonded to the conductor ground plane 136*b* by the conductor plating 148*a* and the solder 140*a*. As a result, the potential from the conductor ground plane 145*b* to the conductor ground plane 136*b* is the same. Note that each of the vias 143 is arranged so as to surround the corresponding one of the second patch antennas 146. The function of the feeding pins 147 is the same as that of the feeding pins 147 in FIG. 23.

The size of each of the hollow structures 132*a* is set so that a gain difference between a vertically polarized wave and a horizontally polarized wave decreases when the antenna device illustrated in FIG. 24 performs beam scanning in a wide angle direction. This suppresses a decrease in an axial ratio when beam scanning is performed in the wide angle direction.

Figure 25:
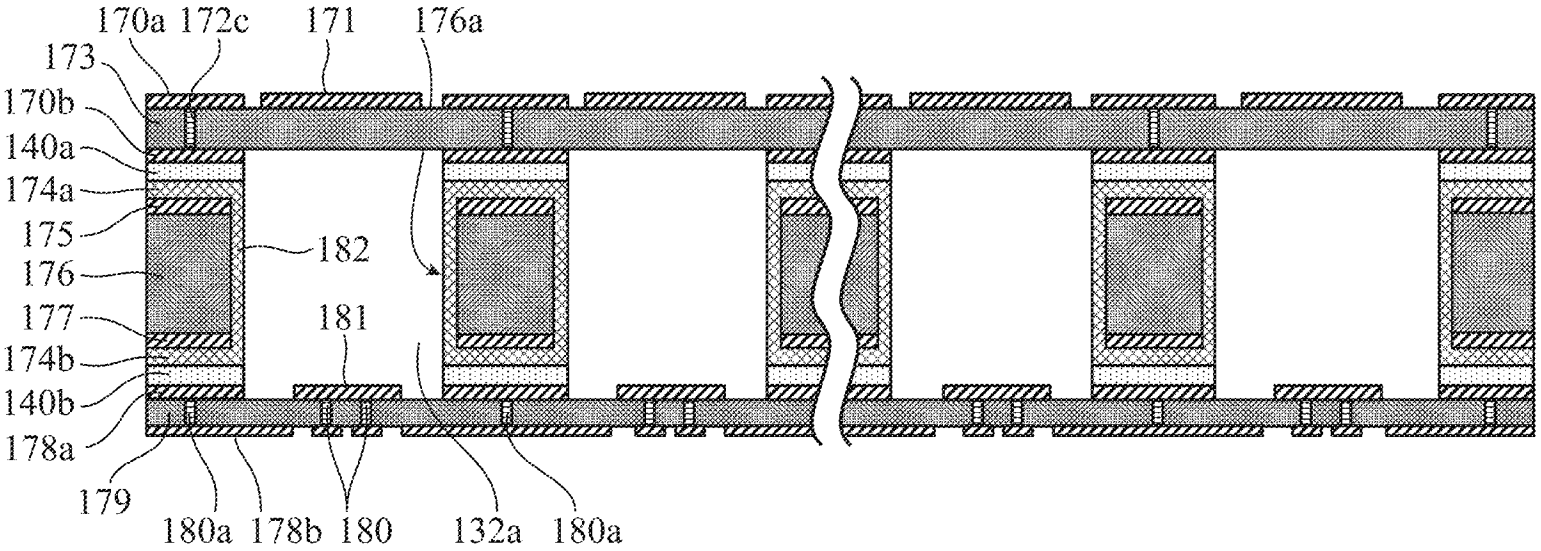
FIG. 25 is a longitudinal sectional view illustrating a configuration of a third modification of the antenna device according to the ninth embodiment.

FIG. 25 is a longitudinal sectional view illustrating a configuration of a third modification of the antenna device according to the ninth embodiment. The antenna device illustrated in FIG. 25 includes a conductor ground plane 170*a*, a dielectric substrate 173, a conductor ground plane 170*b*, solder 140*a*, conductor plating 174*a*, a conductor ground plane 175, a dielectric substrate 176, a conductor ground plane 177, conductor plating 174*b*, solder 140*b*, a conductor ground plane 178*a*, a dielectric substrate 179, and a conductor ground plane 178*b*. Inside a dielectric substrate obtained by bonding the dielectric substrate 173, the dielectric substrate 176, and the dielectric substrate 179, a plurality of hollow structures 132*a* for adjusting an equivalent dielectric constant of the dielectric substrate is provided.

The dielectric substrate 173 is a first dielectric substrate having the conductor ground plane 170*a* and the conductor ground plane 170*b*. The conductor ground plane 170*a* is a zeroth conductor ground plane provided on the entire front side (first side) of the dielectric substrate 173, and is provided with a plurality of first patch antennas 171. The conductor ground plane 170*b* is a first conductor ground plane provided on the entire side (back side, second side) opposite to the front side of the dielectric substrate 173. The conductor ground plane 170*b* has openings formed by removing the conductor from portions facing through holes 176*a* of the dielectric substrate 176.

The dielectric substrate 176 is a second dielectric substrate including the conductor ground plane 175 and the conductor ground plane 177. The conductor ground plane 175 is a second conductor ground plane provided on the entire front side of the dielectric substrate 176, and the conductor ground plane 177 is a third conductor ground plane provided on the entire back side of the dielectric substrate 176. The dielectric substrate 176 has a plurality of through holes 176*a* penetrating from the conductor ground plane 175 to the conductor ground plane 177. The dielectric substrate 176 in which the plurality of through holes 176*a* is formed is subjected to conductor plating processing. By the conductor plating processing, the conductor plating 174*a* is provided on an upper layer of the conductor ground plane 175, conductor plating 182 is provided on the side walls of the through holes 176*a*, and the conductor plating 174*b* is provided on a lower layer of the conductor ground plane 177.

The conductor ground plane 170*b* of the dielectric substrate 173 and the conductor ground plane 175 of the dielectric substrate 176 are bonded by the solder 140*a* via the conductor plating 174*a* in a state where the positions of the plurality of through holes 176*a* and the plurality of first patch antennas 137 face each other. The solder 140*a* is a first solder for bonding the conductor ground planes.

The dielectric substrate 179 is a third dielectric substrate having the conductor ground plane 178*a* and the conductor ground plane 178*b*. The conductor ground plane 178*a* is a fourth conductor ground plane provided on the entire front side of the dielectric substrate 179, and is provided with a plurality of second patch antennas 181. The conductor ground plane 178*b* is a fifth conductor ground plane provided on the entire back side of the dielectric substrate 179. Each of the second patch antennas 181 is a circular patch antenna having a diameter smaller than that of the first patch antenna 171.

The conductor ground plane 178*a* of the dielectric substrate 179 and the conductor ground plane 177 of the dielectric substrate 176 are bonded by the solder 140*b* via the conductor plating 174*b* in a state where the positions of the plurality of through holes 176*a* and the plurality of second patch antennas 181 face each other. The solder 140*b* is a second solder for bonding the conductor ground planes.

A plurality of vias 180*a* and a plurality of feeding pins 180 are formed in the dielectric substrate 179. The plurality of vias 180*a* electrically connects the conductor ground plane 178*a* and the conductor ground plane 178*b*. The conductor ground plane 178*a* is bonded to the conductor ground plane 177 by the conductor plating 174*b* and the solder 140*b*, the conductor ground plane 177 is bonded to the conductor ground plane 175 by the conductor plating 182, the conductor ground plane 175 is bonded to the conductor ground plane 170*b* by the conductor plating 174*a* and the solder 140*a*, and the conductor ground plane 170*b* is electrically bonded to the conductor ground plane 170*a* by vias 172*c*. As a result, the potential from the conductor ground plane 178*b* to the conductor ground plane 170*a* is the same. Note that each of the vias 180*a* is arranged so as to surround the corresponding one of the second patch antennas 181. The function of the feeding pins 180 is the same as that of the feeding pins 147 in FIG. 23.

The size of each of the hollow structures 132*a* is set so that a gain difference between a vertically polarized wave and a horizontally polarized wave decreases when the antenna device illustrated in FIG. 25 performs beam scanning in a wide angle direction. This suppresses a decrease in an axial ratio when beam scanning is performed in the wide angle direction.

Figure 26:
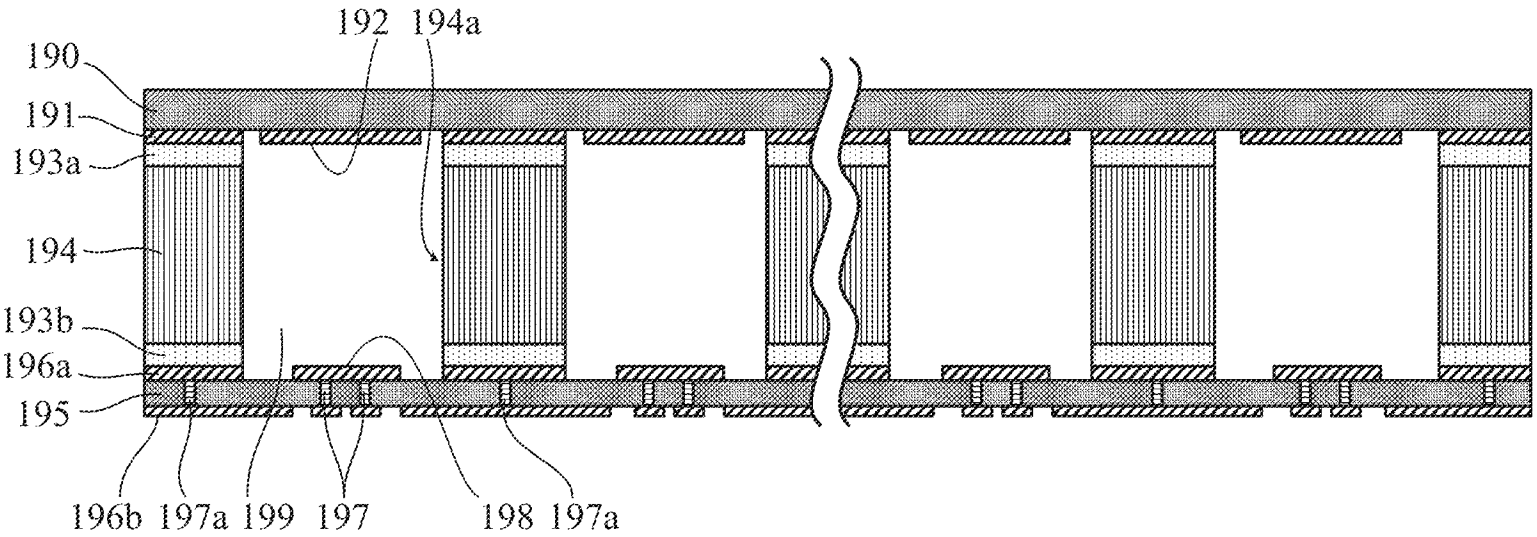
FIG. 26 is a longitudinal sectional view illustrating a configuration of a fourth modification of the antenna device according to the ninth embodiment.

FIG. 26 is a longitudinal sectional view illustrating a configuration of a fourth modification of the antenna device according to the ninth embodiment. The antenna device illustrated in FIG. 26 includes a dielectric substrate 190, a conductor ground plane 191, solder 193*a*, a conductor plate 194, solder 193*b*, a conductor ground plane 196*a*, a dielectric substrate 195, and a conductor ground plane 196*b*. Inside a dielectric substrate obtained by bonding the dielectric substrate 190, the conductor plate 194, and the dielectric substrate 195, a plurality of hollow structures 199 for adjusting an equivalent dielectric constant of the dielectric substrate is provided.

The dielectric substrate 190 is a first dielectric substrate having the conductor ground plane 191. The conductor ground plane 191 is a first conductor ground plane provided on the entire back side of the dielectric substrate 190, and is provided with a plurality of first patch antennas 192. Each of the plurality of first patch antennas 192 is, for example, formed in a circular shape. The first patch antennas 192 may be arranged in a triangular array, a rectangular array, or a circular array, or may be arranged one-dimensionally instead of being arranged two-dimensionally.

The conductor plate 194 is a first conductor plate having a plurality of through holes 194*a*. The conductor ground plane 191 of the dielectric substrate 190 and the conductor plate 194 are bonded by the solder 193*a* in a state where the positions of the plurality of through holes 194*a* and the plurality of first patch antennas 192 face each other. The solder 193*a* is a first solder for bonding the conductor ground plane and the conductor plate.

The dielectric substrate 195 is a third dielectric substrate including the conductor ground plane 196*a* and the conductor ground plane 196*b*. The conductor ground plane 196*a* is a fourth conductor ground plane provided on the entire side of the dielectric substrate 195, and is provided with a plurality of second patch antennas 198. The conductor ground plane 196*b* is a fifth conductor ground plane provided on the entire back side of the dielectric substrate 195. Each of the second patch antennas 198 is a circular patch antenna having a diameter smaller than that of the first patch antenna 192.

The conductor ground plane 196*a* of the dielectric substrate 195 and the conductor plate 194 are bonded by the solder 193*b* in a state where the positions of the plurality of through holes 194*a* and the plurality of second patch antennas 198 face each other. The solder 193*b* is a second solder for bonding the conductor ground plane and the conductor plate.

A plurality of vias 197*a* and a plurality of feeding pins 197 are formed in the dielectric substrate 195. The plurality of vias 197*a* electrically connects the conductor ground plane 196*a* and the conductor ground plane 196*b*. The conductor ground plane 196*a* is bonded to the conductor plate 194 by the solder 193*b*, and the conductor plate 194 is bonded to the conductor ground plane 191 by the solder 193*a*. As a result, the potential from the conductor ground plane 196*b* to the conductor ground plane 191 is the same. Note that each of the vias 197*a* is arranged so as to surround the corresponding one of the second patch antennas 198. The function of the feeding pins 197 is the same as that of the feeding pins 147 in FIG. 23.

The size of each of the hollow structures 199 is set so that a gain difference between a vertically polarized wave and a horizontally polarized wave decreases when the antenna device illustrated in FIG. 26 performs beam scanning in a wide angle direction. This suppresses a decrease in an axial ratio when beam scanning is performed in the wide angle direction.

The antenna device according to the ninth embodiment only needs to have a structure including two or more hollow structures each including a through hole and a patch antenna, and may have a plurality of structures of the antenna device according to any one of the first to eighth embodiments.

As described above, the antenna device according to the ninth embodiment includes two or more hollow structures each including a through hole and a patch antenna, and thus, can be used as an array antenna device. In addition, since the second patch antenna fed with power from the feeding pins is provided in each of the plurality of hollow structures, it is possible to perform beam scanning in a desired direction by adjusting the feeding phase of the antenna having each hollow structure using a phase shifter.

Tenth Embodiment

Figure 27:
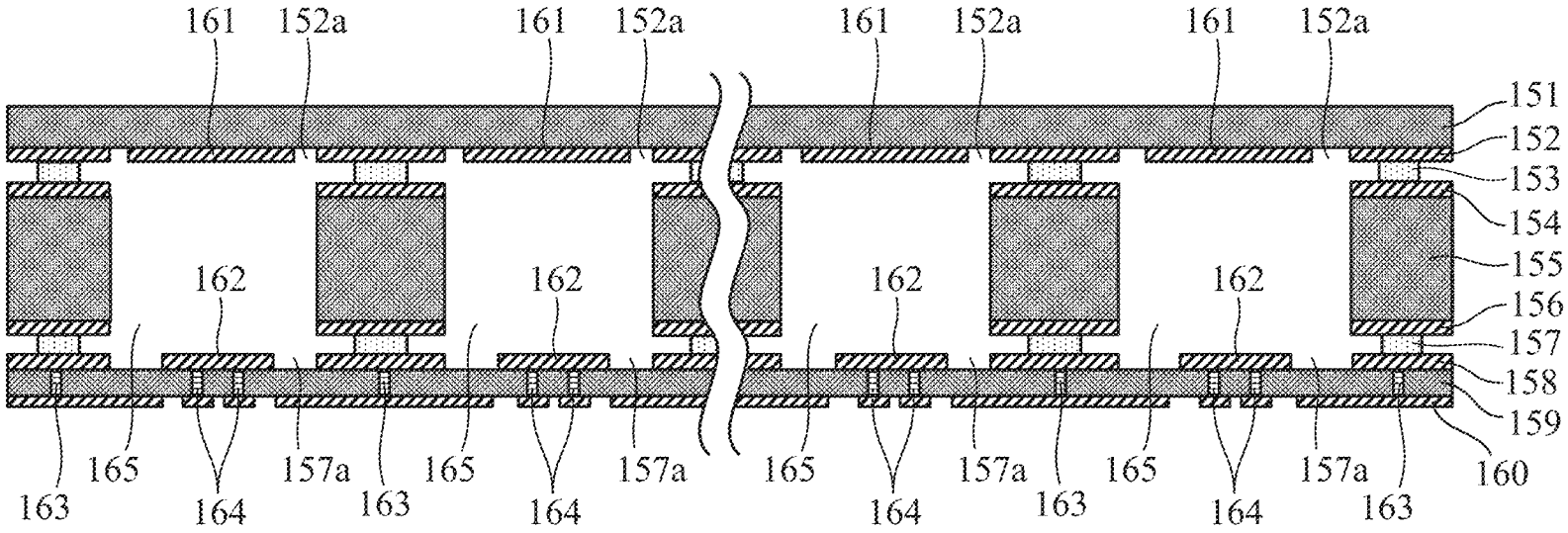
FIG. 27 is a longitudinal sectional view illustrating a configuration of an antenna device according to a tenth embodiment.
Figure 28:
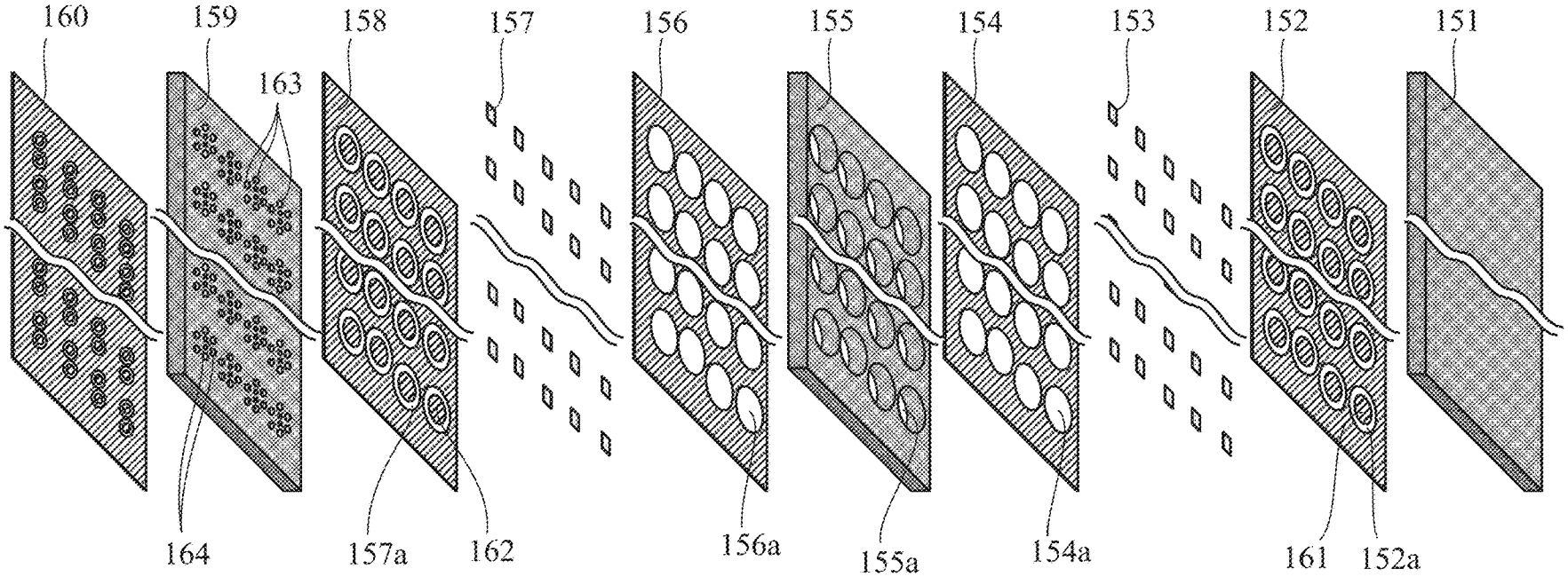
FIG. 28 is an exploded perspective view illustrating the configuration of the antenna device in FIG. 27.

FIG. 27 is a longitudinal sectional view illustrating a configuration of an antenna device according to the tenth embodiment. FIG. 28 is an exploded perspective view illustrating the configuration of the antenna device shown in FIG. 27. As illustrated in FIG. 27, the antenna device according to the tenth embodiment includes a dielectric substrate 151, a conductor ground plane 152, solder 153, a conductor ground plane 154, a dielectric substrate 155, a conductor ground plane 156, solder 157, a conductor ground plane 158, a dielectric substrate 159, and a conductor ground plane 160. Inside a dielectric substrate obtained by bonding the dielectric substrate 151, the dielectric substrate 155, and the dielectric substrate 159, a plurality of hollow structures 165 for adjusting an equivalent dielectric constant of the dielectric substrate is provided, and a first patch antenna 161 and a second patch antenna 162 face each of the hollow structures 165.

The dielectric substrate 151 is a first dielectric substrate having the conductor ground plane 152. The conductor ground plane 152 is a first conductor ground plane provided on the entire back side of the dielectric substrate 151, and is provided with a plurality of first patch antennas 161. Each of the plurality of first patch antennas 161 is formed in a circular shape, and is formed on the conductor ground plane 152 by providing a conductor removed portion 152*a* in the conductor ground plane 152 as illustrated in FIG. 28.

Each conductor removed portion 152*a* is a portion formed by removing is removed from the conductor ground plane 152 along the outer shape of the first patch antenna 161. When each of the first patch antennas 161 has a circular shape, the conductor removed portion 152*a* is an annular portion formed by removing the conductor from the conductor ground plane 152 as illustrated in FIG. 28. Note that the first patch antennas 161 are not limited to one having a circular shape, and it may have, for example, a polygonal shape such as a triangular shape or a quadrangular shape.

For example, the plurality of first patch antennas 161 is arranged in a rectangular array as illustrated in FIG. 28. However, the plurality of first patch antennas 161 may be arranged in a triangular array or a circular array, or may be arranged one-dimensionally instead of being arranged two-dimensionally.

The dielectric substrate 155 is a second dielectric substrate including the conductor ground plane 154 and the conductor ground plane 156. The conductor ground plane 154 is a second conductor ground plane provided on the entire front side (first side) of the dielectric substrate 155, and the conductor ground plane 156 is a third conductor ground plane provided on the entire side (back side, second side) opposite to the front side of the dielectric substrate 155.

The dielectric substrate 155 has a plurality of through holes 155*a* penetrating from the conductor ground plane 154 to the conductor ground plane 156. In the dielectric substrate 155, each of the plurality of through holes 155*a* is formed at positions facing the first patch antennas 161. That is, they are arranged in, for example, a rectangular array as illustrated in FIG. 28.

The conductor ground plane 152 of the dielectric substrate 151 and the conductor ground plane 154 of the dielectric substrate 155 are bonded by the solder 153 in a state where the positions of the plurality of through holes 155*a* and the plurality of first patch antennas 161 face each other. The solder 153 is a first solder for bonding the conductor ground planes, and is, for example, cream solder. In addition, the conductor ground plane 152 and the conductor ground plane 154 are bonded by the solder 153 at positions equidistant from the centers of the adjacent first patch antennas 161 as illustrated in FIG. 28.

The through holes 155*a* penetrate the dielectric substrate 155 from the conductor ground plane 154 to the conductor ground plane 156. Therefore, as illustrated in FIG. 28, openings 154*a* each having the same opening shape as the through hole 155*a* are formed in the conductor ground plane 154, and openings 156*a* each having the same opening shape as the through hole 155*a* are formed in the conductor ground plane 156. The solder 123 is applied to positions equidistant from the centers of the adjacent first patch antennas 161.

The dielectric substrate 159 is a third dielectric substrate including the conductor ground plane 158 and the conductor ground plane 160. The conductor ground plane 158 is a fourth conductor ground plane provided on the entire side (first side) of the dielectric substrate 159, and is provided with a plurality of second patch antennas 162. The conductor ground plane 160 is a fifth conductor ground plane provided on the entire side (back side, second side) opposite to the side of the dielectric substrate 159.

Each of the second patch antennas 162 is a circular patch antenna having a diameter smaller than that of the first patch antenna 161. As illustrated in FIG. 28, the second patch antenna 162 is formed in the conductor ground plane 158 by providing a conductor removed portion 158*a* in the conductor ground plane 158. The conductor removed portion 158*a* is a portion formed by removing the conductor from the conductor ground plane 158 along the outer shape of the second patch antenna 162.

When the second patch antenna 162 has a circular shape, the conductor removed portion 158*a* is an annular portion formed by removing the conductor from the conductor ground plane 158. Note that the second patch antennas 162 are not limited to one having a circular shape, and it may have, for example, a polygonal shape such as a triangular shape or a quadrangular shape. Each of the plurality of second patch antennas 162 is formed at positions facing the through holes 155*a* in the conductor ground plane 158, and thus, they are arranged in, for example, a rectangular array as illustrated in FIG. 28.

The conductor ground plane 158 of the dielectric substrate 159 and the conductor ground plane 156 of the dielectric substrate 155 are bonded by the solder 157 in a state where the positions of the plurality of through holes 155*a* and the plurality of second patch antennas 162 face each other. The solder 157 is a second solder for bonding the conductor ground planes, and is, for example, cream solder. In addition, the conductor ground plane 158 and the conductor ground plane 156 are bonded by the solder 157 at positions equidistant from the centers of the adjacent second patch antennas 162 as illustrated in FIG. 28.

A plurality of vias 163 and a plurality of feeding pins 164 are formed in the dielectric substrate 159. The plurality of vias 163 electrically connects the conductor ground plane 160 and the conductor ground plane 158. Since the conductor ground plane 158 is bonded to the conductor ground plane 156 by the solder 157, the potential from the conductor ground plane 160 to the conductor ground plane 156 is the same due to the plurality of vias 163 being provided. Each of the vias 163 is arranged so as to surround the corresponding one of the second patch antennas 162.

Each of the plurality of feeding pins 164 has a feeding structure that feeds power to the corresponding one of the plurality of second patch antennas 162. For example, a set of two feeding pins 164 is provided for one second patch antenna 162. A first polarized wave is fed to one of the feeding pins 164, and a second polarized wave orthogonal to the first polarized wave is fed to the other feeding pin 164. The second patch antennas 162 operate as an antenna by being fed with power from the feeding pins 164. Although the pin feeding method has been described, a feeding structure using slot coupling or spatial coupling of microstrip lines may be used as the structure for feeding power to the second patch antennas 162.

Each of the plurality of hollow structures 165 is constituted by the first patch antenna 161, the conductor removed portion 152*a*, the opening 154*b*, the through hole 155*a*, the opening 156*a*, and the second patch antenna 162. The size of each hollow structure 165 is set so that a gain difference between a vertically polarized wave and a horizontally polarized wave decreases when the antenna device illustrated in FIG. 27 performs beam scanning in the wide angle direction. This suppresses a decrease in an axial ratio when beam scanning is performed in the wide angle direction. The solder 153 and the solder 157 are applied in an amount that does not cause leakage into each hollow structure 165 when melted.

Although the dielectric substrate 151 in which the conductor ground plane 152 is provided on the back side has been described above, the conductor ground plane 152 may be provided on both the front side and the back side of the dielectric substrate 151. In this case, the first patch antennas 161 may be provided only on the conductor ground plane 152 on the back side of the dielectric substrate 151, or may be provided only on the conductor ground plane 152 on the front side of the dielectric substrate 151. Although the configuration in which there is no via in the dielectric substrate 151 and the dielectric substrate 155 has been described above, both or either of these substrates may have a via.

As described above, the antenna device according to the tenth embodiment includes two or more hollow structures 165 each including the through hole 155*a*, the first patch antenna 161, and the second patch antenna 162. In this configuration, the conductor ground plane 152 and the conductor ground plane 154 are bonded by the solder 153 at positions equidistant from the centers of the adjacent first patch antennas 161, and the conductor ground plane 158 and the conductor ground plane 156 are bonded by the solder 157 at positions equidistant from the centers of the adjacent second patch antennas 162. In the antenna device according to tenth embodiment, the conductor ground planes are bonded by the solder applied at positions equidistant from the centers of the adjacent patch antennas, whereby leakage of the solder to the hollow structures 165 can be prevented. Furthermore, the equivalent dielectric constant from the first patch antennas 161 to the second patch antennas 162 can be reduced depending on the size of the through holes 155*a*. Therefore, compared with a typical patch antenna without the hollow structure 165, the radiation efficiency is improved, and the gain when beam scanning is performed in the wide angle direction is improved. In addition, since the second patch antenna 162 fed with power from the feeding pins 164 is provided in each of the plurality of hollow structures 165, it is possible to perform beam scanning in a desired direction by adjusting the feeding phase of the antenna having each hollow structure 165 using a phase shifter.

Eleventh Embodiment

Figure 29:
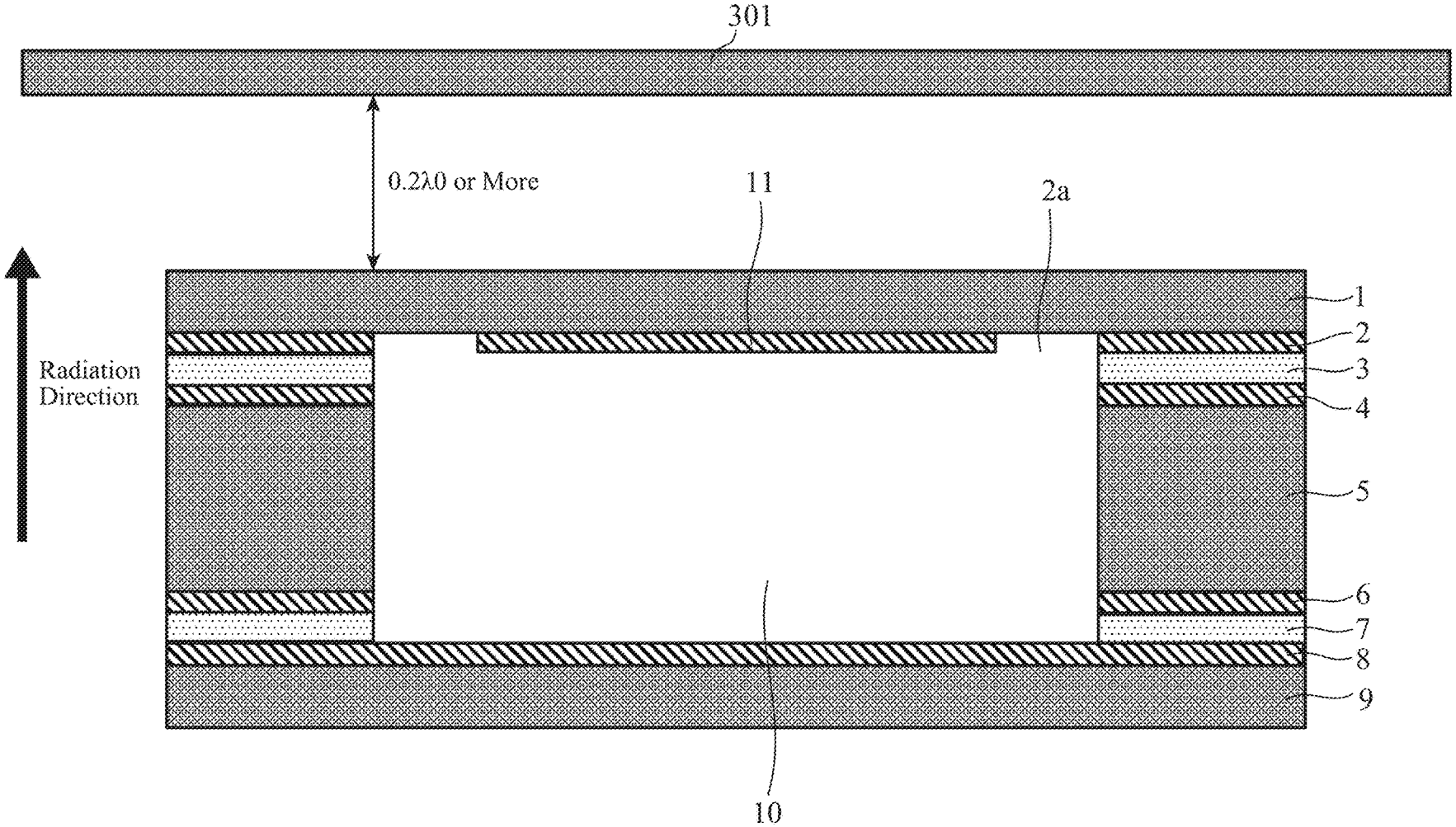
FIG. 29 is a longitudinal sectional view illustrating a configuration of an antenna device according to an eleventh embodiment.
Figure 30:
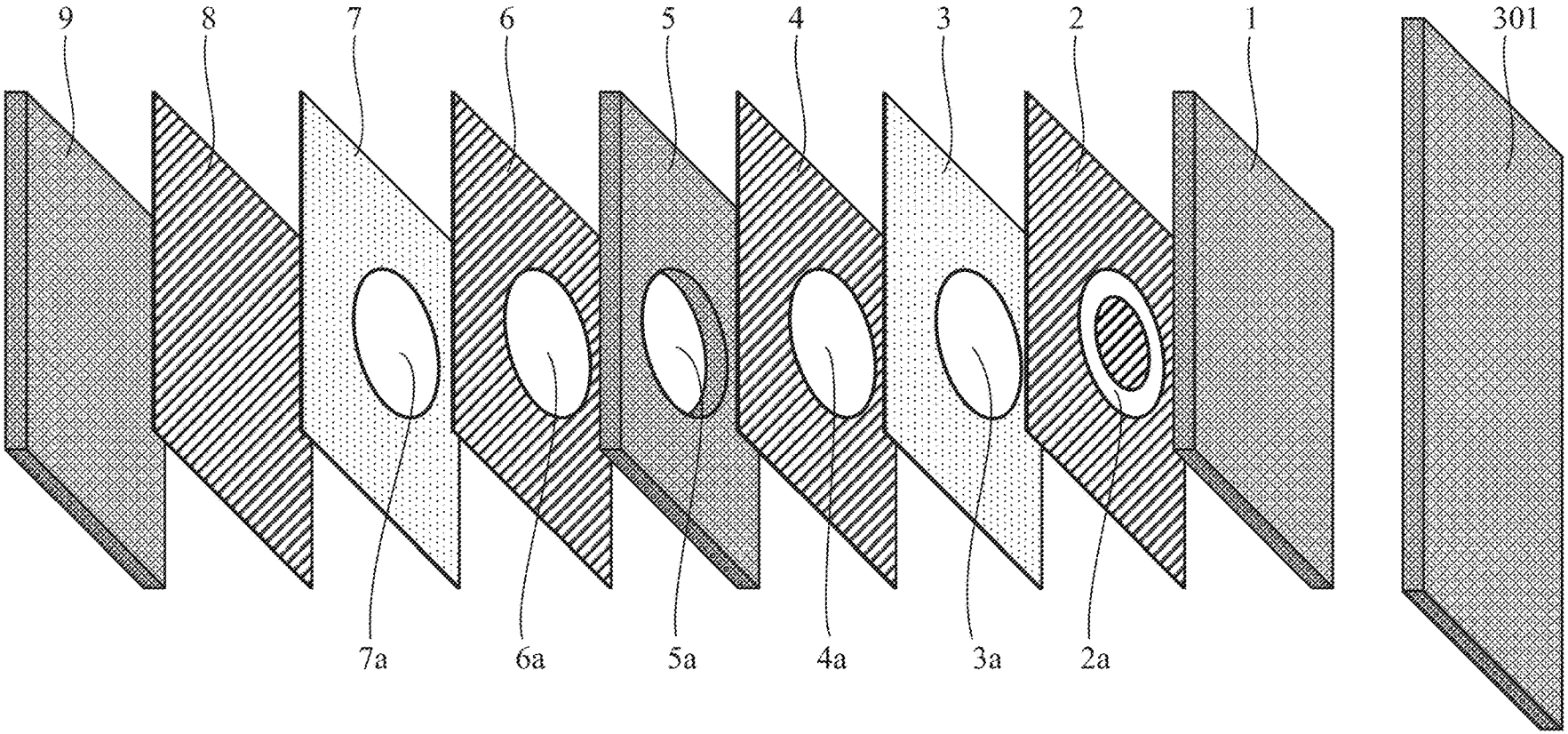
FIG. 30 is an exploded perspective view illustrating the configuration of the antenna device in FIG. 29.

FIG. 29 is a longitudinal sectional view illustrating a configuration of an antenna device according to the eleventh embodiment. FIG. 30 is an exploded perspective view illustrating the configuration of the antenna device shown in FIG. 29. In FIGS. 29 and 30, the same components as those in FIGS. 1 and 2 are identified by the same reference signs, and the description thereof will be omitted. The antenna device according to the eleventh embodiment has a configuration obtained by adding a dielectric substrate 301 to the antenna device illustrated in FIGS. 1 and 2 in the first embodiment. The dielectric substrate 301 is a fourth dielectric substrate provided in parallel with the side (first side) of the dielectric substrate 1 (first dielectric substrate) with a fixed interval therefrom in the radiation direction of the patch antenna 11. The dielectric substrate 301 includes, for example, one or more layers and one or more kinds of dielectric layers or dielectric substrates.

For example, when the relative dielectric constant of the dielectric substrate 301 is about 3, the interval between the front side of the dielectric substrate 1 and the back side of the dielectric substrate 301 is equal to or more than 0.2 times of the wavelength $\lambda 0$ of the design frequency of the antenna device at a position in the radiation direction of the patch antenna and parallel to the front side of the dielectric substrate 1 as illustrated in FIG. 29. The dielectric substrate 301 is larger than the dielectric substrate 1 as illustrated in FIGS. 29 and 30, or substantially equal to the dielectric substrate 1. That is, the dielectric substrate 301 has a size equal to or larger than that of the dielectric substrate 1 having the patch antenna 11.

As described above, the antenna device according to the eleventh embodiment includes the dielectric substrate 301 provided in parallel with the side of the dielectric substrate 1 with a fixed interval therefrom in the radiation direction of the patch antenna 11. As a result, the antenna device according to the eleventh embodiment can reduce a mismatch loss when beam scanning is performed in the wide angle direction, and can further suppress a decrease in gain when beam scanning is performed in the wide angle direction.

The eleventh embodiment describes the configuration in which the dielectric substrate 301 is provided to the antenna device illustrated in FIGS. 1 and 2. However, this is not a limitation. That is, the dielectric substrate 301 may be provided to the antenna device described in any one of the second to tenth embodiments, and the effects similar to those of the eleventh embodiment can be obtained by providing the dielectric substrate 301.

Twelfth Embodiment

Figure 31:
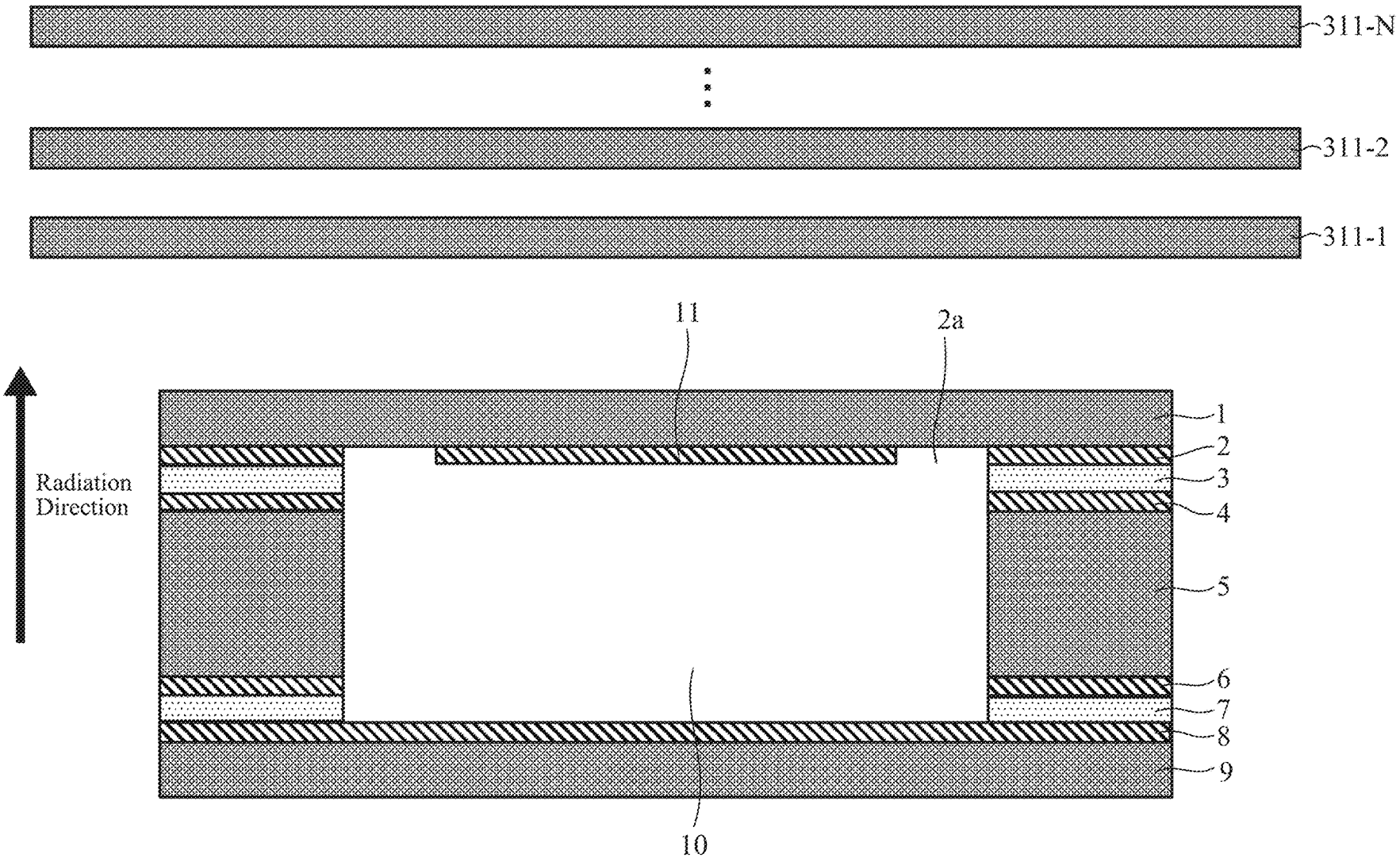
FIG. 31 is a longitudinal sectional view illustrating a configuration of an antenna device according to a twelfth embodiment.
Figure 32:
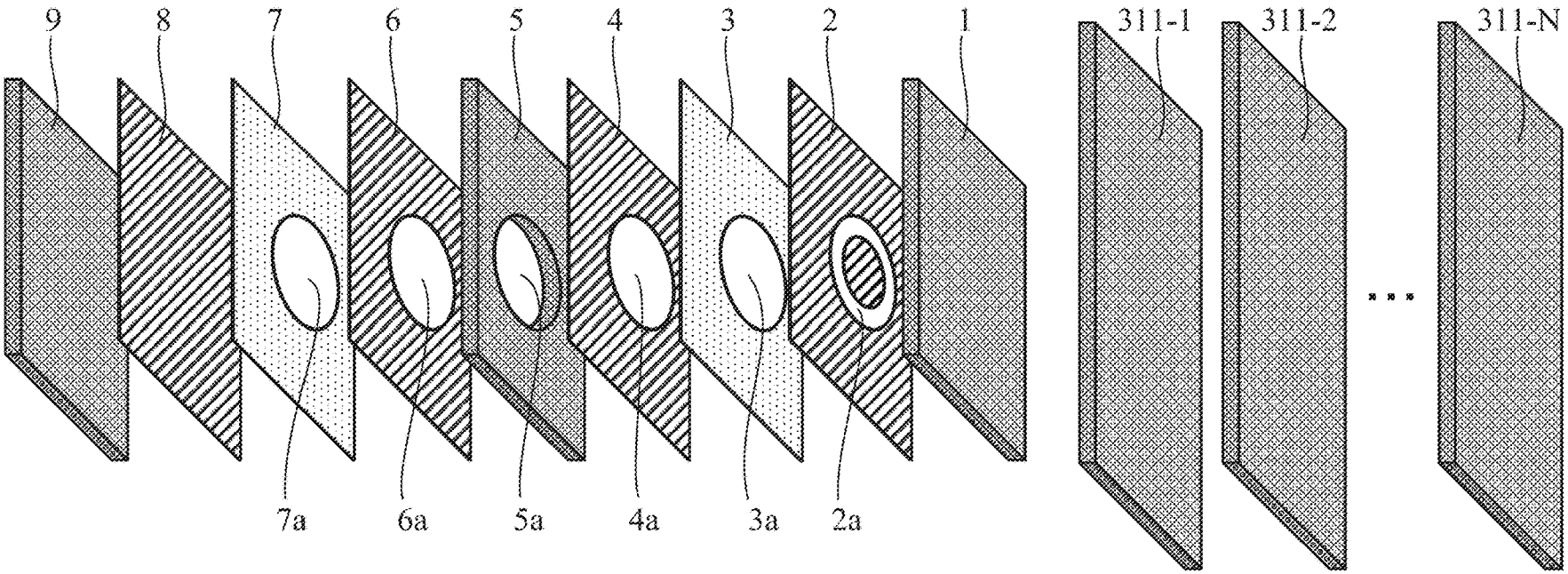
FIG. 32 is an exploded perspective view illustrating the configuration of the antenna device in FIG. 31.

FIG. 31 is a longitudinal sectional view illustrating a configuration of an antenna device according to the twelfth embodiment. FIG. 32 is an exploded perspective view illustrating the configuration of the antenna device shown in FIG. 31. In FIGS. 31 and 32, the same components as those in FIGS. 1 and 2 are identified by the same reference signs, and the description thereof will be omitted. The antenna device according to the twelfth embodiment has a configuration obtained by providing a plurality of dielectric substrates 311-1, 311-2, . . . , and 311-N to the antenna device illustrated in FIGS. 1 and 2 according to the first embodiment. Here, N is a positive natural number of 2 or more.

The dielectric substrates 311-1, 311-2, . . . , and 311-N are a plurality of dielectric substrates provided in parallel with the side of the dielectric substrate 1 and spaced at regular intervals in the radiation direction of the patch antenna 11. Further, each of the dielectric substrates 311-1, 311-2, . . . , and 311-N includes, for example, one or more layers and one or more kinds of dielectric layers or dielectric substrates. In addition, each of the dielectric substrates 311-1, 311-2, . . . , and 311-N is larger than the dielectric substrate 1 as illustrated in FIGS. 31 and 32, or substantially equal to the dielectric substrate 1. That is, each of the dielectric substrates 311-1, 311-2, . . . , and 311-N has a size equal to or larger than that of the dielectric substrate 1 having the patch antenna 11.

For example, when the relative dielectric constant of each of the dielectric substrates 311-1, 311-2, . . . , and 311-N is about 3, the dielectric substrate 1 and the dielectric substrate 311-1, and the dielectric substrates 311-1, 311-2, . . . , and 311-N are spaced at intervals 0.2 times or more the wavelength $\lambda 0$ of the design frequency of the antenna device at positions in the radiation direction of the patch antenna 11 and parallel to the front side of the dielectric substrate 1.

As described above, the antenna device according to the twelfth embodiment includes a plurality of dielectric substrates 311-1, 311-2, . . . , and 311-N provided in parallel with the side of the dielectric substrate 1 and spaced at regular intervals in the radiation direction of the patch antenna 11. As a result, the antenna device according to the twelfth embodiment can reduce a mismatch loss when beam scanning is performed in the wide angle direction, and can further suppress a decrease in gain when beam scanning is performed in the wide angle direction, as in the eleventh embodiment.

The twelfth embodiment describes the configuration in which the plurality of dielectric substrates 311-1, 311-2, . . . , and 311-N is provided to the antenna device illustrated in FIGS. 1 and 2. However, this is not a limitation. That is, the plurality of dielectric substrates 311-1, 311-2, . . . , and 311-N may be provided to the antenna device described in any one of the second to tenth embodiments, and the effects similar to those of the twelfth embodiment can be obtained by providing the plurality of dielectric substrates 311-1, 311-2, . . . , and 311-N.

Thirteenth Embodiment

Figure 33:
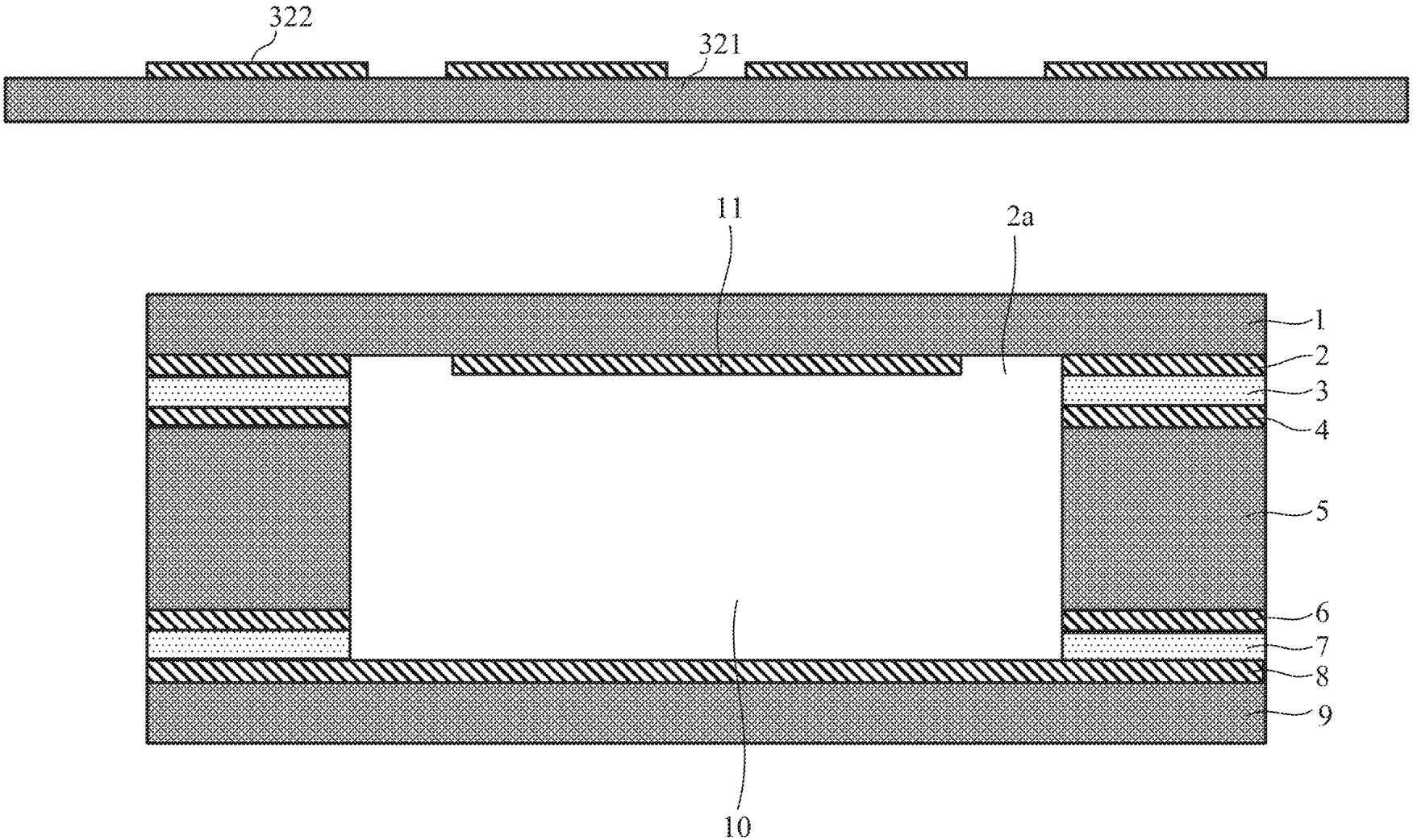
FIG. 33 is a longitudinal sectional view illustrating a configuration of an antenna device according to a thirteenth embodiment.
Figure 34:
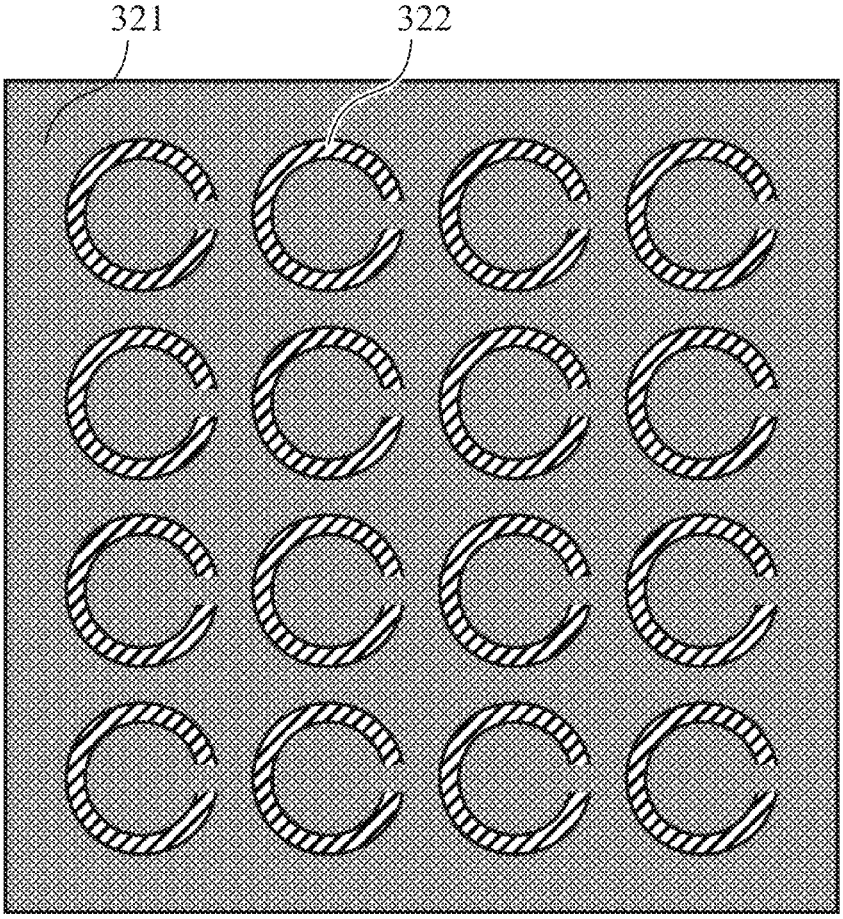
FIG. 34 is a top view illustrating the antenna device in FIG. 33.
Figure 35:
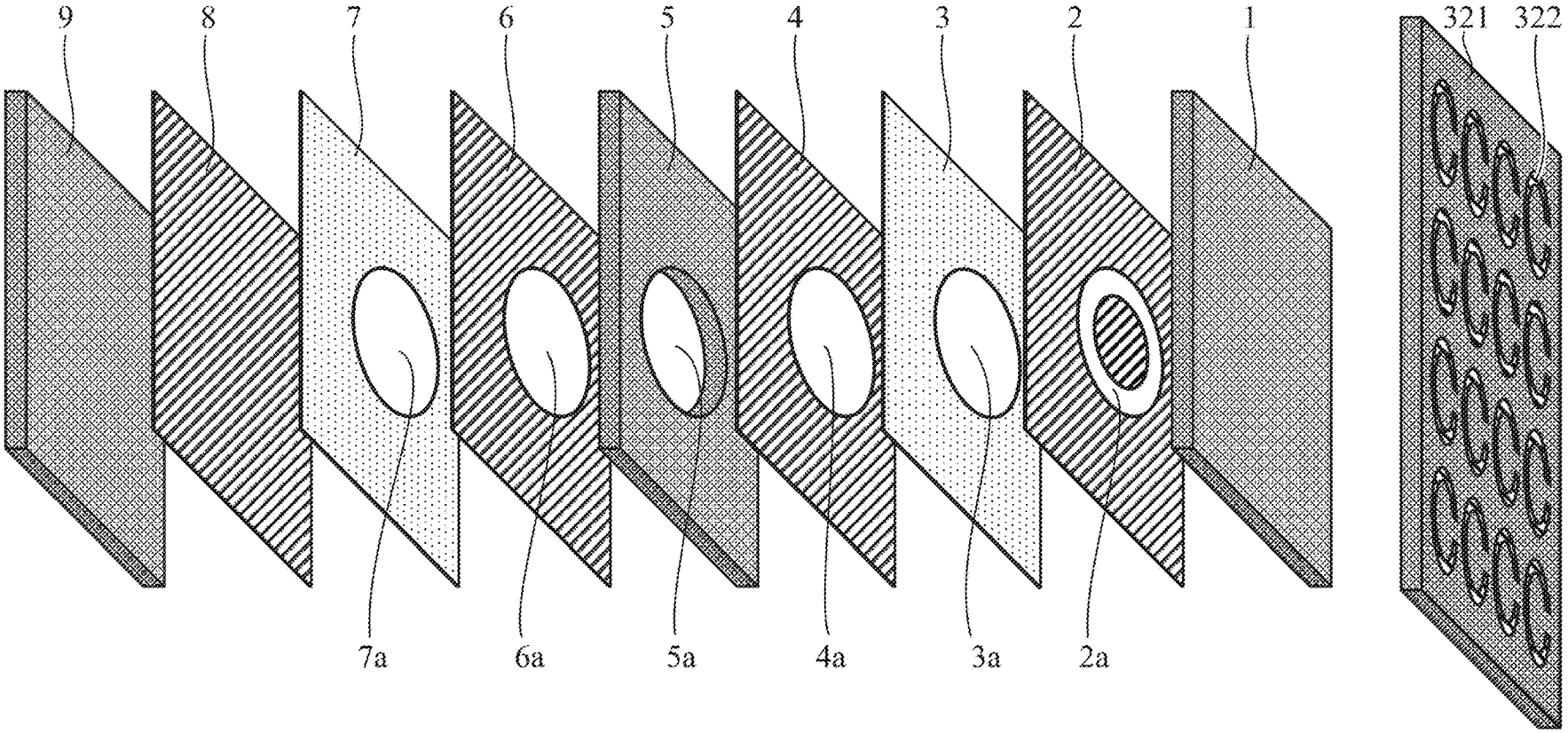
FIG. 35 is an exploded perspective view illustrating the configuration of the antenna device in FIG. 33.

FIG. 33 is a longitudinal sectional view illustrating a configuration of an antenna device according to the thirteenth embodiment. FIG. 34 is a top view of the antenna device in FIG. 33. FIG. 35 is an exploded perspective view illustrating the configuration of the antenna device shown in FIG. 33. In FIGS. 33, 34, and 35, the same components as those in FIGS. 1 and 2 are identified by the same reference signs, and the description thereof will be omitted. The antenna device according to the thirteenth embodiment has a configuration obtained by adding a dielectric substrate 321 to the antenna device illustrated in FIGS. 1 and 2 in the first embodiment. The dielectric substrate 321 is a fourth dielectric substrate provided in parallel with the side (first side) of the dielectric substrate 1 (first dielectric substrate) with a fixed interval therefrom in the radiation direction of the patch antenna 11, and includes a plurality of copper foil patterns 322.

The plurality of copper foil patterns 322 is a plurality of conductor patterns periodically formed on a substrate side (side, first side). Various shapes are conceivable as the shape of the copper foil patterns 322 depending on the application of the antenna device or the like. For example, an annular pattern with a part being opened (split ring shape) as illustrated in FIG. 34 may be used. The dielectric substrate 321 includes, for example, one or more layers and one or more kinds of dielectric layers or dielectric substrates, and has a plurality of copper foil patterns 322 on the side thereof. Thus, the dielectric substrate 321 constitutes a meta-material or a meta-surface.

As described above, in the antenna device according to the thirteenth embodiment, the dielectric substrate 321 has the plurality of copper foil patterns 322 periodically formed on the substrate side. Due to the configuration in which the plurality of copper foil patterns 322 is provided on the dielectric substrate 321 provided in parallel with the side of the dielectric substrate 1 with a fixed interval therefrom in the radiation direction of the patch antenna 11, it is also possible to reduce a mismatch loss when beam scanning is performed in the wide angle direction, and to suppress a decrease in gain when beam scanning is performed in the wide angle direction, as in the eleventh embodiment.

The thirteenth embodiment describes the configuration in which the dielectric substrate 321 is provided to the antenna device illustrated in FIGS. 1 and 2. However, this is not a limitation. That is, the dielectric substrate 321 may be provided to the antenna device described in any one of the second to tenth embodiments, and the effects similar to those of the thirteenth embodiment can be obtained by providing the dielectric substrate 321.

Further, the plurality of copper foil patterns 322 may be provided on each of the plurality of dielectric substrates 311-1, 311-2, . . . , and 311-N described in the twelfth embodiment. With this configuration, effects similar to the effects of the twelfth embodiment can be obtained.

Fourteenth Embodiment

Figure 36:
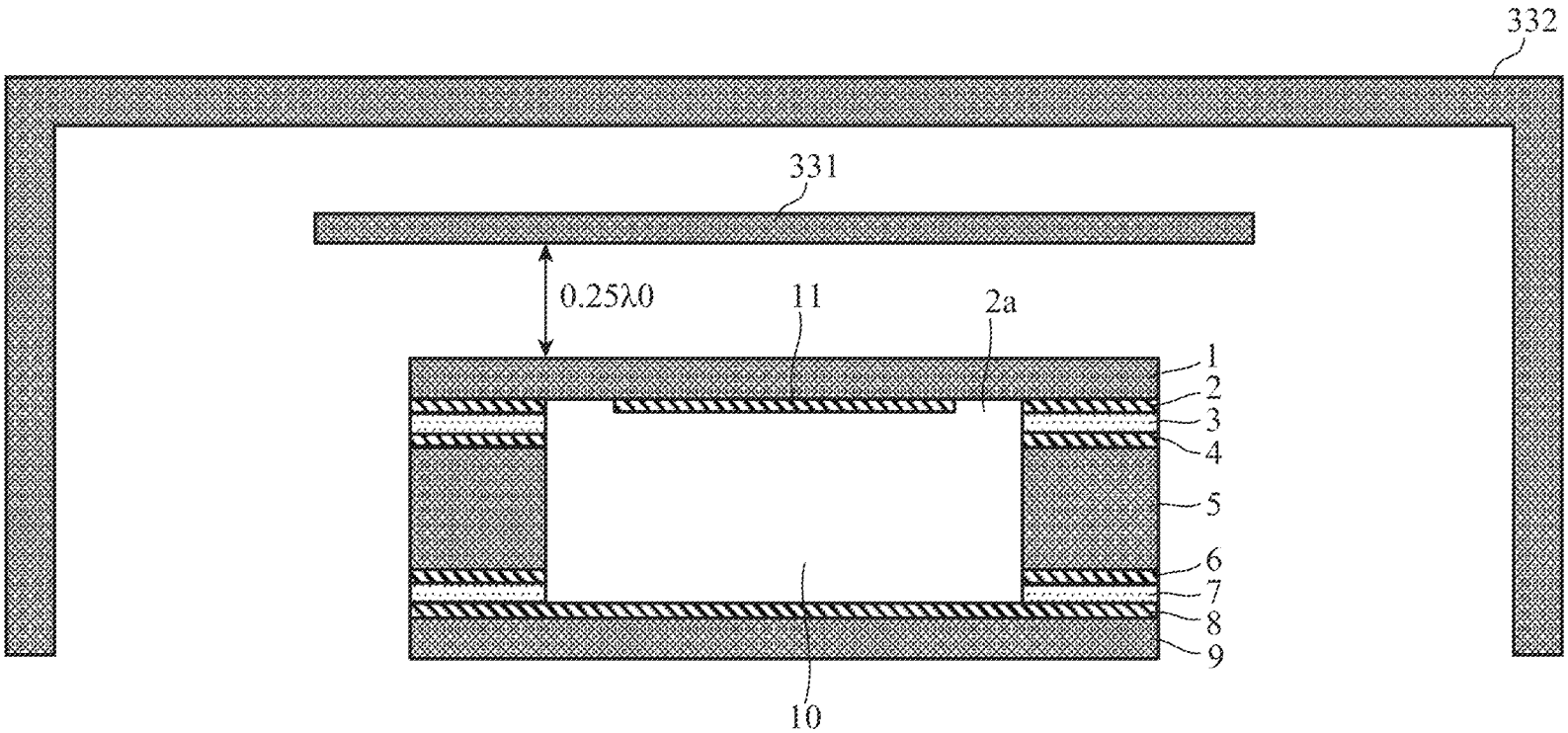
FIG. 36 is a longitudinal sectional view illustrating a configuration of an antenna device according to a fourteenth embodiment.
Figure 37:
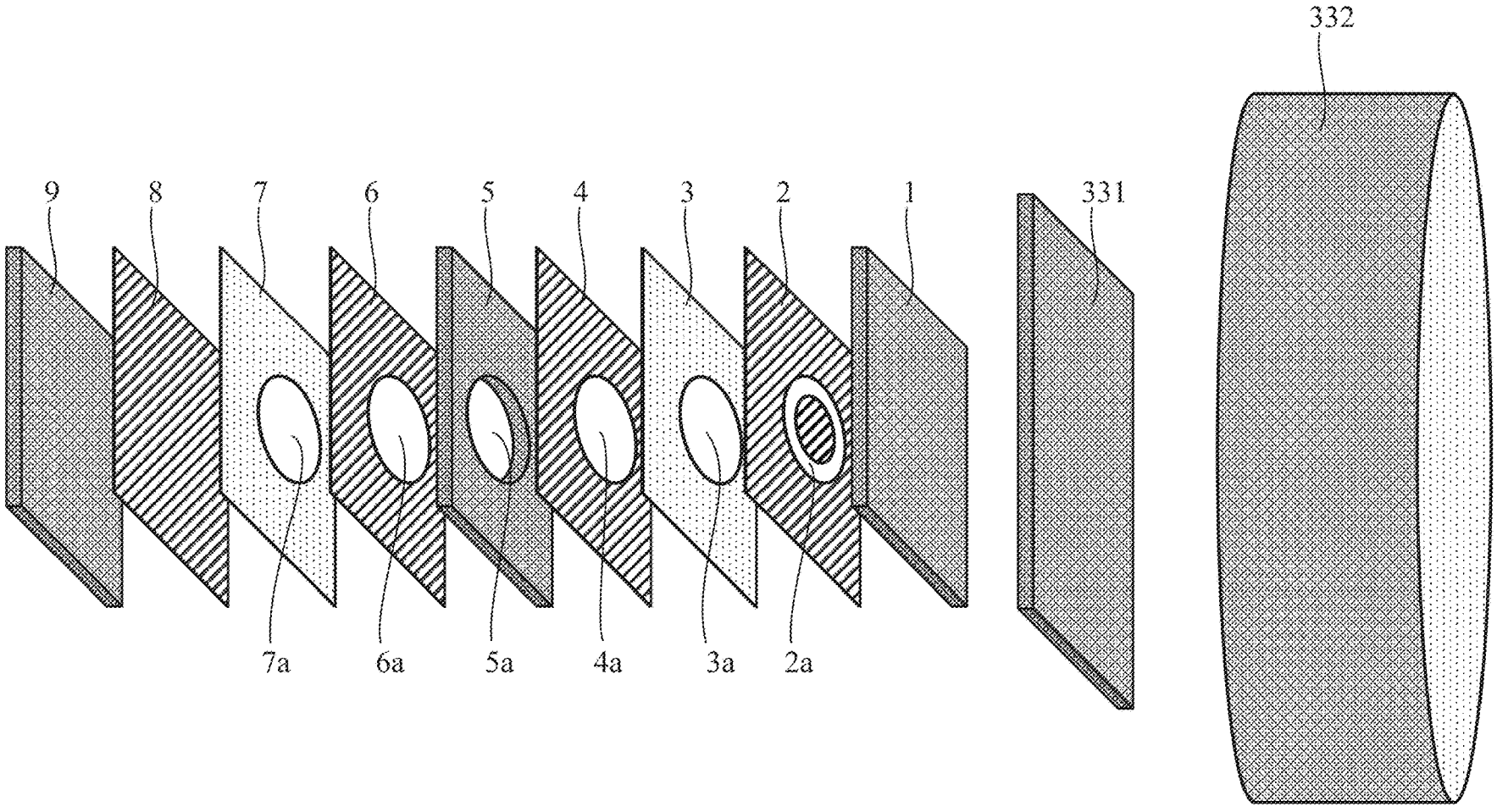
FIG. 37 is an exploded perspective view illustrating the configuration of the antenna device in FIG. 36.

FIG. 36 is a longitudinal sectional view illustrating a configuration of an antenna device according to the fourteenth embodiment. FIG. 37 is an exploded perspective view illustrating the configuration of the antenna device in FIG. 36. In FIGS. 36 and 37, the same components as those in FIGS. 1 and 2 are identified by the same reference signs, and the description thereof will be omitted. The antenna device according to the fourteenth embodiment has a configuration obtained by providing a dielectric substrate 331 and a radome 332 to the antenna device illustrated in FIGS. 1 and 2 according to the first embodiment. The dielectric substrate 331 is a fourth dielectric substrate provided in parallel with the side (first side) of the dielectric substrate 1 (first dielectric substrate) with a fixed interval therefrom in the radiation direction of the patch antenna 11.

The dielectric substrate 331 includes, for example, one or more layers and one or more kinds of dielectric layers or dielectric substrates. For example, when the relative dielectric constant of the dielectric substrate 331 is about 3, the interval between the front side of the dielectric substrate 1 and the back side of the dielectric substrate 331 is equal to or more than 0.2 times of the wavelength λ0 of the design frequency of the antenna device at a position in the radiation direction of the patch antenna 11 and parallel to the front side of the dielectric substrate 1. In the example illustrated in FIG. 36, the interval is 0.25 λ0. The dielectric substrate 331 is larger than the dielectric substrate 1 as illustrated in FIGS. 36 and 37, or substantially equal to the dielectric substrate 1. That is, the dielectric substrate 331 has a size equal to or larger than that of the dielectric substrate 1 having the patch antenna 11.

The radome 332 is provided to cover the entire antenna device, and has, for example, a cylindrical shape as illustrated in FIG. 37. Note that the radome 332 may have a rectangular parallelepiped shape with one side opened, or may have any other shape as long as the entire antenna device can be covered.

As described above, the antenna device according to the fourteenth embodiment includes the radome 332. By providing the radome 332, the antenna device can be protected from a natural environment, for example, wind and rain.

The fourteenth embodiment describes the configuration in which the dielectric substrate 331 and the radome 332 are provided to the antenna device illustrated in FIGS. 1 and 2. However, this is not a limitation. That is, the dielectric substrate 331 and the radome 332 may be provided to the antenna device described in any one of the second to tenth embodiments, and the effects similar to those of the fourteenth embodiment can be obtained by providing the radome 332. Further, the dielectric substrate 331 may be the plurality of dielectric substrates 311-1, 311-2, . . . , and 311-N described in the twelfth embodiment. In this case, the above effects by the radome 332 can be obtained in addition to the effects similar to the effects of the twelfth embodiment. Furthermore, the dielectric substrate 331 may be the dielectric substrate 321 described in the thirteenth embodiment, or may be a plurality of dielectric substrates 311-1, 311-2, . . . , and 311-N each provided with a plurality of copper foil patterns 322. In this case, the above effects by the radome 332 can be obtained in addition to the effects similar to the effects of the thirteenth embodiment.

The present disclosure is not limited to the above embodiments, and two or more of the above embodiments can be freely combined, or any components in the embodiments can be modified or omitted, within the scope of the present disclosure.

INDUSTRIAL APPLICABILITY

The antenna manufacturing method according to the present disclosure can be used, for example, for manufacturing an array antenna device.

REFERENCE SIGNS LIST

1, 5, 9, 21, 26, 30, 41, 47, 50, 55, 59, 71, 77, 101, 104, 107, 121, 125, 129, 139, 139A, 142, 144, 151, 155, 159, 173, 176, 179, 190, 195, 201, 205, 209, 221, 224, 227, 301, 311-1, 311-2, . . . , 311-N, 321, 331: dielectric substrate,
2, 4, 6, 8, 22, 25, 27, 29, 42, 46, 51, 54, 56, 58, 60, 72, 76, 78, 102, 106, 122, 124, 126, 128, 130, 136*a*, 136*b*, 142*a*, 142*b*, 145*a*, 145*b*, 152, 154, 156, 158, 160, 170*a*, 170*b*, 175, 177, 178*a*, 178*b*, 191, 196*a*, 196*b*, 202, 204, 206, 208, 222, 226: conductor ground plane,
2*a*, 22*a*, 42*a*, 51*a*, 58*a*, 72*a*, 76*a*, 102*a*, 122*a*, 128*a*, 152*a*, 158*a*, 202*a*, 222*a*: conductor removed portion,
3, 7, 23, 28, 43, 45, 52, 57, 73, 75, 123, 127, 140*a*, 140*b*, 153, 157, 193*a*, 193*b*, 203, 207: solder,
3*a*, 7*a*, 23*a*, 28*a*, 43*a*, 45*a*, 52*a*, 57*a*, 73*a*, 75*a*, 123*a*, 127*a*: region,
4*a*, 6*a*, 24*b*, 24*d*, 25*a*, 27*a*, 53*b*, 53*d*, 54*a*, 56*a*, 103*a*, 105*a*, 124*a*, 124*b*, 126*a*, 154*a*, 154*b*, 156*a*, 204*a*, 206*a*, 223*a*, 225*a*: opening,
5*a*, 26*a*, 44*a*, 55*a*, 74*a*, 104*a*, 125*a*, 142*c*, 155*a*, 176*a*, 194*a*, 205*a*, 224*a*: through hole,
10, 31, 48, 65, 84, 108, 132, 132*a*, 165, 199, 211, 228: hollow structure,
11, 32, 49, 109, 212, 229: patch antenna,
24*a*, 24*c*, 26*b*, 53*a*, 53*c*, 55*b*, 142*d*, 148*a*, 148*b*, 174*a*, 174*b*, 182: conductor plating,
44, 74, 194: conductor plate,
61*a*, 61*b*, 79*a*, 79*b*, 134, 138, 141, 143, 163, 172*c*, 180*a*, 197*a*: via,
62*a*, 81*a*: first feeding pin,
62*b*, 81*b*: second feeding pin,
63, 80, 133, 137, 161, 171, 192: first patch antenna,
64, 82, 131, 146, 162, 181, 198: second patch antenna,
103, 105, 223, 225: prepreg,
135, 147, 164, 180, 197: feeding pin,
210: land,
224*b*: support portion,
322: copper foil pattern,
332: radome

The invention claimed is:

1. An antenna device comprising:

a first dielectric substrate provided with a first conductor ground plane;

a patch antenna provided on the first conductor ground plane;

a second dielectric substrate including a second conductor ground plane provided on a first side and a third conductor ground plane provided on a second side opposite to the first side, the second dielectric substrate having a through hole penetrating the second dielectric substrate from the second conductor ground plane to the third conductor ground plane; and a third dielectric substrate provided with a fourth conductor ground plane, wherein, in a state in which the through hole and the patch antenna are arranged to face each other, the first conductor ground plane of the first dielectric substrate and the second conductor ground plane of the second dielectric substrate are bonded by a first solder, and the third conductor ground plane of the second dielectric substrate and the fourth conductor ground plane of the third dielectric substrate are bonded by a second solder, wherein a side wall of the through hole is plated with conductor, and the through hole forms a hollow structure between the first dielectric substrate and the third dielectric substrate.

2. The antenna device according to claim 1, wherein the patch antenna is a first patch antenna, and the antenna device further includes:

a feeding structure provided on the third dielectric substrate; and a second patch antenna provided on the third dielectric substrate at a position to be faced by the first patch antenna, the second patch antenna being fed with power from the feeding structure.

3. The antenna device according to claim 2, further comprising two or more of the hollow structures each including the through hole and the patch antenna, wherein the bonding by the first solder is performed at a position equidistant from centers of the first patch antennas adjacent to each other, and the bonding by the second solder is performed at a position equidistant from centers of the second patch antennas adjacent to each other.

4. The antenna device according to claim 1, further comprising a land provided at a bonding portion, wherein the bonding by the first solder is performed on the land, and the bonding by the second solder is performed on the land.

5. The antenna device according to claim 1, further comprising two or more of the hollow structures each including the through hole and the patch antenna.

6. The antenna device according to claim 1, further comprising a fourth dielectric substrate that is provided in parallel with the first side of the first dielectric substrate with a fixed interval in a radiation direction of the patch antenna.

7. The antenna device according to claim 6, wherein the fourth dielectric substrate includes one or more dielectric layers and has a size equal to or larger than a size of the dielectric substrate provided with the patch antenna, and the fixed interval is equal to or more than 0.2 times of a wavelength of a design frequency of the antenna device.

8. The antenna device according to claim 6, wherein the fourth dielectric substrate has a plurality of conductor patterns periodically formed on a substrate side thereof.

9. The antenna device according to claim 8, further comprising a radome that entirely covers the antenna device.

10. The antenna device according to claim 6, further comprising a radome that entirely covers the antenna device.

11. The antenna device according to claim 1, further comprising a plurality of dielectric substrates that is provided in parallel with the first side of the first dielectric substrate and is spaced at regular intervals in a radiation direction of the patch antenna.

12. The antenna device according to claim 11, wherein each of the plurality of dielectric substrates has a plurality of conductor patterns periodically formed on a substrate side thereof.

* * * * *